US010739034B2

(12) United States Patent
Liu et al.

(10) Patent No.: US 10,739,034 B2
(45) Date of Patent: Aug. 11, 2020

(54) INDOOR UNIT FOR AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Xing Liu, Foshan (CN); Xiaofeng Bai, Foshan (CN); Xinzhou Zhang, Foshan (CN); Dacheng Li, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 83 days.

(21) Appl. No.: 15/323,276

(22) PCT Filed: Mar. 31, 2015

(86) PCT No.: PCT/CN2015/075635
§ 371 (c)(1),
(2) Date: Dec. 30, 2016

(87) PCT Pub. No.: WO2016/154955
PCT Pub. Date: Oct. 6, 2016

(65) Prior Publication Data
US 2018/0017282 A1 Jan. 18, 2018

(51) Int. Cl.
*F24F 13/20* (2006.01)
*F24F 1/0007* (2019.01)
(Continued)

(52) U.S. Cl.
CPC ..... *F24F 13/20* (2013.01); *F24F 1/0007* (2013.01); *F24F 1/0057* (2019.02); *F24F 11/89* (2018.01);
(Continued)

(58) Field of Classification Search
CPC ..... F24F 13/20; F24F 1/0057; F24F 1/0007; F24F 11/89; F24F 13/28; F24F 13/30; F24F 1/0025; F24F 2221/22
(Continued)

(56) References Cited

U.S. PATENT DOCUMENTS 5,203,400 A * 4/1993 Tsunekawa ..... F24F 13/20 165/59
5,575,326 A * 11/1996 Asami ..... F24F 1/0057 165/124
(Continued)

FOREIGN PATENT DOCUMENTS

AU 2015389069 B2 7/2018
CA 2952283 A1 10/2016
(Continued)

OTHER PUBLICATIONS

Australian Government IP Australia, Notice of acceptance for patent application, dated Jul. 12, 2018 (Year: 2018).*
(Continued)

*Primary Examiner* — Edelmira Bosques
*Assistant Examiner* — Frances F. Hamilton
(74) *Attorney, Agent, or Firm* — Anova Law Group PLLC

(57) ABSTRACT

An indoor unit for an air conditioner is provided. The indoor unit includes a housing, and the housing including an upper base plate provided with an air inlet, a lower base plate detachably mounted to the upper base plate and provided with an air outlet, and a front cover detachably mounted to the upper base plate; a heat exchanger mounted to the upper base plate; a fan detachably mounted to the lower base plate; and a guide assembly configured to guide the lower base plate when mounting and dismounting the lower base plate.

34 Claims, 34 Drawing Sheets

(51) Int. Cl.

| | |
|---|---|
| ***F24F 1/0057*** | (2019.01) |
| ***F24F 11/89*** | (2018.01) |
| *F24F 1/0025* | (2019.01) |
| *F24F 13/28* | (2006.01) |
| *F24F 13/30* | (2006.01) |

(52) U.S. Cl.
CPC ..... *F24F 1/0025* (2013.01); *F24F 13/28* (2013.01); *F24F 13/30* (2013.01)

(58) Field of Classification Search
USPC ..... 454/233
See application file for complete search history.

(56) References Cited

U.S. PATENT DOCUMENTS

| | | | | |
|---|---|---|---|---|
| 6,745,589 | B2 * | 6/2004 | Katatani | F24F 1/027 62/259.1 |
| 8,505,327 | B2 * | 8/2013 | Son | F24F 1/0007 62/407 |
| 8,961,126 | B1 * | 2/2015 | Tom | F24F 13/078 415/213.1 |
| 9,759,446 | B2 * | 9/2017 | Stewart | F24F 13/30 |
| 10,139,115 | B2 * | 11/2018 | Lackie | F24F 3/0442 |
| 2011/0314855 | A1 * | 12/2011 | Yu | F24F 1/0007 62/222 |
| 2014/0213172 | A1 * | 7/2014 | Jameson | F24F 7/04 454/284 |
| 2015/0096723 | A1 * | 4/2015 | Jeong | F24F 13/1426 165/121 |

FOREIGN PATENT DOCUMENTS

| | | | | | |
|---|---|---|---|---|---|
| CA | 2954009 | A1 | | 10/2016 | |
| CN | 102374630 | A | | 3/2012 | |
| CN | 102472508 | A | * | 5/2012 | F24F 1/0007 |
| CN | 102472508 | A | | 5/2012 | |
| CN | 103939992 | A | | 7/2014 | |
| CN | 104422026 | A | * | 3/2015 | |
| CN | 104422026 | A | | 3/2015 | |
| CN | 104748238 | A | | 7/2015 | |
| CN | 104748344 | A | | 7/2015 | |
| CN | 204629734 | U | | 9/2015 | |
| CN | 204629963 | U | | 9/2015 | |
| EP | 1526339 | A2 | | 4/2005 | |
| EP | 1526339 | A2 | * | 4/2005 | F24F 13/20 |
| JP | 2004020151 | A | | 1/2004 | |
| JP | 2004020151 | A | * | 1/2004 | |
| JP | 2004190991 | A | | 7/2004 | |

OTHER PUBLICATIONS

European Patent Application No. 15886925.5, Extended Search and Opinion dated Oct. 24, 2018, 8 pages.
Canadian Patent Application No. 2,956,247 Office Action dated Jan. 9, 2018, 5 pages.
Canadian Intellectual Property Office (CIPO) The Second Office Action for CA Application No. 2,956,247 dated Oct. 25, 2018 3 Pages.
Canadian Intellectual Property Office (CIPO) The Third Office Action for CA Application No. 2,956,247 dated Aug. 8, 2019 3 Pages.
World Intellectual Property Organization (WIPO) International Search Report for PCT/CN2015/075635 dated Dec. 31, 2015 15 Pages.
Intellectual Property Corporation of Malaysia The Substantive Examination Adverse Report and Search Report for Malaysia Application No. PI2016704865 dated Mar. 31, 2020 4 Pages.

* cited by examiner

B-B

INDOOR UNIT FOR AIR CONDITIONER

RELATED APPLICATIONS

This U.S. application claims priority under 35 U.S.C 371 to, and is a U.S. National Phase application of, the International Patent Application No. PCT/CN2015/075635, filed on Mar. 31, 2015. The entire content of the before-mentioned patent application is incorporated by reference as part of the disclosure of this U.S. application.

FIELD

The present invention relates to a field of household appliances, and more particularly to an indoor unit for an air conditioner.

BACKGROUND

An indoor unit for an air conditioner in the prior art has a housing that is constituted by a base plate, a face frame mounted to the base plate, and a panel mounted to the face frame. A heat exchanger and a fan are mounted to the base plate, and a fan wheel of the fan is located at an inner side of the heat exchanger. Even though the face frame is dismounted, the fan wheel cannot be dismounted only if the heat exchanger is also dismounted, because the fan wheel is limited by the heat exchanger and the base plate together, which brings about great inconvenience for a user to dismount the fan wheel. The dismounting and cleaning of the fan wheel cannot be performed by the user, but needs professional help, which results in a high cost.

SUMMARY

The present invention aims to at least solve one of the problems existing in the related art to some extent. Thus, embodiments of the present invention provide an indoor unit for an air conditioner. It is convenient to assemble or disassemble a fan of the indoor unit.

According to embodiments of the present invention, the indoor unit includes: a housing including an upper base plate provided with an air inlet, a lower base plate detachably mounted to the upper base plate and provided with an air outlet, and a front cover detachably mounted to the upper base plate; a heat exchanger mounted to the upper base plate; a fan detachably mounted to the lower base plate; and a guide assembly configured to guide the lower base plate when mounting and dismounting the lower base plate.

For the indoor unit according to the embodiments of the present invention, the guide assembly is provided to explicitly guide the lower base plate during the process of mounting and dismounting the lower base plate, so as to make the process easy, thus improving the efficiency of mounting and dismounting the lower base plate. Additionally, it is easy to mount the lower base plate to the upper base plate under the guiding function of the guide assembly, so as to avoid or decrease damage of the upper base plate or the lower base plate caused by an improper mounting way of the lower base plate, thus improving the qualified rate of the indoor unit and the housing thereof.

In an embodiment of the present invention, the guide assembly includes: a guide groove provided in the upper base plate; and a guide rail configured to be fitted with the guide groove and disposed on the lower base plate.

In an embodiment of the present invention, the guide groove extends upwards from a bottom of the upper base plate and has an open bottom end, and at least one of a size of the guide groove in a left and right direction and a size thereof in a front and rear direction is decreased gradually from down to up.

In an embodiment of the present invention, the guide rail has a shape decreased gradually from down to up in size and matched with a shape of the guide groove.

In an embodiment of the present invention, a rib is provided on at least one of a top wall, a bottom wall and a side wall of the guide groove, and extends inwards from an opening of the guide groove.

In an embodiment of the present invention, the guide groove is provided with a position limiting protrusion, the guide rail is provided with a position limiting groove, and the position limiting protrusion is configured to be fitted in the position limiting groove.

In an embodiment of the present invention, the position limiting protrusion is provided on a bottom wall of the guide groove and adjacent to an upper end of the guide groove; and the position limiting groove is provided in a rear surface of the guide rail and adjacent to an upper end of the guide rail.

In an embodiment of the present invention, two guide grooves are provided at a left end and a right end of the upper base plate respectively and each guide groove is provided with the position limiting protrusion therein; two guide rails are provided at a left end and a right end of the lower base plate respectively and each guide rail is provided with the position limiting groove therein; and the two guide rails are slidably fitted in the two guide grooves respectively, and two position limiting protrusions are slidably fitted in two position limiting grooves respectively.

In an embodiment of the present invention, the upper base plate is provided with a connecting groove, the lower base plate is provided with a connecting protrusion, and the connecting protrusion is configured to be fitted in the connecting groove.

In an embodiment of the present invention, the upper base plate is provided with an elastic arm, and the connecting groove is provided in the elastic arm.

In an embodiment of the present invention, ribs of the elastic arm located at both sides of the connecting groove are arranged in a stagger manner.

In an embodiment of the present invention, the elastic arm extends along an up and down direction, the connecting groove in the elastic arm extends along a left and right direction, and an inner side surface of a first rib of the elastic arm located behind the connecting groove protrudes inwards beyond an inner side surface of a second rib of the elastic arm located in front of the connecting groove.

In an embodiment of the present invention, the connecting groove is provided at the right end of the upper base plate, and the connecting protrusion is provided at the right end of the lower base plate.

In an embodiment of the present invention, the connecting groove is provided in the guide groove and adjacent to a lower end of the upper base plate.

In an embodiment of the present invention, the lower base plate is further fixed to the upper base plate via a first threaded fastener.

In an embodiment of the present invention, the upper base plate includes: a rear baffle, the heat exchanger being provided to the rear baffle; an upper cover plate having a rear edge connected with an upper edge of the rear baffle and formed with the air inlet therein; a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate. The lower base plate is detachably mounted at a right side of the left end plate and at a left side of the right end plate, the left end plate is located at a left side of the lower base plate and the right end plate is located at a right side of the lower base plate.

In an embodiment of the present invention, the upper base plate further includes: a left shield plate mounted to a left side of the left end plate; and a right shield plate mounted to a right side of the right end plate. The front cover is detachably mounted to the left shield plate and the right shield plate.

In an embodiment of the present invention, an air inlet grille is provided at the air inlet of the upper cover plate, and formed with an air inlet hole running through the upper cover plate.

In an embodiment of the present invention, a bending plate portion is provided at a rear portion of the upper cover plate and extends rearwards and downwards, and a wall-hung groove is defined between the bending plate portion and a rear wall of the upper base plate.

In an embodiment of the present invention, the wall-hung groove extends over an entire length of the upper cover plate.

In an embodiment of the present invention, the bending plate portion is provided with a grid-like process groove.

In an embodiment of the present invention, the indoor unit further includes a filter mesh disposed in the upper base plate.

In an embodiment of the present invention, a supporting bar is disposed in front of the upper base plate, an inserting groove is defined between the supporting bar and the upper cover plate, and the filter mesh is fitted in the inserting groove in a drawable manner.

In an embodiment of the present invention, the supporting bar is located at a lower portion of the upper cover plate.

In an embodiment of the present invention, the supporting bar is integrally formed with the upper cover plate.

In an embodiment of the present invention, a plurality of air inlet holes are provided and configured to have a grid-like shape.

In an embodiment of the present invention, the air inlet grille is integrally formed in the upper cover plate.

In an embodiment of the present invention, the fan includes: a fan wheel detachably mounted to the lower base plate; and a motor detachably mounted to the lower base plate and connected with the fan wheel in a transmission way.

In an embodiment of the present invention, a motor mounting groove is provided in the lower base plate, the upper base plate is provided with a water receiving cover; the motor is mounted in the motor mounting groove, and the water receiving cover is located below the heat exchanger and presses the motor in the motor mounting groove.

In an embodiment of the present invention, an air deflector is provided at the air outlet of the lower base plate and exposed from an air supply port.

In an embodiment of the present invention, the indoor unit includes a middle supporter having a first end mounted to the upper base plate and a second end mounted to the lower base plate.

In an embodiment of the present invention, the first end of the middle supporter is mounted to a front surface of the upper base plate and the second end thereof is mounted to a front surface of the lower base plate, and the first end and the second end of the middle supporter are located in middle of the indoor unit in a left and right direction.

In an embodiment of the present invention, the front cover is detachably mounted to the upper base plate, the first end of the middle supporter is rotatably mounted to the upper base plate, and the second end thereof is mounted to the lower base plate via a second threaded fastener.

In an embodiment of the present invention, a first position limiting groove is provided in an inner surface of the front cover, and the second end of the middle supporter is provided with a tongue piece configured to be fitted with the first position limiting groove.

In an embodiment of the present invention, the first end of the middle supporter is provided with a rotating shaft, the upper base plate is provided a shaft hole, and the rotating shaft is rotatably fitted in the shaft hole.

In an embodiment of the present invention, the first end of the middle supporter is provided with an arc arm for pressing the middle supporter against the upper base plate, and the rotating shaft is provided on the arc arm.

In an embodiment of the present invention, the second end of the middle supporter is provided with a screw hole, the lower base plate is provided with a stud, and the second end of the middle supporter is mounted to the lower base plate via the second threaded fastener fitted in the screw hole and the stud.

In an embodiment of the present invention, the second end of the middle supporter is provided with a positioning boss, the positioning boss is provided with a positioning groove, and the stud is fitted in the positioning groove.

In an embodiment of the present invention, the middle supporter is provided with an anti-drop protrusion, the upper base plate is provided with an anti-drop groove, and the anti-drop protrusion is fitted in the anti-drop groove.

In an embodiment of the present invention, the front cover defines a covering chamber, the upper base plate and the lower base plate are disposed in the covering chamber and shielded by the front cover, and the front cover is provided with an air supply port in a position corresponding to the air outlet.

In an embodiment of the present invention, the front cover includes: a front panel covering front surfaces of the upper base plate and the lower base plate; a lower panel having a front edge connected with a lower edge of the front panel, and covering a lower surface of the lower base plate, wherein an air supply port is provided at a position where the front panel and the lower panel are connected; a left panel having a front edge connected with a left edge of the front panel and a lower edge connected with a left edge of the lower panel, rotatably mounted to a left side of the upper base plate and covering the left side of the upper base plate; and a right panel having a front edge connected with a right edge of the front panel and a lower edge connected with a right edge of the lower panel, rotatably mounted to a right side of the upper base plate and covering the right side of the upper base plate.

In an embodiment of the present invention, the front panel is connected the lower panel via an arc transition portion.

In some embodiments, the indoor unit further includes an electric control box assembly. The electric control box assembly includes an electric control box body; an electric control box lid provided at a top of the electric control box body; an electric control printed circuit board provided in the electric control box body and arranged along a vertical direction; a ground sheet provided at the top of the electric control box body; and a wire holder provided at the top of the electric control box body and located on the ground sheet.

In some embodiments, a mounting groove is formed in each of two opposite inner walls of the electric control box body, and each end of the electric control printed circuit board extends into a corresponding mounting groove.

In some embodiments, an extension part is provided at the top of the electric control box body and extends in a direction running away from a center of the electric control box body, in which the ground sheet and the wire holder are provided on the extension part.

In some embodiments, the extension part is provided with a first position limiting rib, and the first position limiting rib includes two first position limiting sub-ribs that are spaced apart from each other in a width direction of the ground sheet.

In some embodiments, the extension part is provided with a second position limiting rib spaced apart from the first position limiting rib in a length direction of the ground sheet, and the second position limiting rib includes two second position limiting sub-ribs that are spaced apart from each other in the width direction of the ground sheet. The wire holder is disposed between the first position limiting rib and the second position limiting rib.

In some embodiments, the ground sheet is provided with at least one ground screw, and the extension part is provided with at least one seal sleeve fitted with the at least one ground screw.

In some embodiments, a plurality of ground screws are provided and spaced apart from one another along the length direction of the ground sheet.

In some embodiments, a snap piece is provided at at least one of two ends of the ground sheet along the length direction thereof, and the extension part is provided with a snap groove fitted with the snap piece.

In some embodiments, the snap piece is formed by bending a part of the ground sheet.

In some embodiments, the ground sheet is connected to the extension part via a third threaded fastener.

In some embodiments, the electric control box body is provided with a plurality of wire-running hooks.

In some embodiments, at least one fastener is provided at a bottom of the electric control box body.

In some embodiments, the electric control box lid is connected to the top of the electric control box body via a snap.

In an embodiment of the present invention, the electric control box assembly is detachably mounted to the upper base plate.

In an embodiment of the present invention, the electric control box assembly is positioned to the upper base plate via a snap structure.

In an embodiment of the present invention, the electric control box assembly is further fixed to the upper base plate via a screw.

In an embodiment of the present invention, the upper base plate defines a mounting space at an end of the heat exchanger, and the electric control box assembly is disposed in the mounting space.

Figure 1:
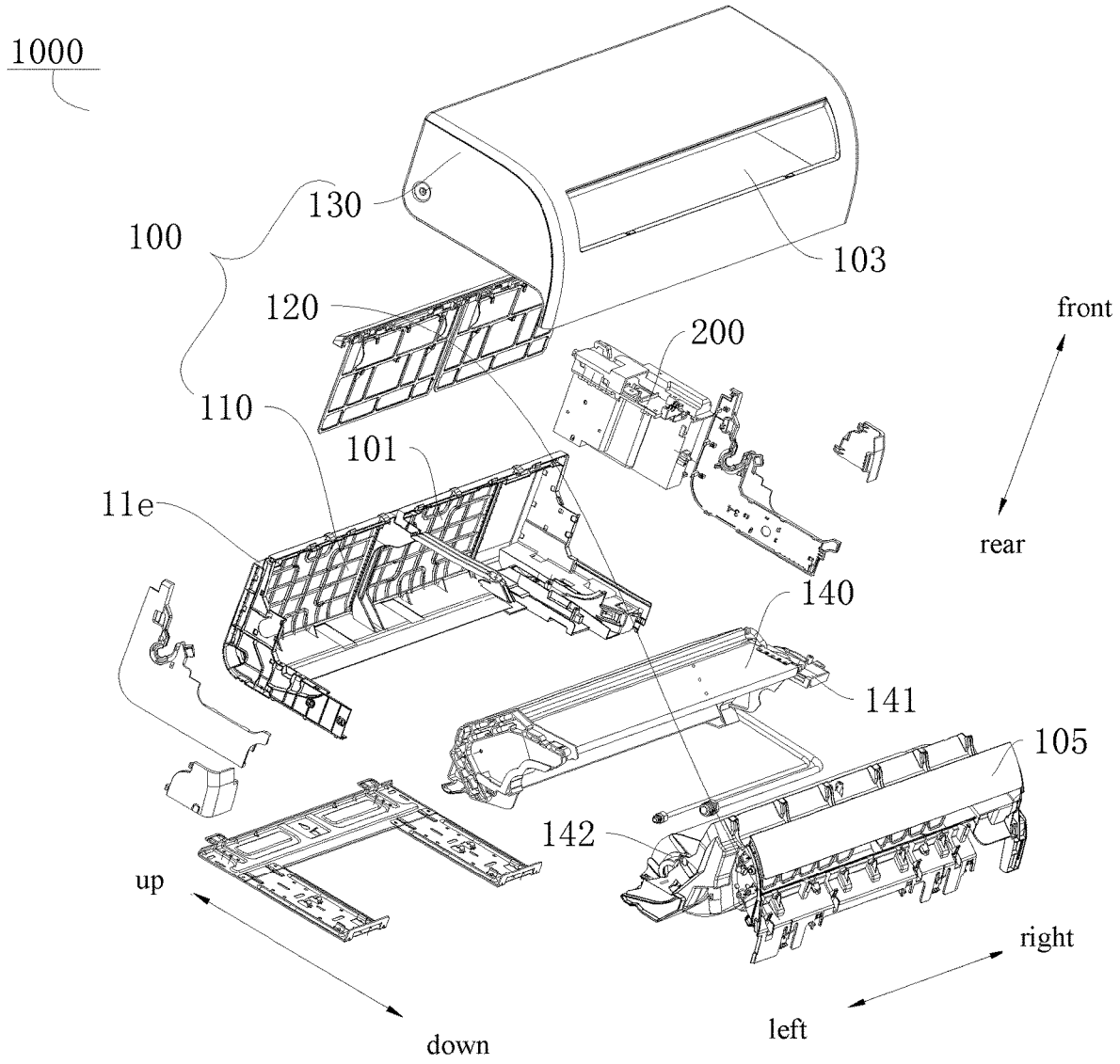
FIG. 1 is an exploded schematic view of an indoor unit for an air conditioner in a direction according to an embodiment of the present invention.

REFERENCE NUMERALS indoor 1000 unit of air conditioner, housing 100, air inlet 101, air supply port 103, covering chamber 104, air deflector 105, upper base plate 110, rear baffle 111, upper cover plate 112, left end plate 113, right end plate 114, left shield plate 115, right shield plate 116, air inlet grille 117, shaft hole 118, anti-drop groove 119, mounting lug 11*a*, bending plate portion 11*b*2, process groove 11*b*3, wall-hung groove 11*c*, supporting bar 11*d*, inserting groove 11*e*, lower base plate 120, stud 121, reinforcing rib 1211, front cover 130, front panel 131, lower panel 132, left panel 133, right panel 134, first position limiting groove 135, heat exchanger 140, water receiving cover 141, fan 142, fan wheel 143, motor 144, filter mesh 145, middle supporter 160, first end 160*a* of middle supporter, second end 160*b* of middle supporter, tongue piece 161, rotating shaft 162, arc arm 163, anti-drop protrusion 164, screw hole 165, positioning boss 166, positioning groove 167, middle supporter reinforcing rib 168, electric control box assembly 200, electric control box body 210, mounting groove 211, extension part 212, first position limiting rib 2121, first position limiting sub-rib 2121*a*, second position limiting rib 2122, second position limiting sub-rib 2122*a*, seal sleeve 2123, snap groove 2124, wire-running hook 213, fastener 214, electric control box lid 220, snap 221, electric control printed circuit board 230, ground sheet 240, ground screw 241, snap piece 242, wire holder 250, wire 251, wall-hung plate 146, guide assembly a14, guide groove a141, rib a1411, guide rail a142, position limiting protrusion a151, position limiting groove a152, connecting groove a153, connecting protrusion a154, elastic arm a155, first rib b1551, second rib a1552.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

As shown in FIGS. 1 to 42, an indoor unit 1000 for an air conditioner according to embodiments of the present invention includes a housing 100, a heat exchanger 140, a fan 142 and a guide assembly a14.

Specifically, the housing 100 includes: an upper base plate 110, a lower base plate 120 detachably mounted to the upper base plate 110, and a front cover 130 detachably mounted to the upper base plate 110. The upper base plate 110 is provided with an air inlet 101 for air supply, and the lower base plate 120 is provided with an air outlet (not shown) for air exhaust. Driven by the fan 142, an air flow enters the indoor unit 1000 from the air inlet 101 and is sent out through the air outlet. The air flow exchanges heat with the heat exchanger 140 in the indoor unit 1000. The heat exchanger 140 is mounted to the upper base plate 110, and the fan 142 is detachably mounted to the lower base plate 120.

As shown in FIGS. 6 to 16, the guide assembly a14 is used for guiding the lower base plate 120 in the process of mounting and dismounting the lower base plate 120. That is, the lower base plate 120 is moved, along a first guiding direction of the guide assembly a14, to a first position where it will be mounted to the upper base plate 110, when the lower base plate 120 needs mounting to the upper base plate 110; the lower base plate 120 is moved, along a second guiding direction of the guide assembly a14, to a second position where it will be dismounted from the upper base plate 110, when the lower base plate 120 needs dismounting from the upper base plate 110.

For the indoor unit 1000 according to embodiments of the present invention, the guide assembly a14 is provided to explicitly guide the lower base plate 120 during the process of mounting and dismounting the lower base plate 120, so as to make the process easy, thus improving the efficiency of mounting and dismounting the lower base plate 120. Additionally, it is easy to mount the lower base plate 120 to the upper base plate 110 under the guiding function of the guide assembly a14, so as to avoid or decrease damage of the upper base plate 110 or the lower base plate 120 caused by an improper mounting way of the lower base plate 120 and thus to improve the qualified rate of the indoor unit 1000 and the housing 100 thereof.

In addition, the fan 142 is mounted to the lower base plate 120 and the lower base plate 120 is detachably mounted to the upper base plate 110, such that the cleaning, maintenance and repair of the fan 142 just need to dismount the lower base plate 120 from the upper base plate 110, and hence the fan 142 may be dismounted from the indoor unit 1000, which avoids the problem in the prior art that the heat exchanger 140 affects the mounting and dismounting of the fan 142. The convenient dismounting of the fan 142 in the present invention facilitates cleaning a fan wheel 143 of the fan 142. The cleaning of the fan wheel 143 does not involve the dismounting and mounting of the heat exchanger 140, which thus avoids the problem that the heat exchanger 140 tends to break down due to the dismounting and mounting thereof during the cleaning of the fan 142, thereby facilitating the maintenance of the indoor unit 1000 and reduces the failure rate of the indoor unit 1000.

Figure 2:
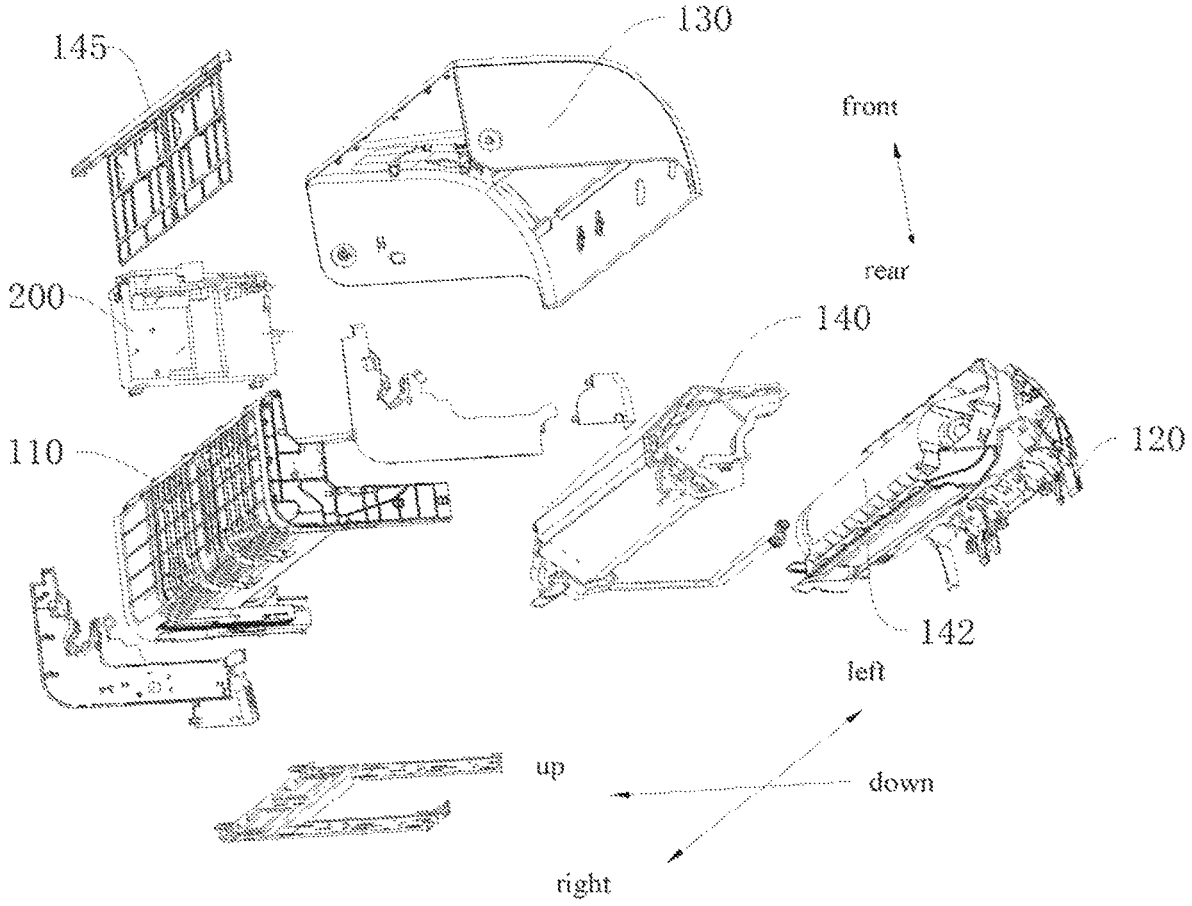
FIG. 2 is an exploded schematic view of an indoor unit in another direction according to an embodiment of the present invention.
Figure 3:
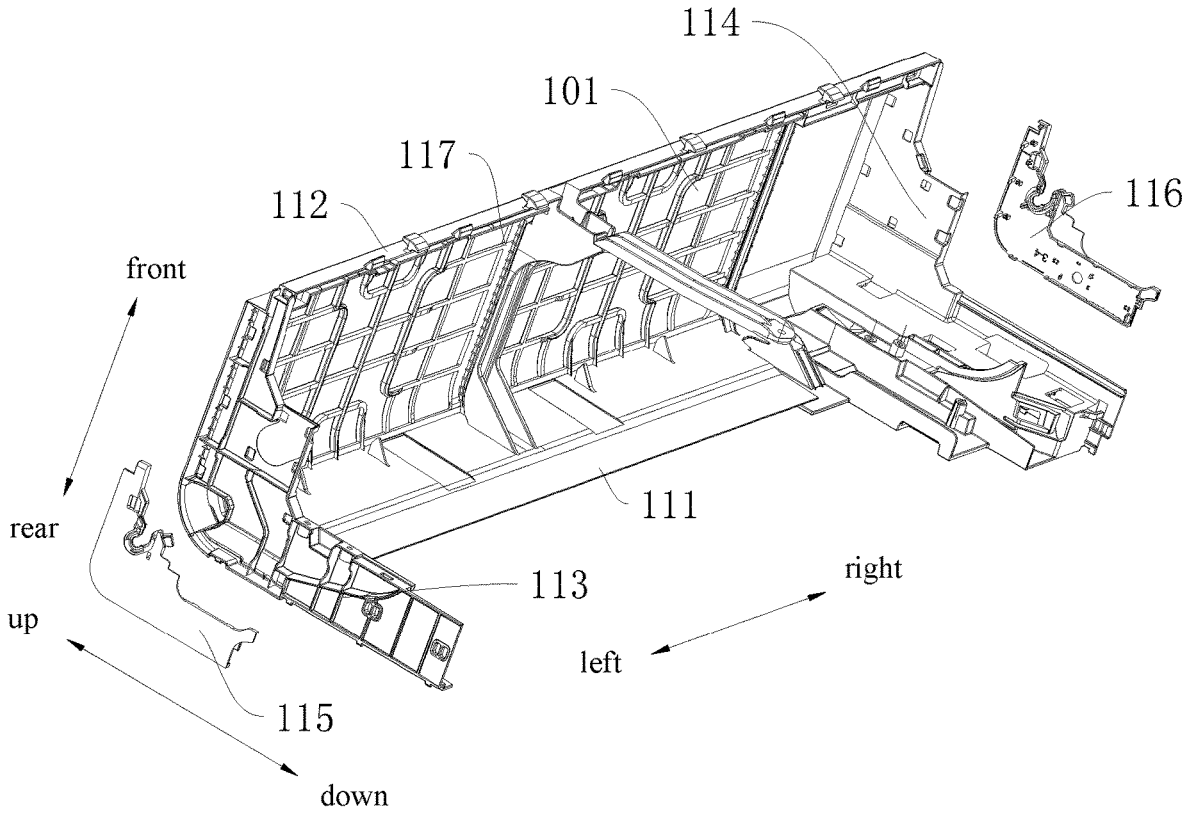
FIG. 3 is a schematic view of an upper base plate of an indoor unit for an air conditioner according to an embodiment of the present invention.

With reference to FIGS. 1 to 3, in some embodiments of the present invention, the upper base plate 110 includes: a rear baffle 111, an upper cover plate 112, a left end plate 113 and a right end plate 114. The heat exchanger 140 is mounted on the rear baffle 111, a rear edge of the upper cover plate 112 is connected with an upper edge of the rear baffle 111, and the air inlet 101 is formed in the upper cover plate 112, such that the air flow may enter the indoor unit 1000 from the air inlet 101 to exchange heat. The left end plate 113 has a rear edge connected with a left edge of the rear baffle 111 and an upper edge connected with a left edge of the upper cover plate 112. The right end plate 114 has a rear edge connected with a right edge of the rear baffle 111 and an upper edge connected with a right edge of the upper cover plate 112, so as to enhance the structural strength of the upper base plate 110 and facilitate mounting the heat exchanger 140 to the upper base plate 110, thereby improving the whole structural strength of the whole indoor unit 1000.

Additionally, by providing the air inlet 101 in the upper cover plate 112 of the upper base plate 110 and mounting the heat exchanger 140 to the rear baffle 111, a gap may be effectively formed between the heat exchanger 140 and the upper cover plate 112 provided with the air inlet 101, such that the air flow may enter the indoor unit 1000 smoothly, to guarantee the smooth circulation of the air flow and improve the working efficiency of the indoor unit 1000 of the air conditioner.

Preferably, the lower base plate 120 is detachably mounted at the right side of the left end plate 113 and at the left side of the right end plate 114. The left end plate 113 is located at a left side of the lower base plate 120, and the right end plate 114 is located at a right side of the lower base plate 120, so that it is convenient to mount the lower base plate 120 to the upper base plate 110 and also to disassemble the lower base plate 120 therefrom.

Further, with reference to FIGS. 1 to 3, the upper base plate 110 further includes a left shield plate 115 and a right shield plate 116. The left shield plate 115 is mounted to a left side of the left end plate 113, and the right shield plate 116 is mounted to a right side of the right end plate 114, so as to further improve the structural strength of the upper base plate 110 via the left shield plate 115 and the right shield plate 116 and to enhance the sealing performance at the left and right sides of the upper base plate 110, along with a beautiful appearance of the housing 100.

Preferably, the front cover 130 is detachably mounted over the left shield plate 115 and the right shield plate 116, which facilitates mounting the front cover 130 and improves the assembling and maintenance efficiency of the indoor unit 1000.

Advantageously, as shown in FIG. 3, an air inlet grille 117 is provided at the air inlet 101 of the upper cover plate 112, which makes it convenient for the air flow to enter the indoor unit 1000 via the air inlet 101, and prevents dust outside from entering the indoor unit 1000 to a certain extent, i.e., reduces the amount of the dust outside entering the indoor unit 1000, so as to facilitate cleaning the indoor unit 1000 and improve the stability and safety of the operation thereof.

Advantageously, the air inlet grille 117 is integrally formed in the upper cover plate 112, so as to improve the structural strength of the air inlet grille 117 and facilitate the molding of the upper cover plate 112.

Additionally, the upper base plate 110 according to the present invention may include other forms. For example, the upper base plate 110 may only include the rear baffle 111, but not include the upper cover plate 112, and the rear baffle 111 is provided with positions where the heat exchanger 140 and the lower base plate 120 are mounted.

In some embodiments of the present invention, the front cover 130 is pivotably mounted to the upper base plate 110. That is, the front cover 130 is mounted to the upper base plate 110 and rotatable between a first position where the housing 100, the heat exchanger 140 and the fan 142 are shielded and a second position where the housing 100, the heat exchanger 140 and the fan 142 are exposed, so as to facilitate mounting the heat exchanger 140 and the fan 142 to the housing 100 and dismounting the heat exchanger 140 and the fan 142.

Figure 4:
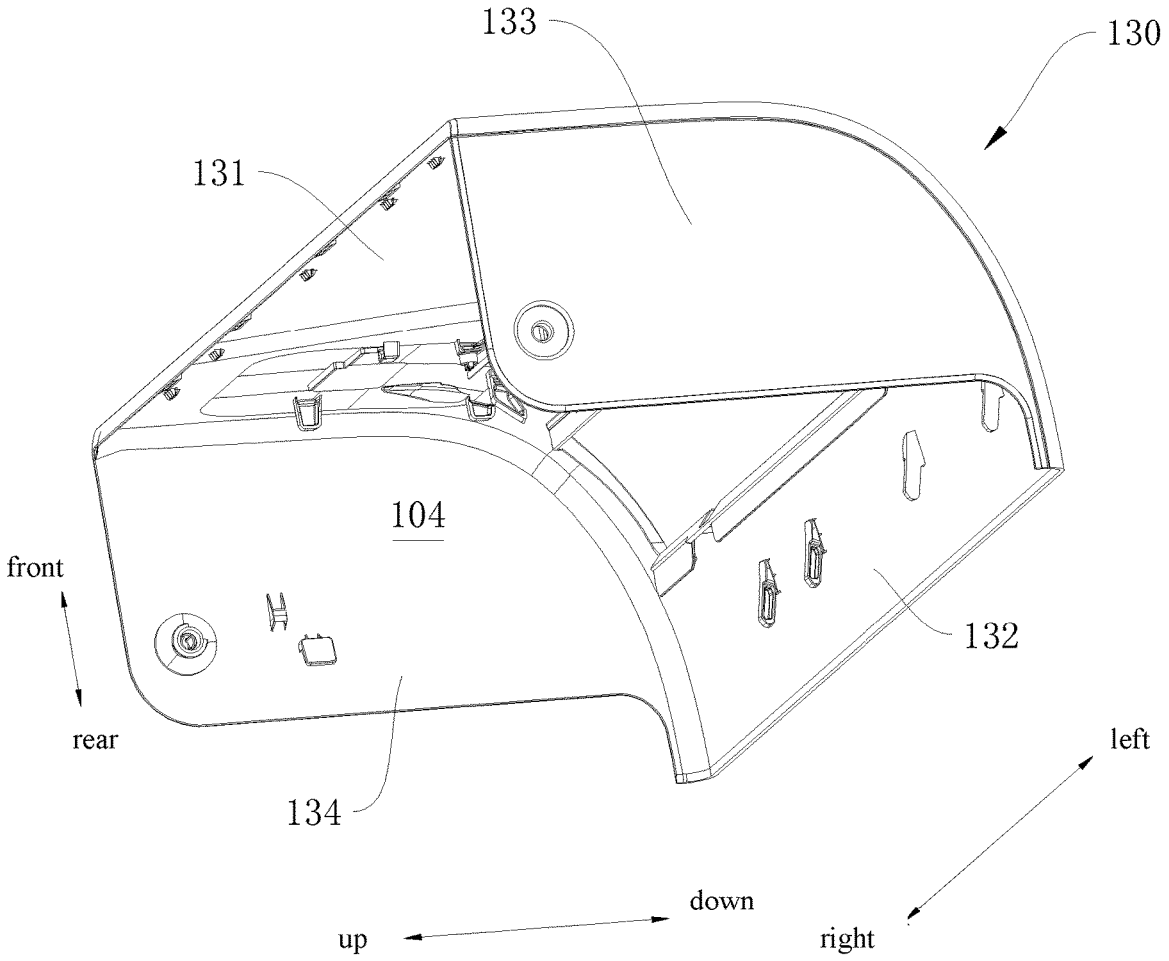
FIG. 4 is a schematic view of a front cover of an indoor unit for an air conditioner according to an embodiment of the present invention.

Referring to FIGS. 1, 2 and 4, in some embodiments of the present invention, the front cover 130 defines an covering chamber 104 therein, and the upper base plate 110 and the lower base plate 120 are disposed in the covering chamber 104 and shielded by the front cover 130, such that the indoor unit 1000 has a beautiful appearance and is enclosed, which is conductive to oriented air supply. Alternatively, an air supply port 103 corresponding to the air outlet is provided in the front cover 130 and configured to avoid the air outlet.

Further, with reference to FIGS. 1, 2 and 4, the front cover 130 includes a front panel 131, a lower panel 132, a left panel 133 and a right panel 134. The front panel 131 covers front surfaces of the upper base plate 110 and the lower base plate 120. The lower panel 132 has a front edge connected with a lower edge of the front panel 131, and covers a lower surface of the lower base plate 120, in which the air supply port 103 is provided at a position where the front panel 131 and the lower panel 132 are connected. The left panel 133 has a front edge connected with a left edge of the front panel 131 and a lower edge connected with a left edge of the lower panel 132, and is rotatably mounted to a left side of the upper base plate 110 and covers the left side thereof. The right panel 134 has a front edge connected with a right edge of the front panel 131 and a lower edge connected with a right edge of the lower panel 132, and is rotatably mounted to a right side of the upper base plate 110 and covers the right side thereof.

Further, with reference to FIG. 1, the left panel 133 is provided at the left side of the upper base plate 110, and the right panel 134 is provided at the right side of the upper base plate 110. A rotating shaft is provided at each of a rear end of an upper portion of the left panel 133 and a rear end of an upper portion of the right panel 134, while a shaft hole structure fitted with the rotating shaft is provided in each of the left shield plate 115 and the right shield plate 116 of the upper base plate 110, so as to realize the rotatable mounting of the front cover 130 to the housing 100 via the shaft-hole fit.

Advantageously, the front panel 131 is connected with the lower panel 132 via an arc transition portion, to make the appearance of the indoor unit 100 aesthetic. Moreover, the indoor unit 1000 having a rounded-off surface is less easy to be damaged than the indoor unit 1000 having an angular surface during the transportation of the indoor unit 1000.

Additionally, the front panel 131 and the lower panel 132 of the front cover 130 may be molded separately, in which the lower panel 132 may be separately fixed to the lower panel 120 or integrally molded with the lower panel 120.

Figure 5:
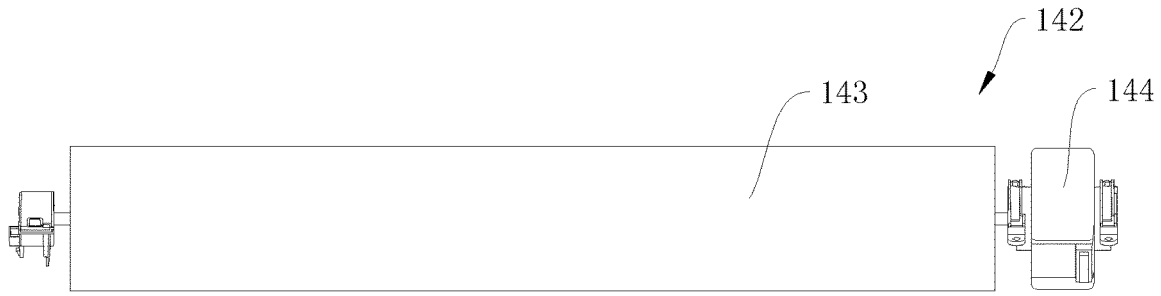
FIG. 5 is a schematic view of a fan of an indoor unit for an air conditioner according to an embodiment of the present invention.
Figure 6:
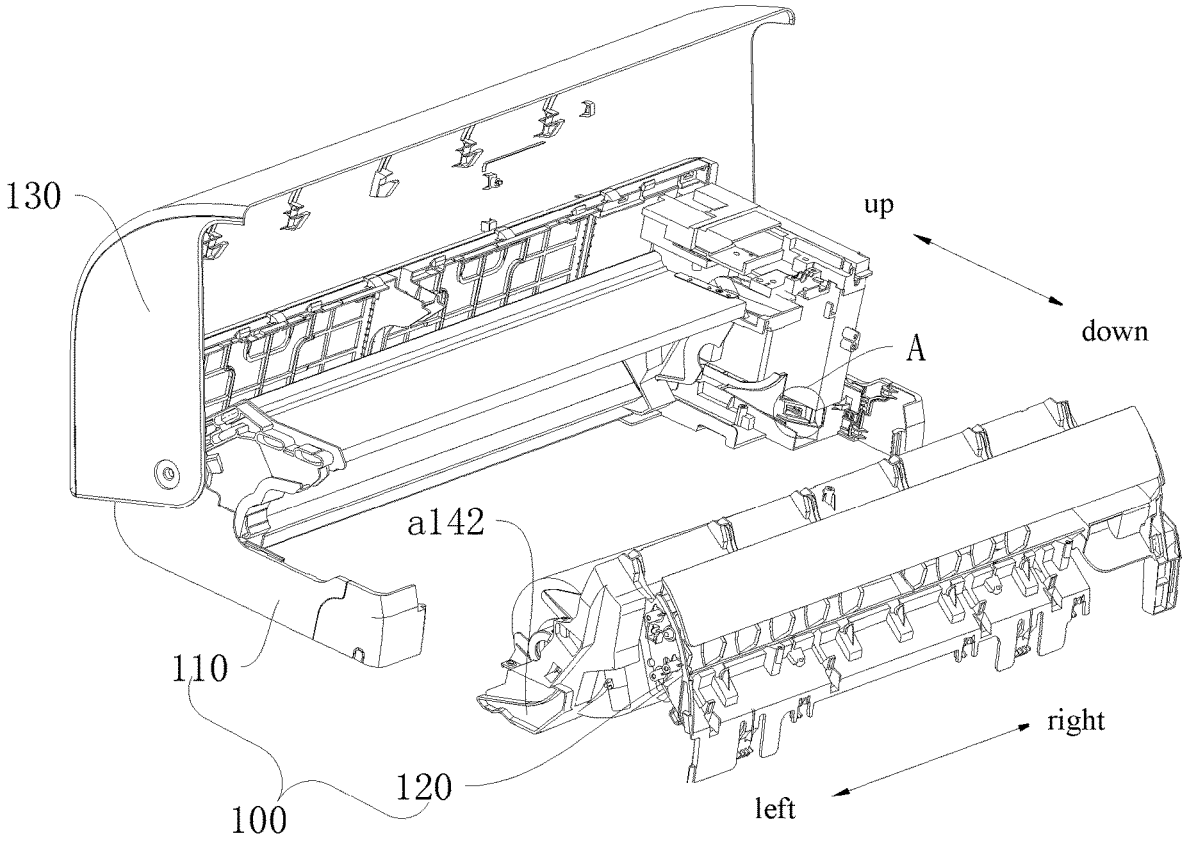
FIG. 6 is an exploded schematic view of an indoor unit for an air conditioner in another direction according to an embodiment of the present invention.

As shown in FIG. 5, in some embodiments of the present invention, the fan 142 includes a fan wheel 143 and a motor 144. The fan wheel 143 is detachably mounted to the lower base plate 120; and the motor 144 is detachably mounted to the lower base plate 120 and connected with the fan wheel 143 in a transmission way, so as to facilitate the operation, mounting and dismounting of the fan 142.

Further, the lower base plate 120 is provided with a motor mounting groove (not shown) for the motor 144, the upper base plate 110 is provided with a water receiving cover 141, the motor 144 is mounted in the motor mounting groove, and the water receiving cover 141 is located below the heat exchanger 140 and presses the motor 144 in the motor mounting groove.

In some embodiments of the present invention, an air deflector 105 is provided at the air outlet of the lower base plate 120 and exposed from the air supply port 103, to guide the direction of the air flow sent out from the indoor unit 1000.

In an embodiment of the present invention, the housing 100 of the indoor unit 1000 includes a lower base plate 120, an upper base plate 110 and a front cover 130. The lower base plate 120 is provided with an air outlet and a fan mounting structure (not shown) for mounting a fan 142. The upper base plate 110 is detachably mounted to the lower base plate 120, and provided with an air inlet 101 and a heat exchanger mounting structure for mounting a heat exchanger 140. The front cover 130 is detachably mounted to the upper base plate 110 and provided with an air supply port 103 in a position corresponding to the air outlet.

In the housing 100 of the indoor unit 1000 according to embodiments of the present invention, the fan 142 and the heat exchanger 140 may be mounted or dismounted, and cleaned conveniently by mounting the fan 142 to the lower base plate 120 via the fan mounting structure and mounting the heat exchanger 140 to the upper base plate 110 via the heat exchanger mounting structure.

In the present invention, the upper base plate 110 is provided to mount the heat exchanger 140, and the lower base plate 120 is provided to mount the fan 142. The lower base plate 120 and the fan 142 are mounted below the upper base plate 110 and the heat exchanger 140, such that the dismounting of the fan 142 only needs to dismount the lower base plate 120 located below from the upper base plate 110, which may separate the fan 142 from a main body of the indoor unit 1000 and also facilitate the maintenance and cleaning of the fan 142. The procedure of cleaning the fan 142 of the indoor unit 1000 is simplified, so that even the user may clean the fan on his own.

In addition, the front cover 130 is configured to be pivotably connected with the upper base plate 110, such that the process of dismounting and mounting the fan 142 does not need to dismount the front cover 130 (or the front cover 130 may be dismounted very easily), thus facilitating the maintenance of the fan 142 of the indoor unit 1000.

As shown in FIGS. 17 to 28, in an embodiment of the present invention, the housing 100 of the indoor unit 1000 includes the upper base plate 110, the lower base plate 120 and a middle supporter 160.

Specifically, the lower base plate 120 is detachably mounted to the upper base plate 110, which facilitates the mounting and dismounting of the housing 100. It shall be noted that the upper base plate 110 and the lower base plate 120 both have a large width in a left and right direction of the housing (e.g. the left and right direction shown in FIG. 17), and the upper base plate 110 and the lower base plate 120 tend to be deformed during a long-term use, thus affecting a normal working of the indoor unit 1000. In order to improve the structural strength of the upper base plate 110 and the lower base plate 120 and to prevent the upper base plate 110 and the lower base plate 120 from deformation, the middle supporter 160 may be disposed between the upper base plate 110 and the lower base plate 120, and have a first end and a second end connected to the upper base plate 110 and the lower base plate 120 respectively.

For the housing 100 of the indoor unit 1000 according to this embodiment of the present invention, the middle supporter 160 is disposed between the upper base plate 110 and the lower base plate 120 and provides support therebetween, so as to improve the structural strength of the upper base plate 110 and the lower base plate 120, and to prevent the housing 100 from being deformed, hence prolonging the service life of the housing 100. Moreover, the usage performance of the indoor unit 1000 may be improved and the user's usage requirements may be satisfied.

Figure 17:
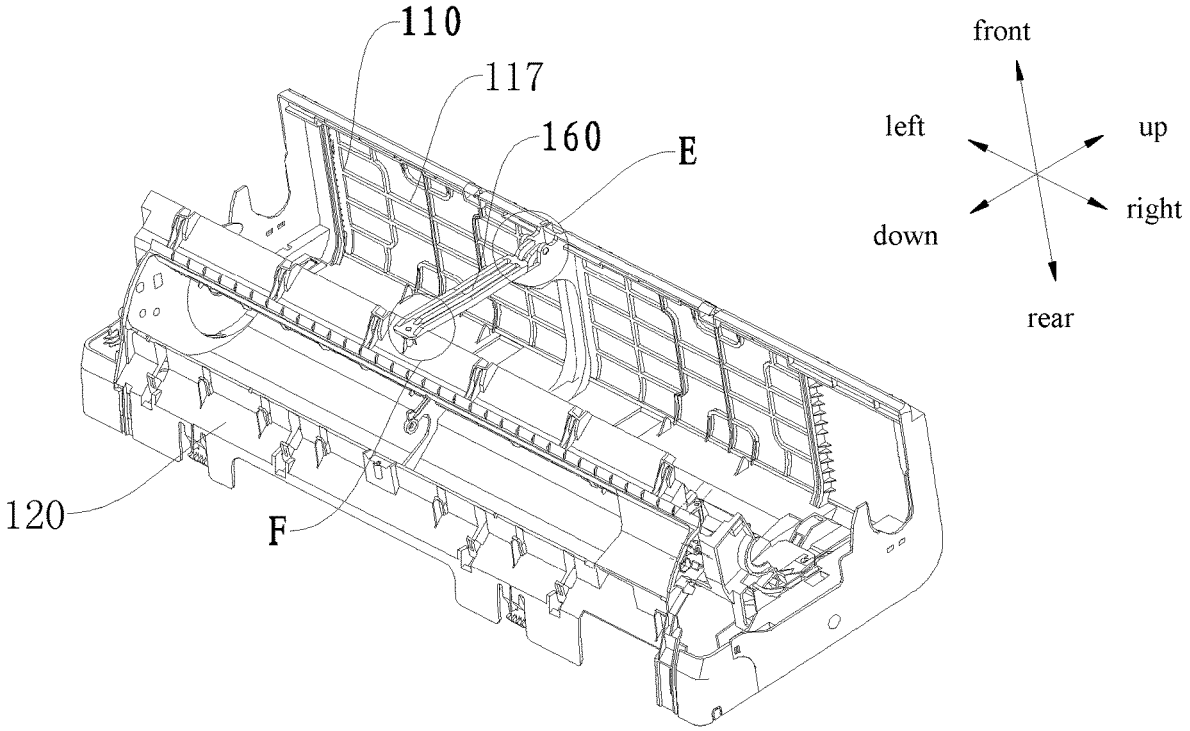
FIG. 17 is a perspective view of an indoor unit for an air conditioner according to an embodiment of the present invention.

As shown in FIGS. 17 to 28, in an embodiment of the present invention, the middle supporter 160 supports the housing 100 of the indoor unit 1000 in a middle position of the housing 100, in the left and right direction shown in FIG. 17. It shall be noted that the middle of the upper base plate 110 or the lower base plate 120 is easiest to be deformed, in the left and right direction shown in FIG. 17, so the deformation of the housing 100 may be prevented effectively by providing the middle supporter 160 in such position.

Figure 20:
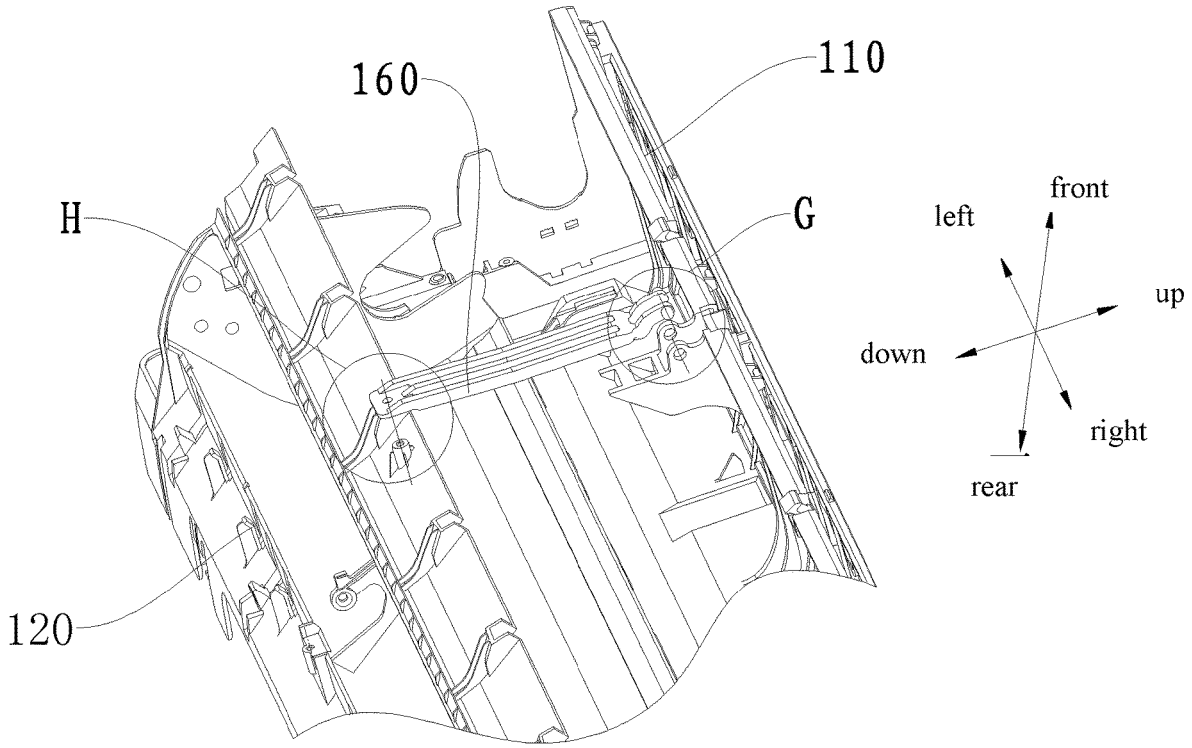
FIG. 20 is a partially schematic view of an indoor unit for an air conditioner according to an embodiment of the present invention.

Further, the first end and the second end of the middle supporter 160 are mounted to a front surface of the upper base plate 110 and a front surface of the lower base plate 120 respectively, so as to further improve the structural strength of the upper base plate 110 and the lower base plate 120 and prevent the upper base plate 110 and the lower base plate 120 from deformation. For example, as shown in FIGS. 17 and 20, a first end 160*a* of the middle supporter 160 is mounted to the front surface of the upper base plate 110, while a second end 160*b* of the middle supporter 160 is mounted to the front surface of the lower base plate 120.

As shown in FIGS. 1, 2, and 4, the front cover 130 is provided in front of the upper base plate 110 and the lower base plate 120 to shield components behind the front cover 130, so as to prevent the indoor unit 1000 from being damaged or to avoid causing potential dangers to the user due to foreign matters and fingers entering into the housing 100. Meanwhile, a side surface of the front cover 130 facing an exterior of the housing 100 may be provided with a certain aesthetic structure or pattern to meet the aesthetic requirement of the user. When the indoor unit 1000 needs cleaning, maintenance or replacement of components, the front cover 130 is detachably mounted to the upper base plate 110 and also pivotably mounted to the upper base plate 110 for the sake of convenient operations. Thus, the components shielded by the front cover 130 in the housing 100 may be exposed by rotating the front cover 130, so as to facilitate the cleaning, maintenance or replacement of components in the housing 100. That is, the front cover 130 is switchable between an open position and a closed position. When the front cover 130 is in the open position, the components shielded by the front cover 130 in the housing 100 are exposed; when the front cover 130 is in the closed position, the front cover 130 shields the components therebehind. Consequently, the user or the maintenance personnel may manipulate the front cover 130 according to practical needs.

Figure 18:
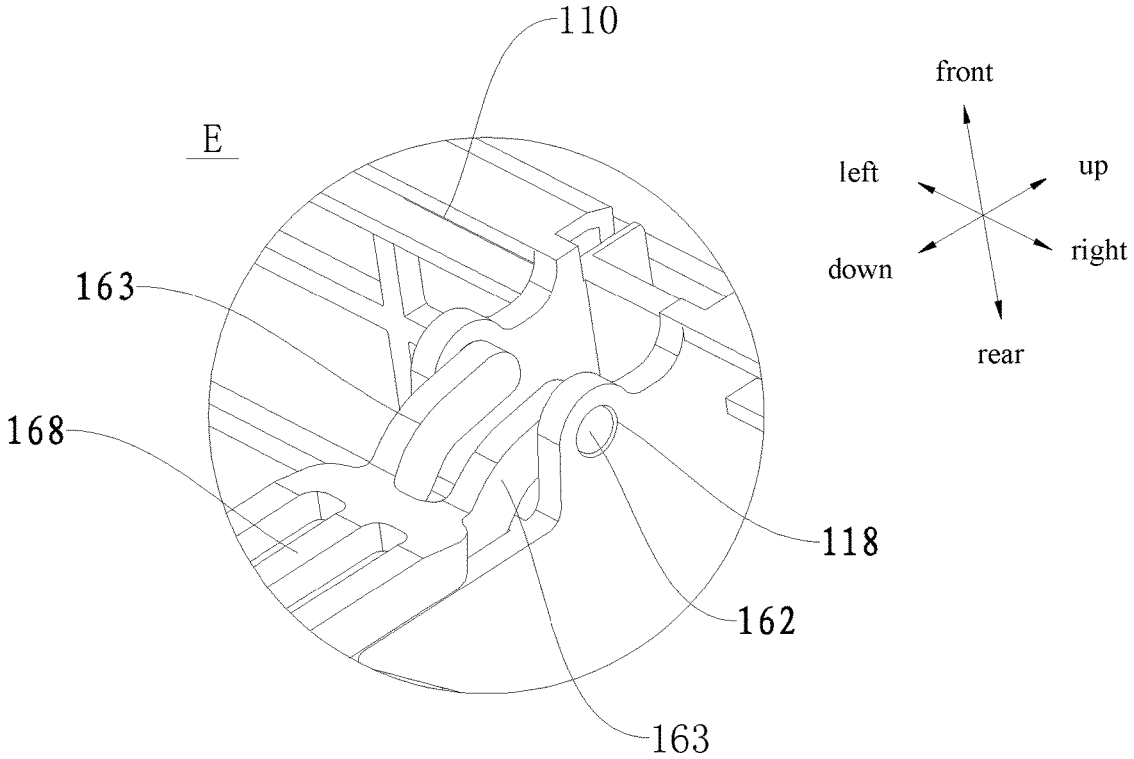
FIG. 18 is a partially enlarged view of part E in FIG. 17.
Figure 19:
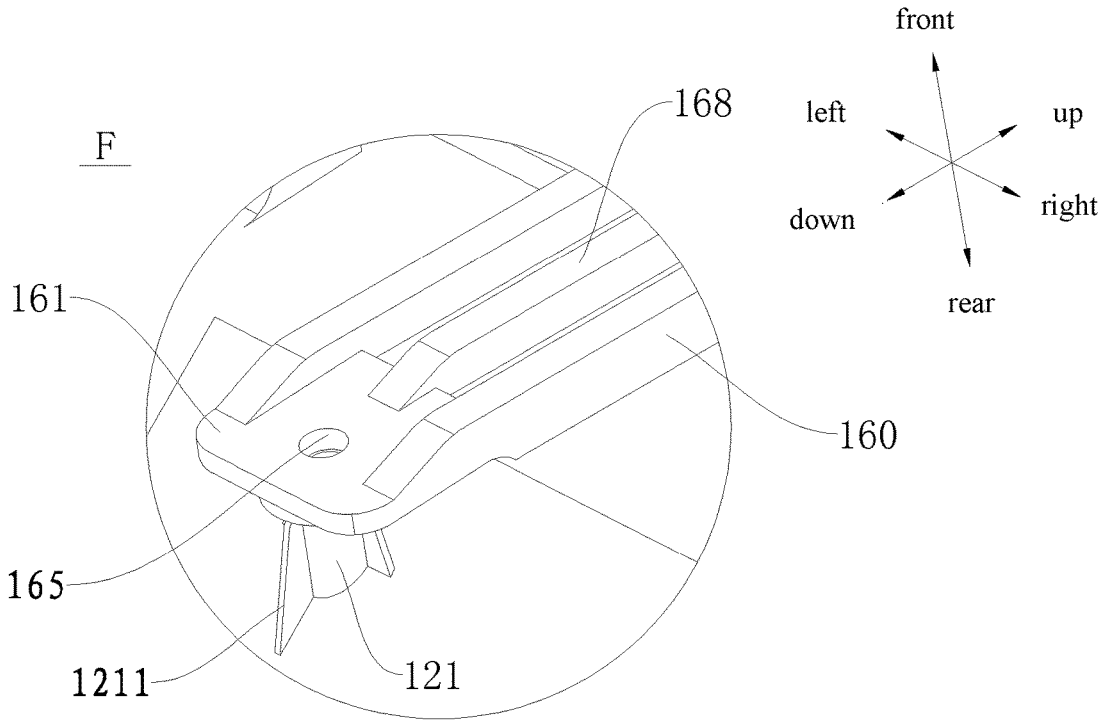
FIG. 19 is a partially enlarged view of part F in FIG. 17.
Figure 21:
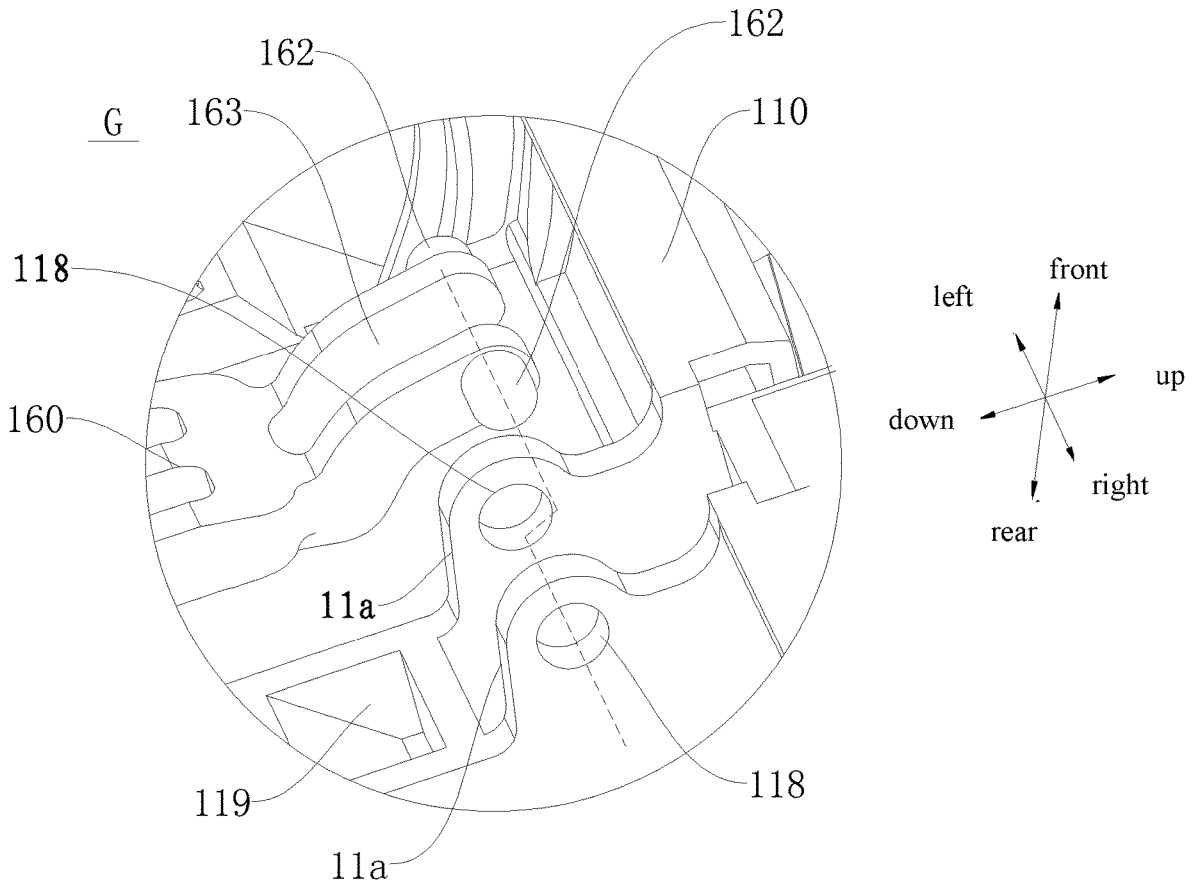
FIG. 21 is a partially enlarged view of part G in FIG. 20.
Figure 22:
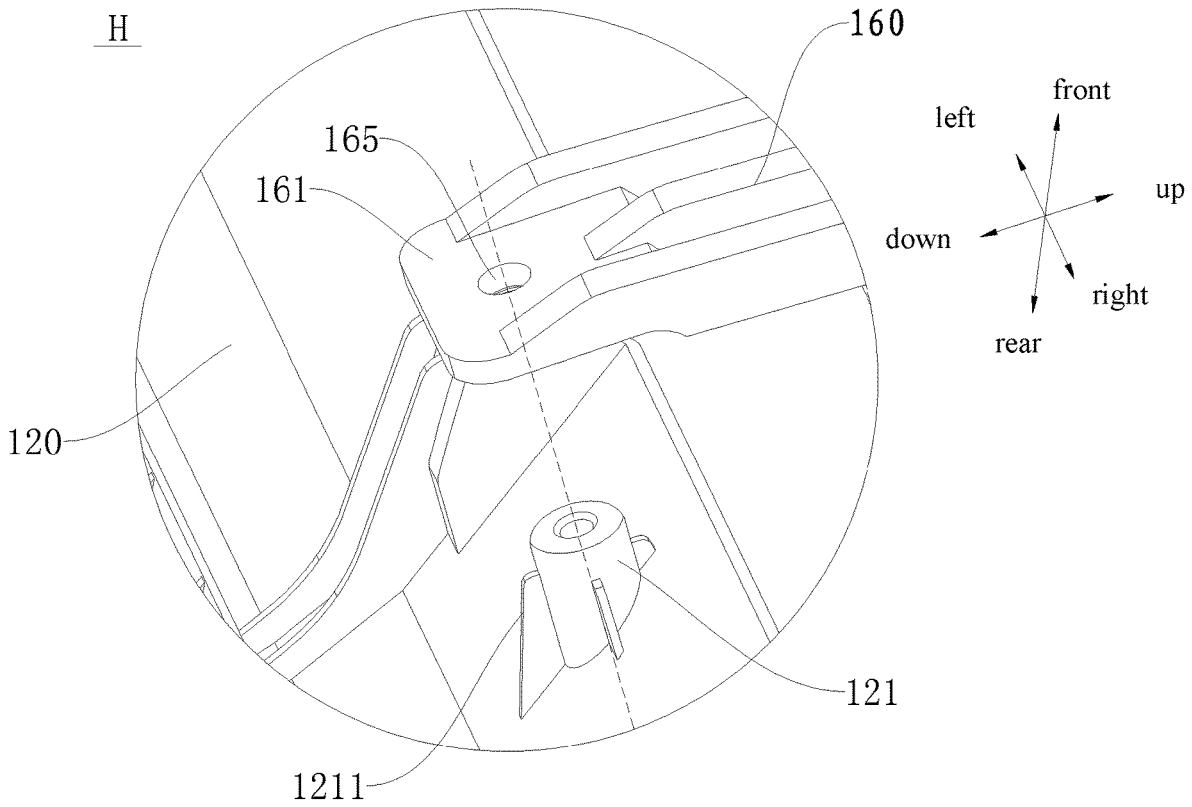
FIG. 22 is a partially enlarged view of part H in FIG. 20.

As shown in FIGS. 18 and 21, the first end 160*a* of the middle supporter 160 is rotatably mounted to the upper base plate 110; as shown in FIGS. 19 and 22, the second end 160*b* of the middle supporter 160 is mounted to the lower base plate 120 via a second threaded fastener. Consequently, when the front cover 130 is in the open position, the second threaded fastener provided at the second end 160*b* of the middle supporter 160 is loosened to rotate the middle supporter 160 and make the second end 160*b* of the middle supporter 160 support the front cover 130, such that the front cover 130 remains in the open position. That is, the middle supporter 160 may switch between a non-supporting state and a supporting state. When the front cover 130 is in the closed position, the middle supporter 160 is in the non-supporting state, and the second end 160*b* of the middle supporter 160 is fixed to the lower base plate 120 via the second threaded fastener; when the front cover 130 is in the open position, the second threaded fastener provided at the second end 160*b* of the middle supporter 160 is loosened to rotate the middle supporter 160 and make the second end 160*b* of the middle supporter 160 support a side wall of the front cover 130 facing the upper base plate 110, such that the front cover 130 remains in the open position, thereby facilitating the operation on the components shielded by the front cover 130 by the user or the maintenance personnel.

Alternatively, the second threaded fastener may be configured as a bolt or a screw. It shall be noted that the second end 160*b* of the middle supporter 160 is fixed to the lower base plate 120 via the second threaded fastener, so as to avoid abnormal sound or damage of other components in the housing 100 caused by shaking of the second end 160*b* of the middle supporter 160, thus improving the practicability of the housing 100 and the product quality.

Figure 23:
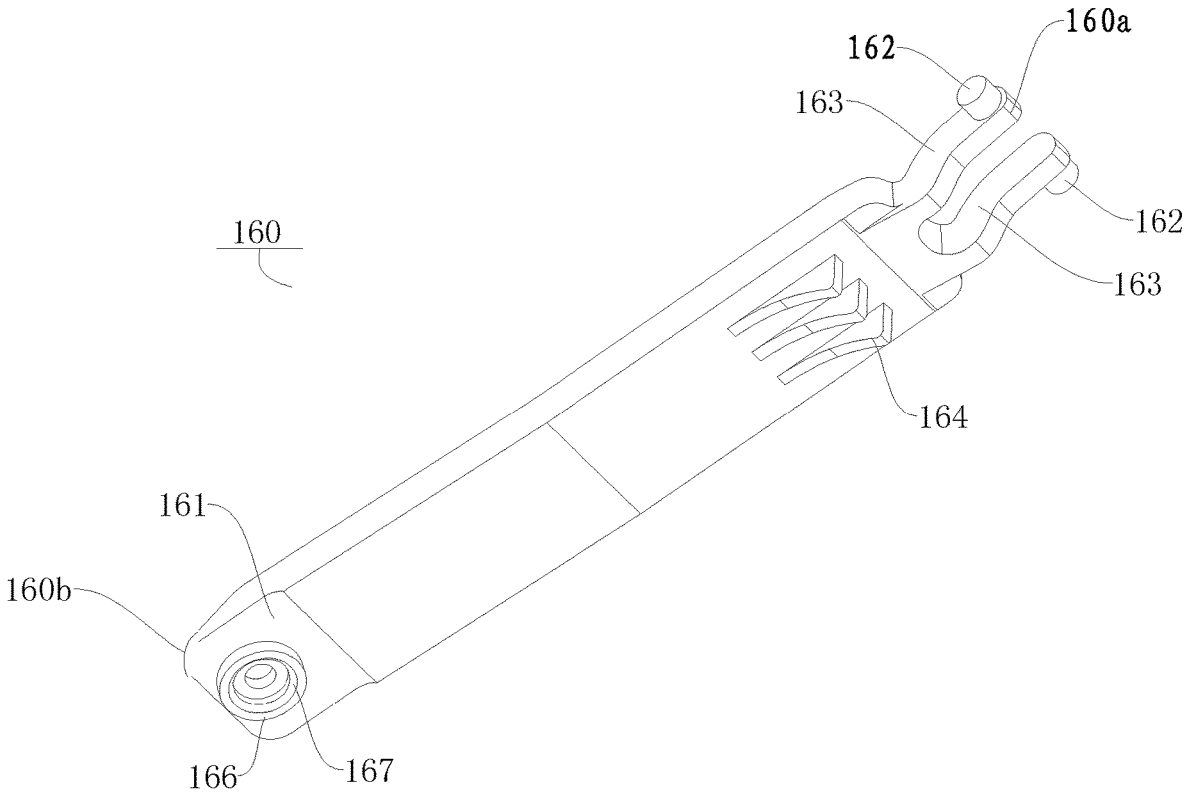
FIG. 23 is a perspective view of a middle supporter of an indoor unit for an air conditioner according to an embodiment of the present invention.
Figure 24:
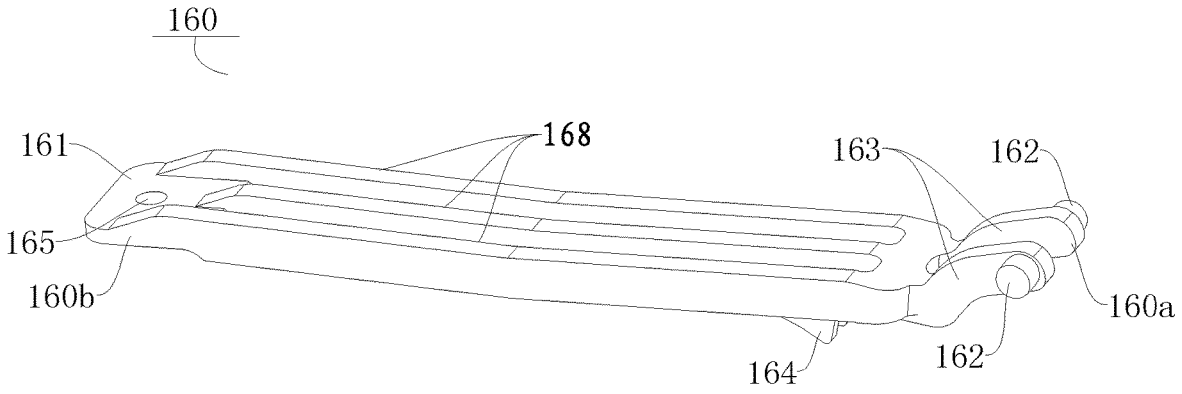
FIG. 24 is a perspective view of the middle supporter in FIG. 23 in another direction.
Figure 25:
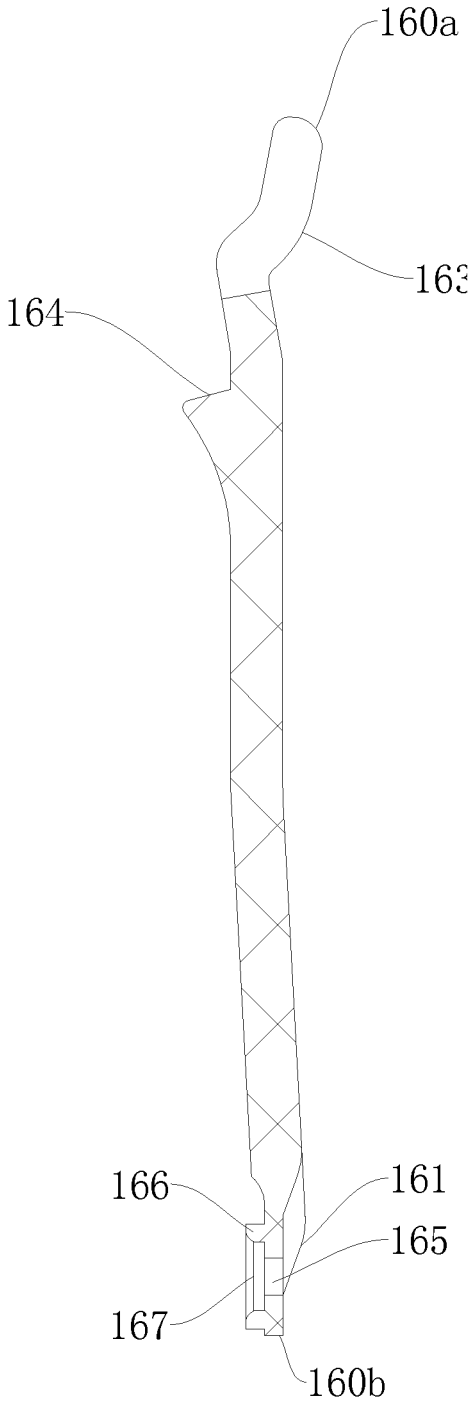
FIG. 25 is a sectional view of the middle supporter in FIG. 24.
Figure 26:
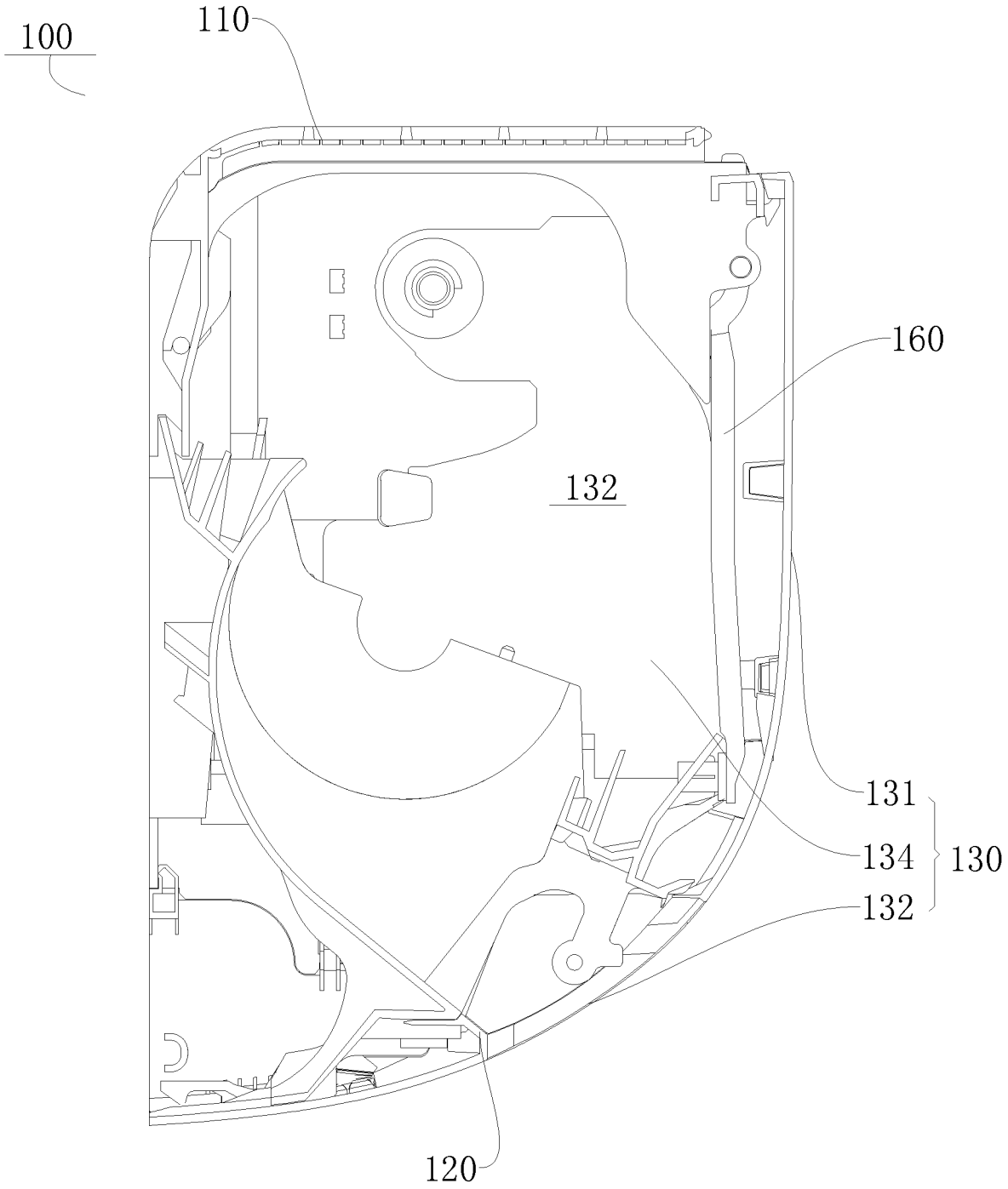
FIG. 26 is a sectional view of an indoor unit for an air conditioner according to an embodiment of the present invention, in which a front cover is in a closed position and a middle supporter is in a non-supporting state.
Figure 27:
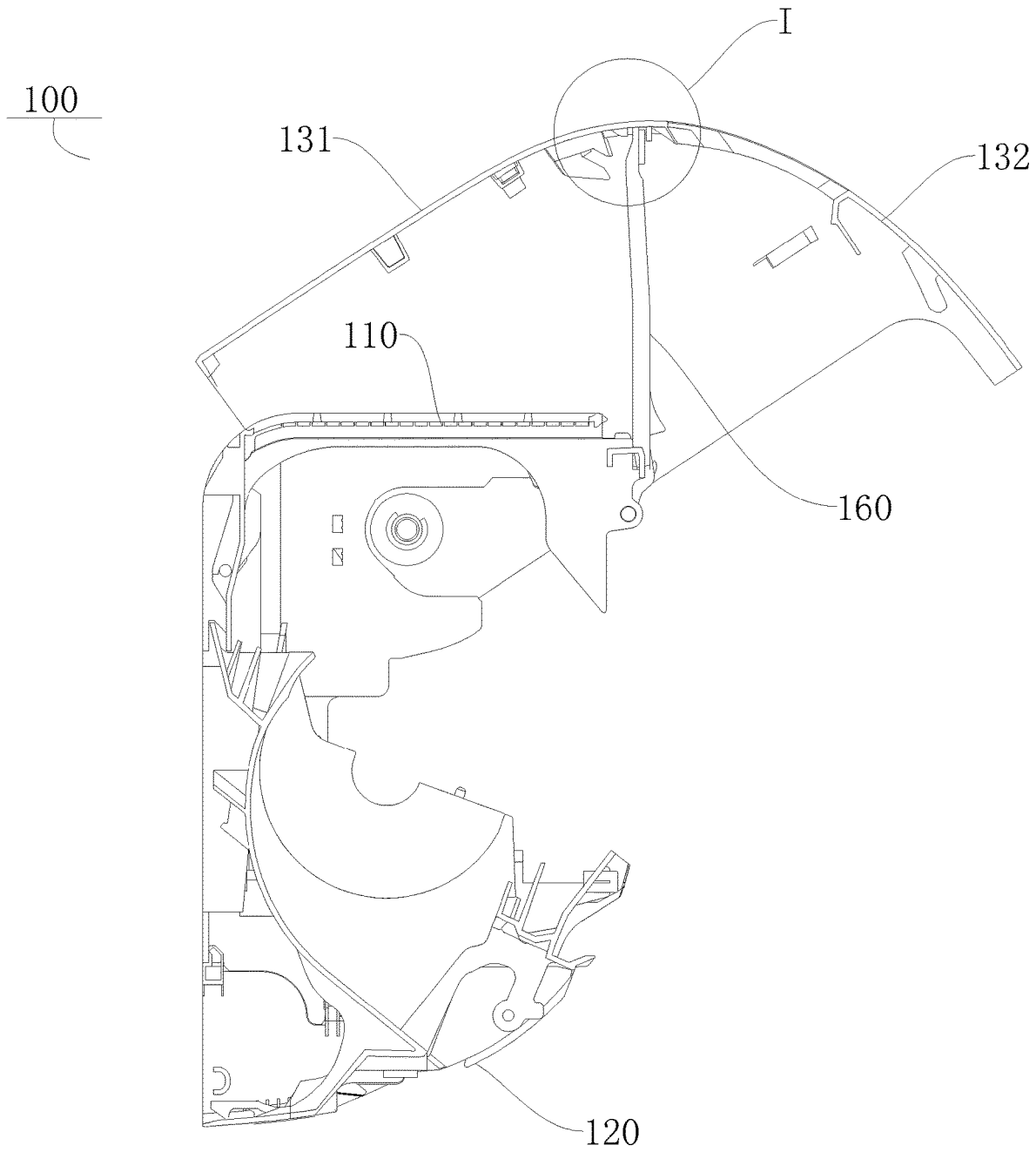
FIG. 27 is a sectional view of a housing of an indoor unit for an air conditioner according to an embodiment of the present invention, in which a front cover is in an open position and a middle supporter is in a supporting state.

For example, as shown in FIGS. 19 and 22, the second end 160*b* of the middle supporter is provided with a screw hole 165, and the lower base plate 120 is provided with a stud 121, so as to facilitate supporting the second end 160*b* of the middle supporter. The second end 160*b* of the middle supporter 160 is mounted to the lower base plate 120 via the second threaded fastener fitted in the screw hole 165 and the stud 121, thus facilitating fixing the second end 160*b* of the middle supporter 160 to the lower base plate 120. In order to improve the structural strength of the stud 121, as shown in FIGS. 19 and 22, a reinforcing rib 1211 is provided between an outer circumferential wall of the stud 121 and the lower base plate 120. A plurality of reinforcing ribs 1211 may be provided and spaced apart from one another along a circumferential direction of the stud 121. As shown in FIGS. 19, 23 and 25, the second end 160*b* of the middle supporter is provided with a positioning boss 166, the positioning boss 166 is provided with a positioning groove 167, and the stud 121 is fitted in the positioning groove 167. In the process of connecting the second end 160*b* of the middle supporter to the lower base plate 120, the stud 121 of the lower base plate 120 is fitted with the positioning groove 167 first, and then the second end 160*b* of the middle supporter is fixed to the stud 121 via the second threaded fastener. Thus, it is convenient to mount the middle supporter 160 to the lower base plate 120, thereby improving the assembling efficiency greatly. Also, it is possible to avoid damage of the middle supporter 160 or the lower base plate 120 due to an improper assembling position of the middle supporter 160 and the lower base plate 120.

Herein, a connection manner of the second end 160*b* of the middle supporter and the lower base plate 120 is not limited to this. For example, the second end 160*b* of the middle supporter may be connected to the lower base plate 120 via a snap structure, so as to facilitate switching the middle supporter 160 from the non-supporting state to the supporting state.

Figure 28:
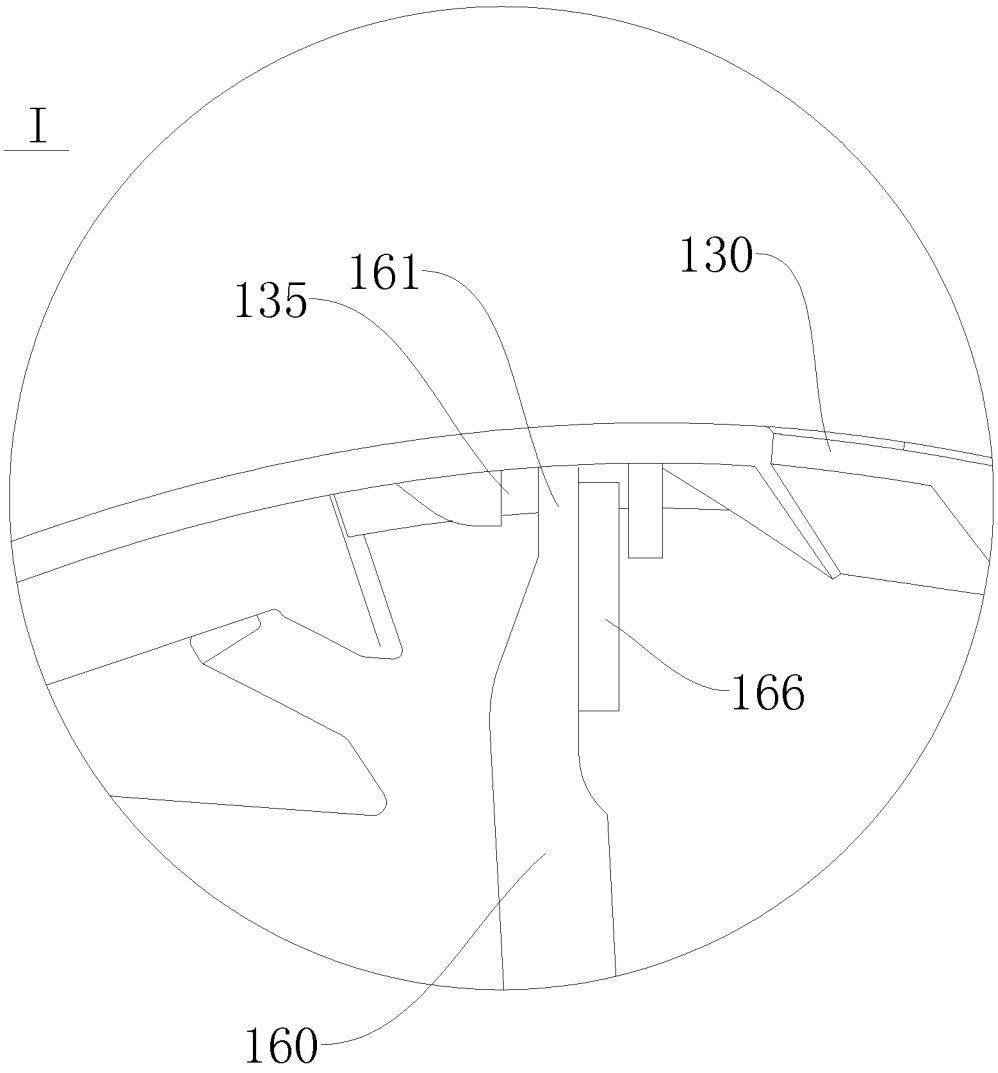
FIG. 28 is a partially enlarged view of part F in FIG. 27.
Figure 29:
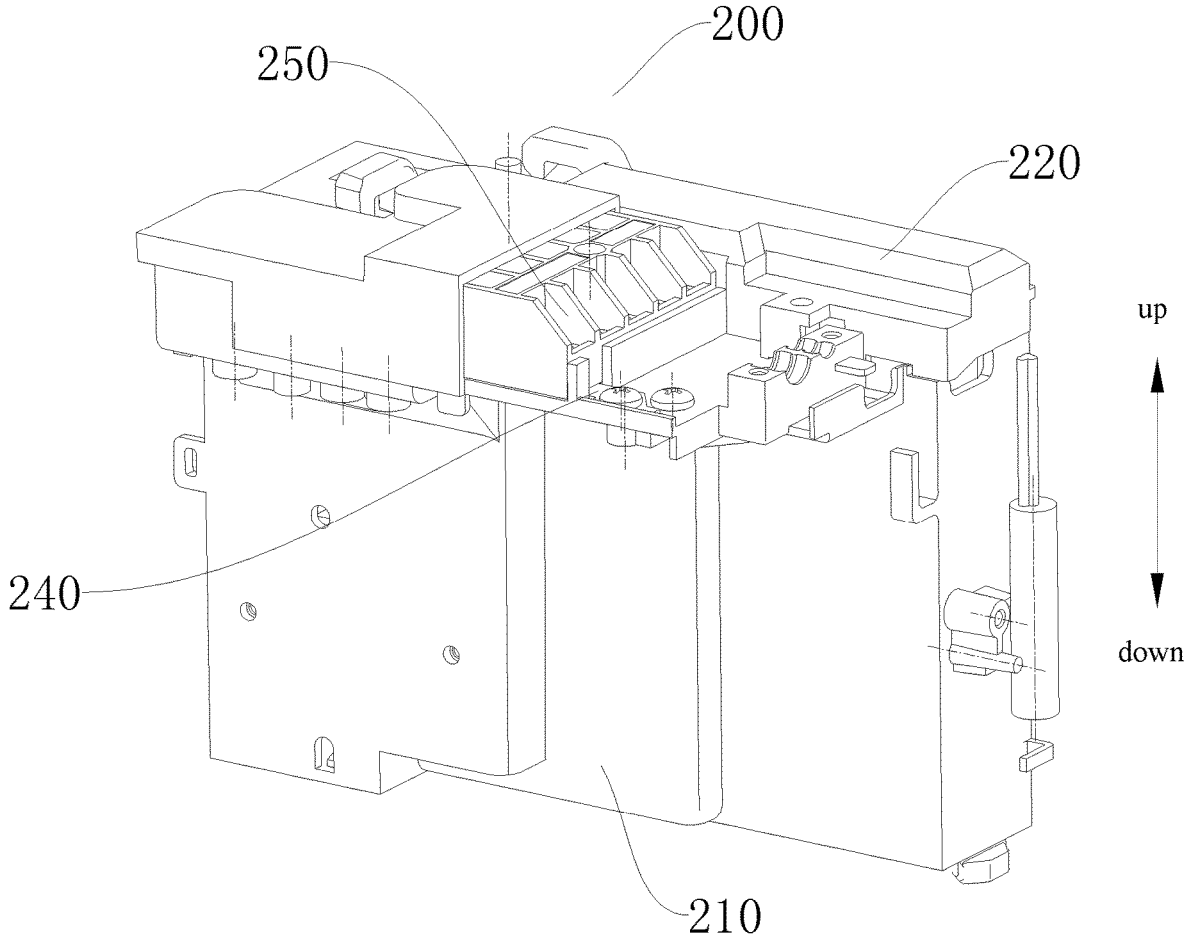
FIG. 29 is a perspective view of an electric control box assembly of an indoor unit for an air conditioner according to an embodiment of the present invention.
Figure 30:
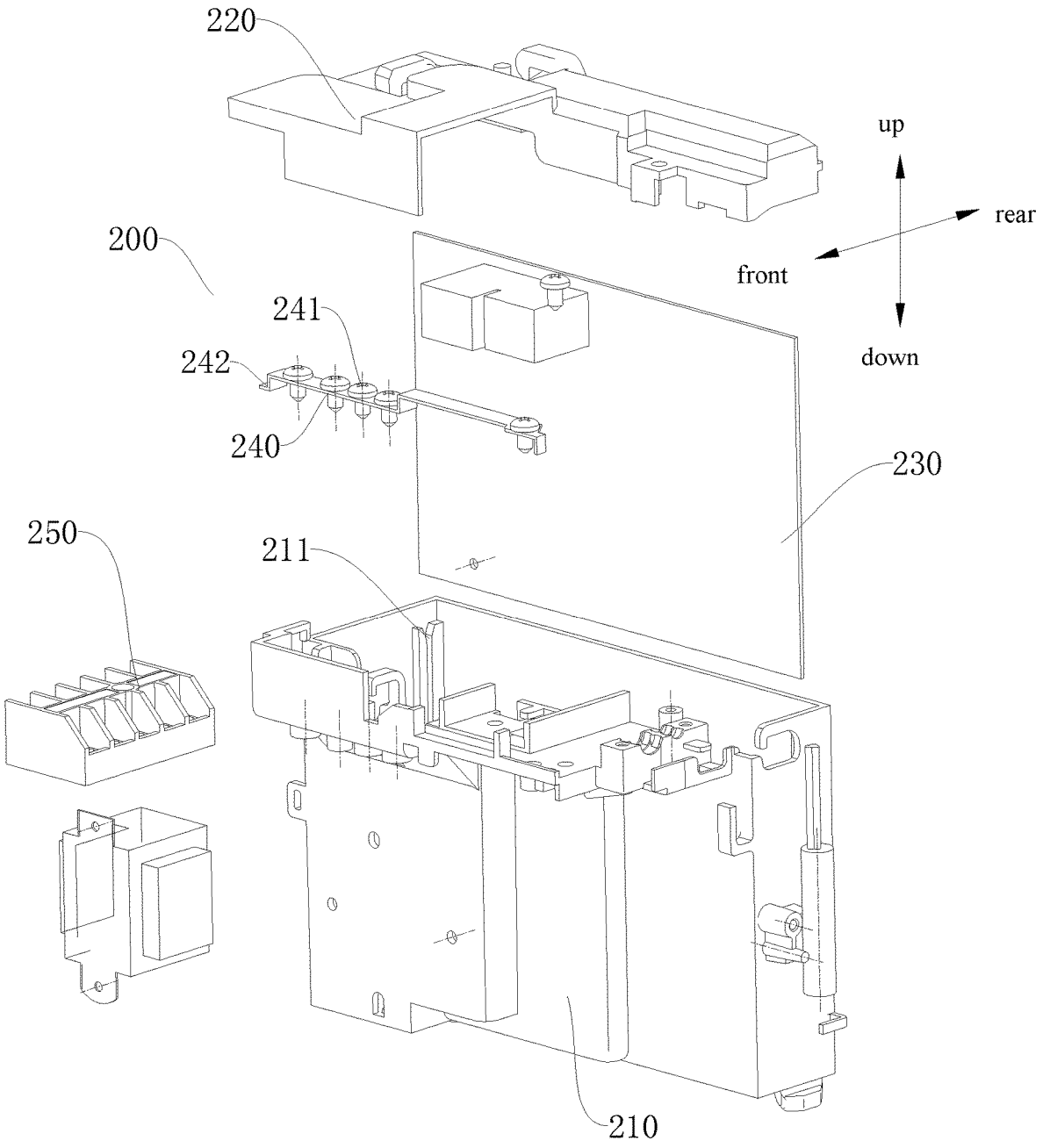
FIG. 30 is a perspective exploded view of an electric control box assembly of an indoor unit for an air conditioner according to an embodiment of the present invention.
Figure 31:
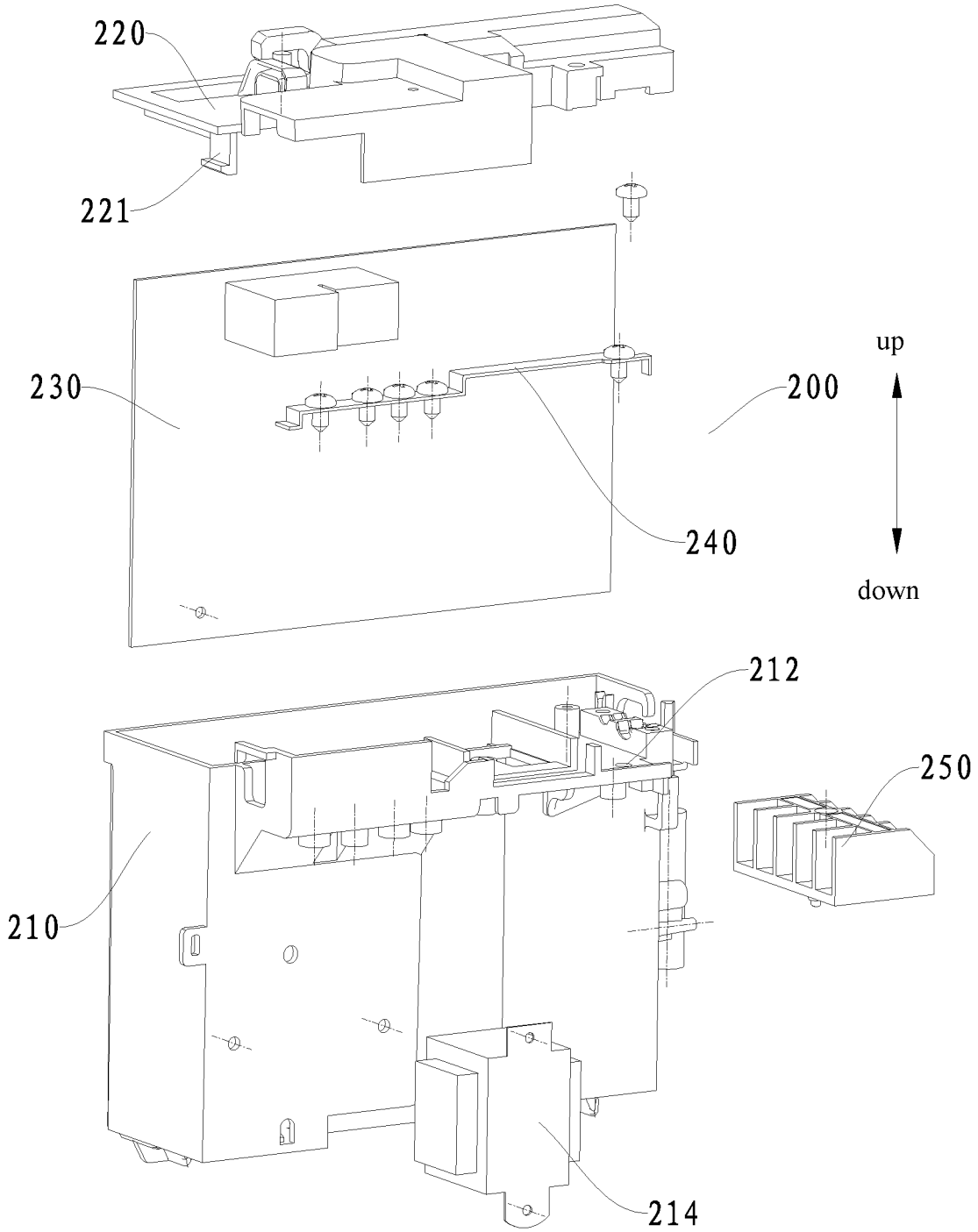
FIG. 31 is a perspective exploded view of an electric control box assembly of an indoor unit for an air conditioner according to an embodiment of the present invention.

When the middle supporter 160 is in the supporting state, a first position limiting groove 135 is provided in an inner surface of the front cover 130, and the second end 160*b* of the middle supporter is provided with a tongue piece 161 configured to be fitted with the first position limiting groove 135, so as to prevent the middle supporter 160 from slipping off from the front cover 130. As shown in FIGS. 19 and 28, by fitting the tongue piece 161 in the first position limiting groove 135, the middle supporter 160 may be effectively limited in the supporting state, such that the front cover 130 may remain in the open position.

As shown in FIGS. 18 and 21, the first end 160*a* of the middle supporter 160 is provided with a rotating shaft 162, the upper base plate 110 is provided a shaft hole 118, and the rotating shaft 162 is configured to be rotatably fitted in the shaft hole 118, such that it is convenient for the middle supporter 160 to be pivotably connected to the upper base plate 110. As shown in FIG. 2, and FIGS. 19 to 21, the first end 160*a* of the middle supporter is provided with an arc arm 163 for pressing the middle supporter 160 against the upper base plate 110, and the rotating shaft 162 is provided on the arc arm 163. When the middle supporter 160 is in the non-supporting state, the middle supporter 160 is pressed against the upper base plate 110, thus facilitating fixing the middle supporter 160 in the non-supporting state.

For example, as shown in FIGS. 21 and 18, the first end 160*a* of the middle supporter 160 is provided with two arc arms 163, and two rotating shafts 162 are provided symmetrically and correspond to the two arc arms 163 respectively. As shown in FIG. 21, the two rotating shafts 162 are disposed at two side surfaces of the two arc arms 163 respectively, and the two side surfaces are away from each other. Central axes of the two rotating shafts 162 each extend along a left and right direction of the housing 100 (e.g. the left and right direction shown in FIG. 21). The upper base plate 110 is provided with shaft holes 118 in one-to-one correspondence with the rotating shafts 162, so as to improve the reliability of connecting the middle supporter 160 with the upper base plate 110. Further, as shown in FIG. 21, the upper base plate 110 is provided with a mounting lug 11*a* at a position where the upper base plate 110 and the middle supporter 160 are connected, and the shaft hole 118 is provided in the mounting lug 11*a*, so as to simplify the connecting structure of the middle supporter 160 and the upper base plate 110.

When the middle supporter 160 is in the non-supporting state, in order to prevent the middle supporter 160 from slipping off from the upper base plate 110, as shown in FIGS. 21 and 19, the middle supporter 160 is provided an anti-drop protrusion 164, the upper base plate 110 is provided with an anti-drop groove 119, and the anti-drop protrusion 164 is configured to be fitted in the anti-drop groove 119. That is, when the middle supporter 160 is in the non-supporting state, the anti-drop protrusion 164 is fitted in the anti-drop groove 119, so as to limit the middle supporter 160 to the upper base plate 110 effectively and also prevent the middle supporter 160 in the non-supporting state from shaking.

In addition, as shown in FIG. 19, the middle supporter 160 is provided a plurality of middle supporter reinforcing ribs 168, and the plurality of middle supporter reinforcing ribs 168 are spaced apart from one another along a width direction of the middle supporter 160 and extend along a length direction of the middle supporter 160, so as to improve the structural strength of the middle supporter 160.

As shown in FIG. 4, the front cover 130 defines an covering chamber 104 therein, and the upper base plate 110 and the lower base plate 120 are disposed in the covering chamber 104 and shielded by the front cover 130, such that the indoor unit 1000 has a beautiful appearance and is enclosed, thus facilitaing the oriented air supply.

Further, with reference to FIGS. 1 to 42, the front cover 130 includes a front panel 131, a lower panel 132, a left panel 133 and a right panel 134. The front panel 131 covers front surfaces of the upper base plate 110 and the lower base plate 120. The lower panel 132 has a front edge connected with a lower edge of the front panel 131, and covers a lower surface of the lower base plate 120, in which the air supply port 103 is provided at a position where the front panel 131 and the lower panel 132 are connected. The left panel 133 has a front edge connected with a left edge of the front panel 131 and a lower edge connected with a left edge of the lower panel 132, and is rotatably mounted to a left side of the upper base plate 110 and covers the left side of the upper base plate 110. The right panel 134 has a front edge connected with a right edge of the front panel 131 and a lower edge connected with a right edge of the lower panel 132, and is rotatably mounted to a right side of the upper base plate 110 and covers the right side of the upper base plate 110. In such a way, the structure of the housing 100 of the indoor unit 1000 may be further simplified, to facilitate assembling the housing 100.

Further, the left panel 133 is provided at the left side of the upper base plate 110, and the right panel 134 is provided at the right side of the upper base plate 110; a mounting rotating shaft is provided at each of a rear end of an upper portion of the left panel 133 and a rear end of an upper portion of the right panel 134, while a mounting shaft hole structure configured to be fitted with the mounting rotating shaft 162 is provided in a corresponding position in the upper base plate 110, so as to realize the rotatable mounting of the front cover 130 to the housing 100 via the shaft-hole fit.

Advantageously, the front panel 131 is connected with the lower panel 132 via an arc transition portion, to make the appearance of the indoor unit 100 aesthetic. Moreover, the indoor unit 1000 having a rounded-off surface is less easy to be damaged than the indoor unit 1000 having an angular surface during the transportation of the indoor unit 1000.

The upper base plate 110 is formed with the air inlet 101, and the air inlet grille 117 is provided at the air inlet 101. Thus, it is convenient for the air flow to enter the indoor unit 1000 via the air inlet 101, and the dust outside can be prevented from entering the indoor unit 1000 to a certain extent, i.e., the dust outside entering the indoor unit 1000 can be reduced, so as to facilitate cleaning the indoor unit 1000 and improve the stability and safety of the operation thereof. Advantageously, the air inlet grille 117 is integrally formed with the upper cover plate 112, so as to improve the structural strength of the air inlet grille 117 and facilitate the molding of the upper cover plate 112. In order to prevent foreign matters (such as the dust outside) from entering the housing 100, a filter mesh 145 may be provided at the air inlet grille 117, as shown in FIG. 2.

As shown in FIGS. 39 to 42, the air inlet grille 117 is disposed at the air inlet 101 of the upper cover plate 112, and provided with an air inlet hole running through the upper cover plate 112 along a thickness direction of the upper cover plate 112, in which the thickness direction refers to an up and down direction in FIG. 2.

Consequently, for the indoor unit 1000 according to this embodiment of the present invention, the heat exchanger 140 and the fan wheel 143 are respectively disposed in the housing of the indoor unit 1000, to facilitate assembling and disassembling of the indoor unit 1000, thus improving the assembling efficiency of the indoor unit 1000 greatly. Moreover, the indoor unit 1000 has a simple and compact structure, and various components in the housing of the indoor unit 1000 are modularized to facilitate maintenance and repair.

Figure 40:
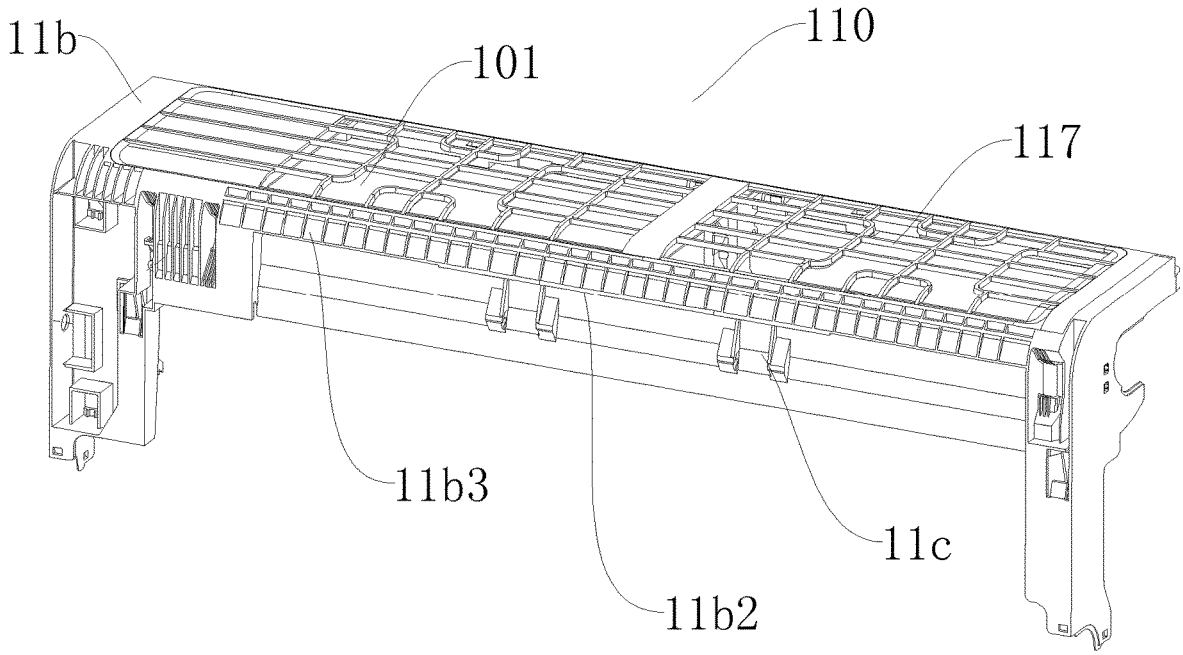
FIG. 40 is a perspective view of an upper base plate of an indoor unit for an air conditioner according to an embodiment of the present invention.
Figure 41:
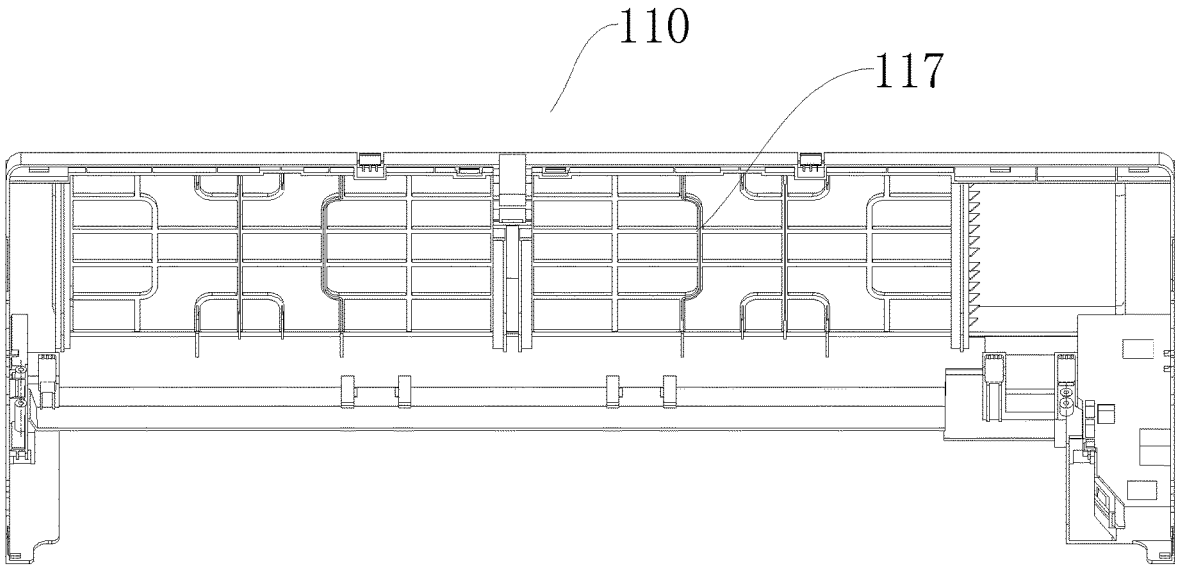
FIG. 41 is a schematic view of an upper base plate of an indoor unit for an air conditioner according to an embodiment of the present invention.
Figure 42:
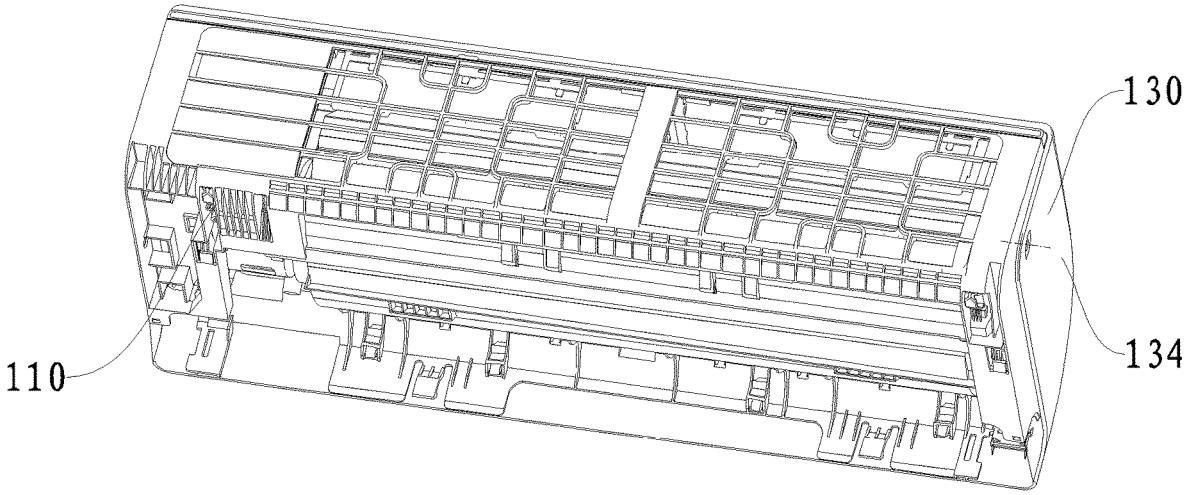
FIG. 42 is a schematic view of an indoor unit for an air conditioner according to an embodiment of the present invention.

In some specific embodiments of the present invention, as shown in FIG. 40, a rear portion of the upper cover plate 112 includes a bending plate portion **11*b*2 extending rearwards and downwards, and a wall-hung groove 11*c* is defined between the bending plate portion 11*b*2 and a rear wall of the upper base plate. Specifically, the upper base plate mainly includes the upper cover plate 112 and the bending plate portion 11*b*2, a rear end of the upper cover plate 112 is connected with an upper end of the bending plate portion 11*b*2, and the rear portion of the upper cover plate 112 extends rearwards and is bent downwards, so as to form the bending plate portion 11*b*2. The wall-hung groove 11*c* is defined between the upper cover plate 112 and the bending plate portion 11*b*2. In the process of mounting the indoor unit 1000, a mounting plate may be fixed in a mounting position first, and then the wall-hung groove 11*c* is fitted with a hook of the mounting plate, so as to realize the mounting of the indoor unit 1000**.

Consequently, by forming the bending plate portion **11*b*2 at the upper cover plate 112 of the housing, the wall-hung groove 11*c* may be formed by the bending plate portion 11*b*2 and the rear wall of the upper base plate, so as to facilitate the mounting of the indoor unit 1000. Moreover, the structure of the indoor unit 1000 is simple, complete and compact, thereby improving the assembling efficiency of the indoor unit 1000** considerably.

Alternatively, according to an embodiment of the present invention, the wall-hung groove **11*c* extends over an entire length of the upper cover plate 112. That is, the wall-hung groove 11*c* is defined between the bending plate portion 11*b*2 and the rear wall of the upper base plate, and extends along the length direction of the upper cover plate 112. The mounting plate of the indoor unit 1000 is provided with a plurality of hooks arranged along the length direction. By providing the wall-hung groove 11*c* in the length direction of the upper cover plate 112, the indoor unit 1000** may be mounted more firmly, so as to guarantee the safety thereof.

Specifically, in an embodiment of the present invention, the bending plate portion **11*b*2 is provided with a grid-like process groove 11*b*3. In this embodiment, the indoor unit 1000 further includes a filter mesh 145 disposed to the base plate. In other words, the indoor unit 1000 mainly includes the housing, the heat exchanger 140, the fan wheel 143 and the filter mesh 145, in which the filter mesh 145 is disposed to the base plate of the housing, and the heat exchanger 140 and the fan wheel 143** are also disposed in the housing.

Figure 39:
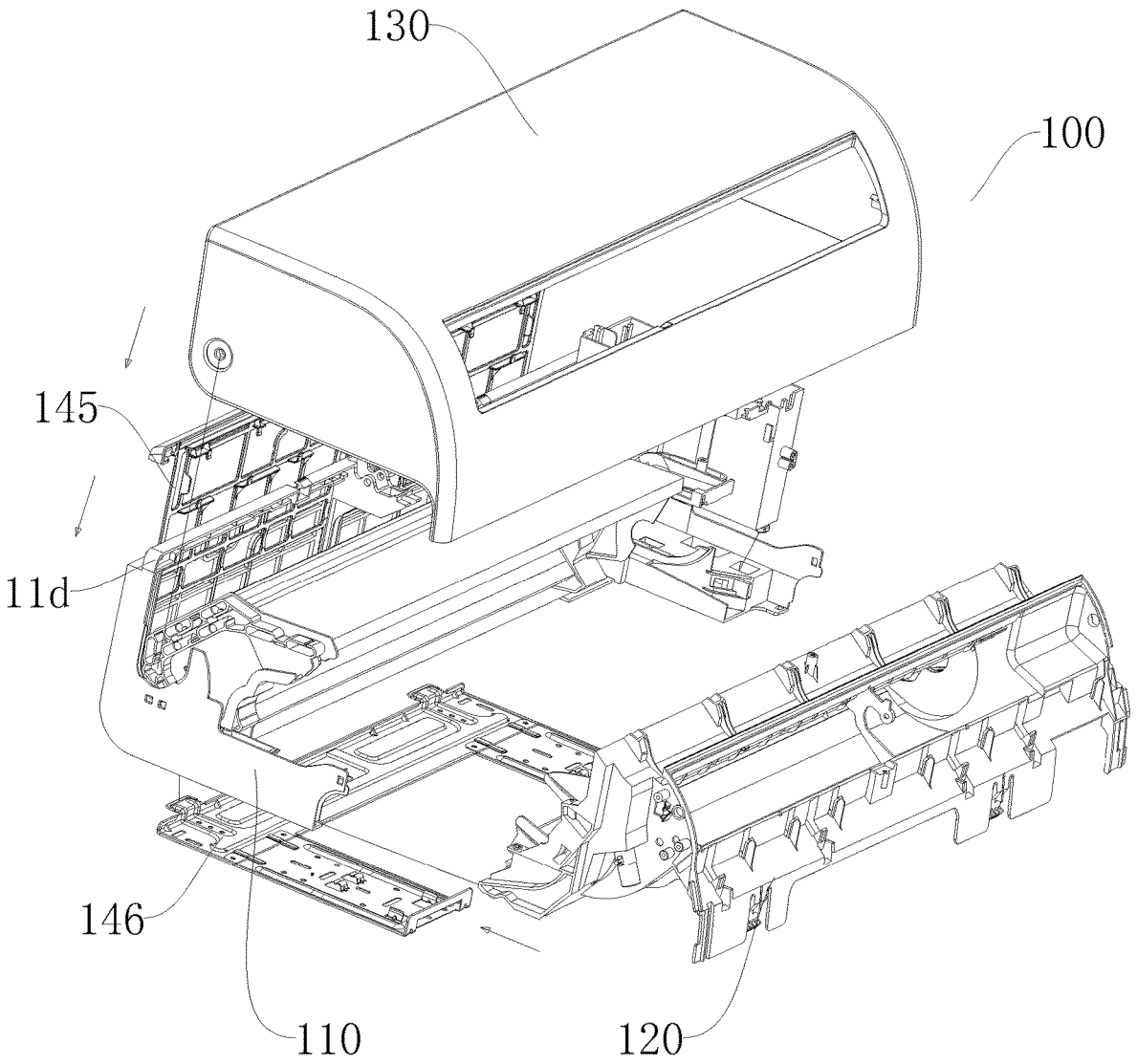
FIG. 39 is a perspective exploded view of an electric control box assembly of an indoor unit for an air conditioner according to an embodiment of the present invention.

In an embodiment of the present invention, as shown in FIG. 39, a supporting bar **11*d* is disposed in front of the upper base plate, an inserting groove 11*e* is defined between the supporting bar 11*d* and the upper cover plate 112, and the filter mesh 145 is fitted in the inserting groove 11*e* in a drawable manner. Alternatively, the supporting bar 11*d* is located at a lower portion of the upper cover plate 112**.

That is, the supporting bar **11*d* is provided to a front end of the base plate and located at the lower portion of the upper cover plate 112, the inserting groove 11*e* is defined between the supporting bar 11*d* and the upper cover plate 112 of the upper base plate, and the filter mesh 145 is provided in the inserting groove 11***e* and is movable therein.

Consequently, by providing the supporting bar 11*d* to the base plate and providing the filter mesh 145 in the inserting groove 11*e* defined between the supporting bar 11*d* and the upper cover plate 112, dust may be isolated and prevented from blocking an evaporator of the indoor unit 1000 to guarantee the normal working of the indoor unit 1000, and the indoor unit 1000 is convenient to clean.

In an embodiment of the present invention, the supporting bar 11*d* and the upper cover plate 112 are integrally formed. It may be understood that the supporting bar 11*d* may be directly formed on the base plate at the same time of molding the upper cover plate 112. The integrally formed structure not only guarantees the structural stability of the base plate, but also causes a low cost along with an easy molding and makes the structure of the whole housing compact.

Alternatively, in an embodiment of the present invention, a plurality of air inlet holes are provided and configured to have a grid-like shape. Specifically, as shown in FIG. 3, the upper cover plate 112 is provided with the plurality of air inlet holes spaced apart from one another and running through the upper cover plate 112, and the plurality of air inlet holes are arranged in the grid-like shape.

In some specific embodiments of the present invention, the heat exchanger 140 is disposed to the upper base plate 110, the air inlet hole is formed in the upper cover plate 112 of the upper base plate 110, the lower base plate 120 is detachably disposed below the upper base plate, and the fan wheel 143 is disposed on the lower base plate 120.

In other words, the upper base plate 110 is disposed above the lower base plate 120, and they are detachably connected with each other, in which the upper base plate 110 has the upper cover plate 112, the upper cover plate 112 is provided with the air inlet hole running through the upper cover plate 112, the heat exchanger 140 is disposed to the upper cover plate 112 of the upper base plate 110, and the fan wheel 143 is disposed on the lower base plate 120. Thus, the indoor unit 1000 according to the embodiments of the present invention has a simple structure with high stability, and is convenient to assemble or disassemble.

In an embodiment of the present invention, the heat exchanger 140 is disposed on the upper base plate 110, the upper base plate 110 has the upper cover plate 112, and the upper cover plate 112 is provided with the air inlet hole running through the upper cover plate 112. The rear portion of the upper cover plate 112 includes the bending plate portion 11*b*2 extending rearwards and downwards, and the wall-hung groove 11*c* is defined between the bending plate portion 11*b*2 and the rear wall of the upper base plate 110. The lower base plate 120 is detachably disposed below the upper base plate, the fan wheel 143 is disposed on the lower base plate 120, and the front cover 130 is detachably disposed to the upper base plate 110.

Figure 7:
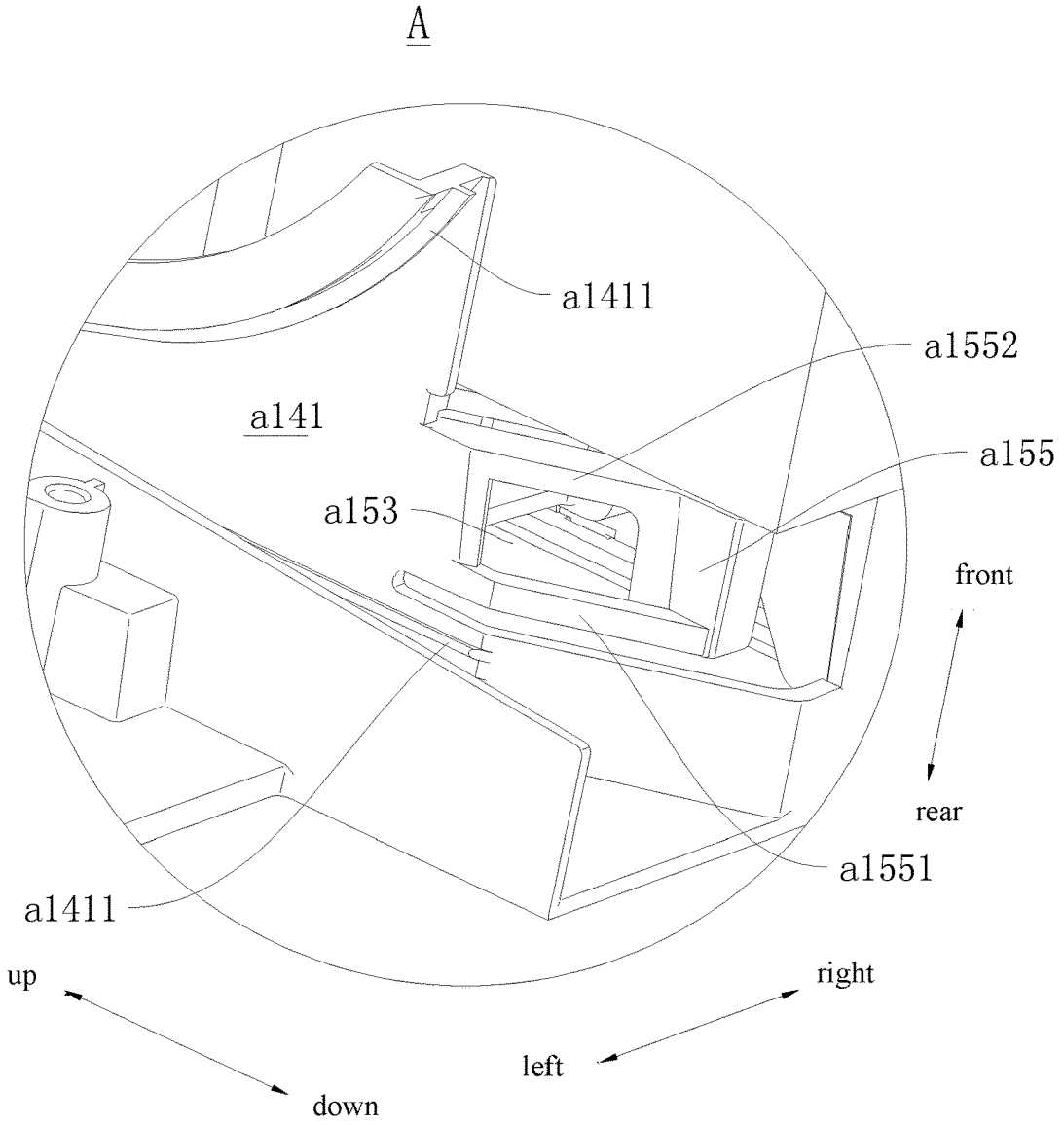
FIG. 7 is a partially enlarged view of part A in FIG. 6.

Specifically, as shown in FIG. 7, the housing of the indoor unit mainly includes the base plate and the front cover 130 that is detachably disposed to the base plate of the housing.

The base plate mainly includes the upper base plate 110 and the lower base plate 120. The lower base plate 120 is disposed below and detachably connected with the upper base plate 110, and the front cover 130 is detachably disposed to the upper base plate 110. More specifically, the upper base plate 110 includes the upper cover plate 112 and the bending plate portion 11*b*2 formed by the rear portion of the upper cover plate 112 extending rearwards and bent downwards. That is, the rear end of the upper cover plate 112 of the upper base plate 110 is connected with the upper end of the bending plate portion 11*b*2. The wall-hung groove 11*c* is defined between the bending plate portion 11*b*2 and the rear wall of the upper base plate 110. The heat exchanger 140 of the indoor unit 1000 is disposed to the upper base plate 110, while the fan wheel 143 thereof is disposed on the lower base plate 120.

Therefore, in the housing of the indoor unit 1000 according to this embodiment of the present invention, by forming the bending plate portion 11*b*2 at the upper base plate 110 of the housing, the wall-hung groove 11*c* may be formed between the bending plate portion 11*b*2 and the rear wall of the upper base plate 110, so as to facilitate mounting the indoor unit 1000. Moreover, the structure of the indoor unit 1000 is simple, complete and compact, thereby improving the assembling efficiency of the indoor unit 1000 considerably.

In an embodiment of the present invention, the front cover 130 is pivotably mounted to the upper base plate 110. That is, the front cover 130 may rotate around a position where the upper base plate 110 is mounted. Specifically, the front cover 130 defines the covering chamber 104, and the upper base plate 110 and the lower base plate 120 are disposed in the covering chamber 104 and shielded by the front cover 130.

Alternatively, in an embodiment of the present invention, the air inlet grille 117 is provided at the air inlet of the upper base plate 110. The air inlet grille 117 divides the air inlet of the upper base plate 110 into a plurality of grids. Alternatively, the air inlet grille 117 is integrally formed with the upper base plate 110.

By providing the air inlet grille 117 integrally designed with the upper cover plate 112 at the upper base plate 110, the structure of connecting the base plate with the air inlet grille 117 in the prior art is removed, thus improving the integrity of the housing of the indoor unit 1000 and guaranteeing the structural stability. Moreover, unnecessary assembling procedures are reduced to improve the production efficiency and the maintenance convenience considerably.

With reference to FIGS. 6 to 16, the housing 100 of the indoor unit 1000 according to an embodiment of the present invention includes the upper base plate 110, the lower base plate 120 and the guide assembly a14.

Specifically, the lower base plate 120 is detachably mounted to the upper base plate 110. The guide assembly a14 is used for guiding the lower base plate 120 in the process of mounting and dismounting the lower base plate 120. That is, the lower base plate 120 is moved, along the first guiding direction of the guide assembly a14, to the first position where the lower base plate 120 will be mounted to the upper base plate 110, when the lower base plate 120 needs mounting to the upper base plate 110; and the lower base plate 120 is moved, along the second guiding direction of the guide assembly a14, to the second position where the lower base plate 120 will be dismounted from the upper base plate 110, when the lower base plate 120 needs dismounting from the upper base plate 110.

For the housing 100 of the indoor unit 1000 according to the embodiment of the present invention, the guide assembly a14 is provided to explicitly guide the lower base plate 120 during the process of mounting and dismounting the lower base plate 120, so as to make the process easy, thus improving the efficiency of mounting and dismounting the lower base plate 120. Additionally, it is easy to mount the lower base plate 120 to the upper base plate 110 under a guiding function of the guide assembly a14, so as to avoid or decrease damage of the upper base plate 110 or the lower base plate 120 caused by an improper mounting way of the lower base plate 120, thus improving the qualified rate of the indoor unit 1000 and the housing thereof.

With reference to FIGS. 6 to 16, in some embodiments of the present invention, the guide assembly a14 includes: a guide groove a141 and a guide rail a142. The guide groove a141 is provided in the upper base plate 110. The guide rail a142 is configured to be fitted with the guide groove a141 and provided on the lower base plate 120. Through the fit of the guide rail a142 and the guide groove a141, it is convenient to guide the mounting direction of the lower base plate 120 so as to improve the mounting efficiency thereof.

Further, as shown in FIG. 7, the guide groove a141 extends upwards from a bottom of the upper base plate 110 and has an open bottom end, and at least one of a size of the guide groove a141 in a left and right direction and a size thereof in a front and rear direction decreases gradually from down to up. That is, in the process of mounting the lower base plate 120, the lower base plate 120 will slide upwards from an initial mounting position to be mounted to the upper base plate 110, so as to allow the lower base plate 120 to slide stably in the mounting process thereof.

Moreover, as shown in FIG. 7, the guide groove a141 is configured to have a size decreased gradually from down to up (i.e. from an open end of the guide groove a141 to a closed end thereof), so as to facilitate aligning the guide rail a142 with the guide groove a141 and thus inserting the guide rail a142 into the guide groove a141 conveniently. Furthermore, an upper end of the guide groove a141 is relatively small in size, which allows the guide rail a142 to be fitted into the guide groove a141 stably and conveniently.

The guide rail a142 has a shape decreased gradually from down to up in size and matched with the shape of the guide groove a141.

Further, as shown in FIG. 7, a rib a1411 is provided on at least one of a top wall, a bottom wall and a side wall of the guide groove a141, and the rib a1411 fitted with a side wall of the guide rail a142 has a guiding function. The fit between the rib a1411 and the side wall of the guide rail a142 may reduce a noise of the whole machine due to expansion caused by heat and contraction caused by cold.

Advantageously, with reference to FIGS. 6 to 12, the guide groove a141 is provided with a position limiting protrusion a151, the guide rail a142 is provided with a position limiting groove a152, and the position limiting protrusion a151 is configured to be fitted in the position limiting groove a152. That is, after the lower base plate 120 is mounted, the position limiting protrusion a151 is fitted in the position limiting groove a152, so as to position the lower base plate 120 with respect to the upper base plate 110 conveniently, thereby allowed the lower base plate 120 to be stably mounted. In addition, the fit of the position limiting protrusion a151 and the position limiting groove a152 may have a function of obvious indication, i.e. it can be quickly indicated whether the lower base plate 120 is mounted in place through the fit of the position limiting protrusion al 51 and the position limiting groove a152.

Moreover, when the position limiting protrusion a151 is snapped in the position limiting groove a152, a sound "crack" of snapping may be generated to further indicate that the lower base plate 120 is mounted in place.

Further, as shown in FIGS. 6 to 12, the position limiting protrusion a151 is provided on a bottom wall of the guide groove a141 and adjacent to the upper end of the guide groove a141, and the position limiting groove a152 is provided in a rear surface of the guide rail a142 and adjacent to an upper end of the guide rail a142, so as to position the lower base plate 120 stably. Moreover, since the position limiting protrusion a151 is provided adjacent to the upper end of the guide groove a141, the abrasion of the position limiting protrusion a151 is less in the process of mounting and dismounting the lower base plate 120.

Further, two guide grooves a141 are provided at a left end and a right end of the upper base plate 110 respectively and each are provided with the position limiting protrusion a151 therein, two guide rails a142 are provided at a left end and a right end of the lower base plate 120 respectively and each are provided with the position limiting groove a152 therein, the two guide rails a142 are slidably fitted in the two guide grooves a141 respectively, and the two position limiting protrusions a151 are fitted in the two position limiting grooves a152 respectively. Two pairs of guide grooves a141 and guide rails a142 may further facilitate the mounting of the lower base plate 120, two pairs of position limiting protrusions a151 and position limiting grooves a152 are fitted with each other to facilitate the positioning of the upper base plate 110.

Further, at least one of the size of the guide groove a141 in the left and right direction and the size thereof in the front and rear direction is decreased gradually from down to up, so as to facilitate aligning the guide rail a142 with the guide groove a141 and thus inserting the guide rail a142 into the guide groove a141 conveniently. Furthermore, the upper end of the guide groove a141 is relatively small in size, thus allowing the guide rail a142 to be fitted into the guide groove a141 stably and conveniently.

Advantageously, with reference to FIGS. 6 to 12, the upper base plate 110 is provided with a connecting groove a153, the lower base plate 120 is provided with a connecting protrusion a154, and the connecting protrusion a154 is configured to be fitted in the connecting groove a153. That is, after the lower base plate 120 is mounted, the connecting protrusion a154 on the lower base plate 120 has at least a part thereof fitted in the connecting groove a153, so as to limit the lower base plate 120. Also, the lower base plate 120 is positioned through the fit of the connecting groove a153 and the connecting protrusion a154.

Further, the upper base plate 110 is provided with an elastic arm a155, and the connecting groove a153 is provided in the elastic arm a155. In the process of mounting the lower base plate 120, the connecting protrusion a154 on the lower base plate 120 pushes the elastic arm a155 outwards, such that the lower base plate 120 is moved conveniently and the connecting protrusion a154 is less easy to be damaged. Also, in the dismounting process, the elastic arm a155 may be pulled to separate the connecting protrusion a154 from the connecting groove a153, so as to facilitate dismounting the lower base plate 120 from the upper base plate 110. Ribs of the elastic arm a155 located at both sides of the connecting groove a153 are arranged in a stagger manner.

Further, the elastic arm a155 extends along the up and down direction, and the connecting groove a153 in the elastic arm a155 extends along the left and right direction. An inner side surface of a first rib b1551 of the elastic arm a155 located in rear of the connecting groove a153 protrudes inwards beyond an inner side surface of a second rib a1552 thereof located in front of the connecting groove a153.

Additionally, as shown in FIGS. 6 to 12, the connecting groove a153 is disposed at the right end of the upper base plate 110, and the connecting protrusion a154 is disposed at the right end of the lower base plate 120, so as to mount and dismount the lower base plate 120 conveniently.

Specifically, the connecting groove a153 is disposed in the guide groove a141 and located adjacent to a lower end of the upper base plate 110.

Specifically, the elastic arm a155 is disposed at the right end of the upper base plate 110, the connecting groove a153 in the elastic arm a155 extends along the left and right direction, the elastic arm a155 has the second rib a1552 located in front of the connecting groove a153 and the first rib b1551 located in rear of the connecting groove a153, and a left side surface of the first rib b1551 protrudes leftwards beyond a left side surface of the second rib a1552.

Certainly, the connecting groove a153 may be provided at each side of the upper base plate 110, and the connecting protrusion a154 may be provided at each end of the lower base plate 120. Also, the guide groove a141 (or the guide rail a142) may be provided at a side of the upper base plate 110, and the guide rail a142 (or the guide groove a141) may be provided in a corresponding position of the lower base plate 120. Also, multiple pairs of guide groove a141 and guide rail a142 may be provided to the upper base plate 110 and the lower base plate 120.

Furthermore, in the previous description, positions of the guide groove a141 and the guide rail a142 may be exchanged, positions of the connecting groove a153 and the connecting protrusion a154 may be exchanged, and positions of the position limiting protrusion a151 and the position limiting groove a152 may be exchanged.

Further, the lower base plate 120 is further mounted to the upper base plate 110 via a first threaded fastener, so as to further improve the stability of the lower base plate 120 and also prevent the lower base plate 120 from slipping off or breakdown.

Preferably, the upper base plate 110 is provided with the air inlet grille 117, which makes it convenient for the air flow to enter the indoor unit 1000, and prevents the dust outside from entering the indoor unit 1000 to a certain extent, so as to reduce the dust entering into the indoor unit 1000, thus facilitating cleaning the indoor unit 1000 and improving the stability and safety of the operation thereof.

Preferably, the air inlet grille 117 is integrally formed with the upper base plate 110, so as to improve the structural strength of the air inlet grille 117 and facilitate the molding of the upper base plate 110.

Also, the assembling of the housing 100 is generally implemented by mounting the lower base plate 120 to the upper base plate 110, so the guide rail a142 is disposed on the lower base plate 120 while the guide groove a141 is formed in the upper base plate 110, to improve the guiding efficiency and effect of the guide assembly a14, thereby further improving the efficiency of assembling the housing 100.

Certainly, in the present invention, the guide rail a142 may be disposed on the upper base plate 110, while the guide groove a141 may be formed in the upper base plate 110. Additionally, the upper base plate 110 may be provided with the guide rail a142 and the guide groove a141, while the lower base plate 120 may be provided with the guide groove a141 and the guide rail a142 corresponding to the guide rail a142 and the guide groove a141 respectively.

In the embodiments of the present invention, in the process of mounting the lower base plate 120, the guide rail a142 on the lower base plate 120 is fitted with the guide groove a141 in the upper base plate 110, the lower base plate 120 is pushed rearwards and downwards to move the guide rail a142 along the guide groove a141, and when the guide rail a142 is moved to a predetermined position, the position limiting groove a152 in the guide rail a142 is fitted with the position limiting protrusion a151 in the guide groove a141. Moreover, in the process of moving the guide rail a142 along the guide groove a141, the connecting protrusion a154 on the lower base plate 120 pushes the elastic arm a155 to be deformed elastically. When the connecting protrusion a154 is moved to a predetermined position, the connecting protrusion a154 is opposite to the connecting groove a153, and at this moment, the elastic arm a155 is restored, such that at least a part of the connecting protrusion a154 is fitted in the connecting groove a153. After the position limiting protrusion a151 is fitted with the position limiting groove a152, and the connecting protrusion a154 is fitted with the connecting groove a153, the lower base plate 120 is fastened to the upper base plate 110 via a screw.

In the process of dismounting the lower base plate 120, the screw for connecting the lower base plate 120 with the upper base plate 110 is removed, and the elastic arm a155 is pulled to be elastically deformed in a direction moving away from the lower base plate 120. In such a way, the connecting protrusion a154 escapes from the connecting groove a153, and the lower base plate 120 is drawn downwards, so that the position limiting groove a152 in the guide rail a142 of the lower base plate 120 is separated from the position limiting protrusion a151 in the guide groove a141 of the upper base plate 110. Then, the lower base plate 120 is drawn further, and the guide rail a142 of the lower base plate 120 is moved along the guide groove a141 of the upper base plate 110. When the guide rail a142 is completely separated from the guide groove a141, the lower base plate 120 may be detached from the upper base plate 110. The lower base plate 120 according to embodiments of the present invention is convenient to mount and dismount.

Figure 8:
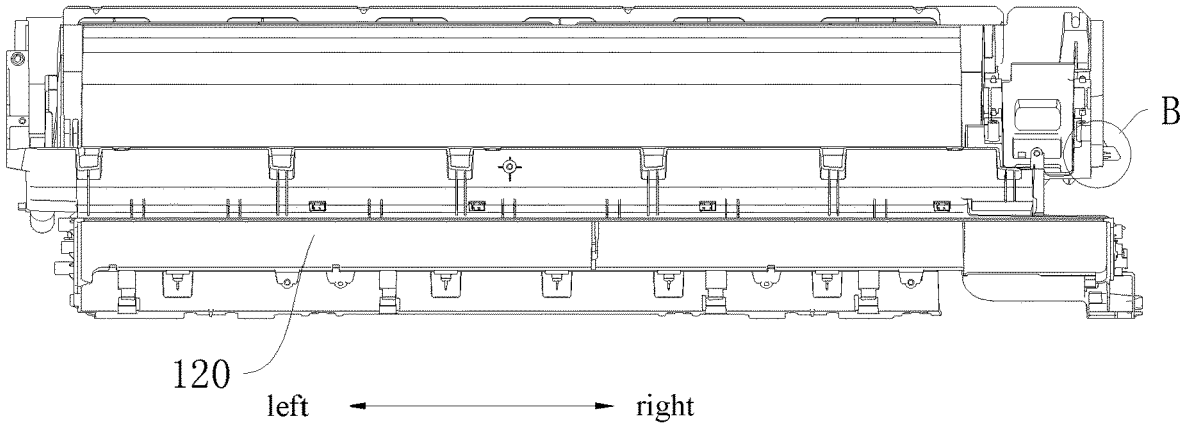
FIG. 8 is a schematic view of a housing of an indoor unit for an air conditioner according to an embodiment of the present invention.
Figure 9:
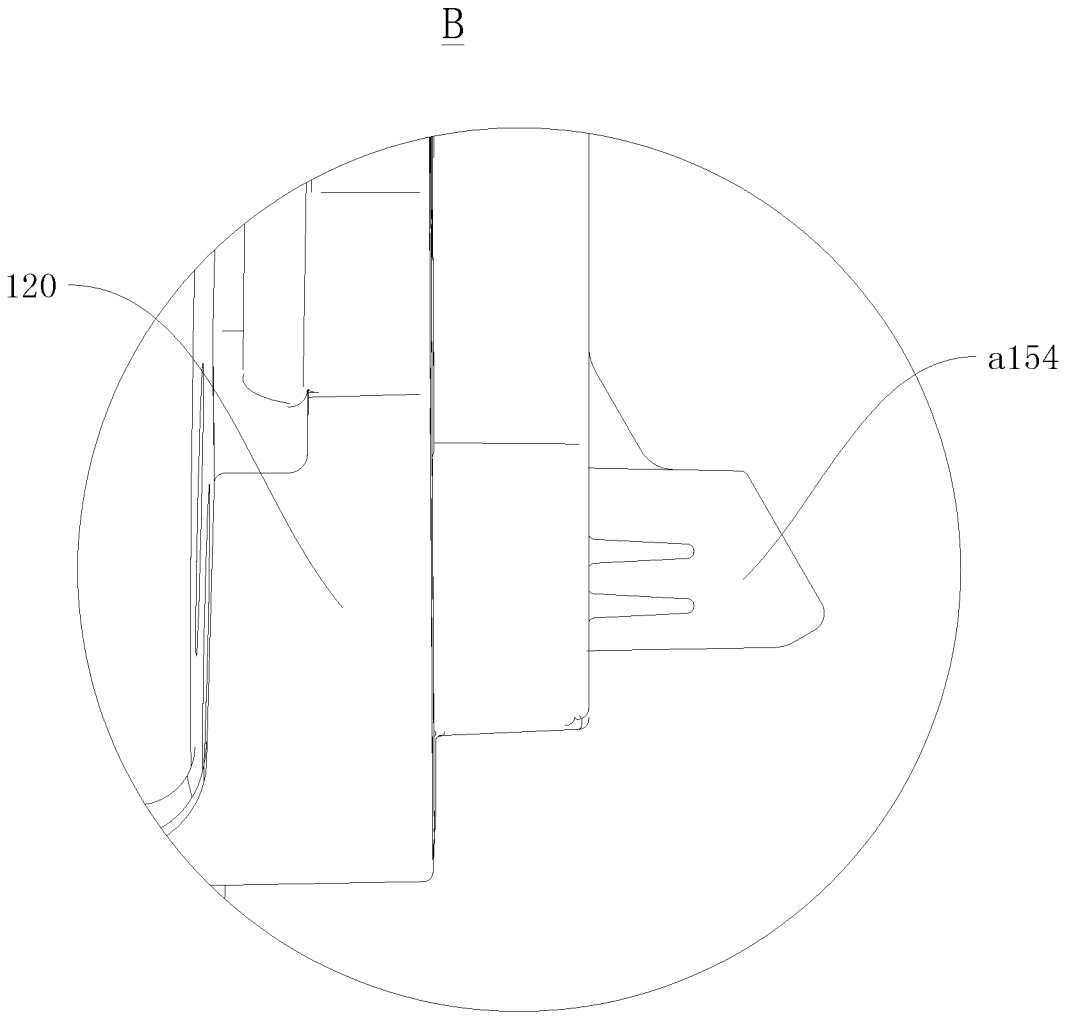
FIG. 9 is a partially enlarged view of part B in FIG. 8.

As shown in FIG. 8, the indoor unit 1000 according to the embodiments of the present invention includes the housing 100, the front cover 130, the heat exchanger 140 and the fan 142.

Specifically, the housing 100 includes the upper base plate 110 and the lower base plate 120. The lower base plate 120 is detachably mounted to the upper base plate 110, and the front cover 130 is detachably mounted to the upper base plate 110. The upper base plate 110 is provided with the air inlet 101 for air supply, and the lower base plate 120 is provided with the air outlet (not shown) for air exhaust. Driven by the fan 142, the air flow enters the indoor unit 1000 from the air inlet 101 and is sent out through the air outlet. The air flow exchanges heat with the heat exchanger 140 in the indoor unit 1000. The heat exchanger 140 is mounted to the upper base plate 110, and the fan 142 is detachably mounted to the lower base plate 120.

In the indoor unit 1000 according to the embodiments of the present invention, the fan 142 is mounted to the lower base plate 120, and the lower base plate 120 is detachably mounted to the upper base plate 110. The cleaning, maintenance and repair of the fan 142 just need to dismount the lower base plate 120 from the upper base plate 110, and hence the fan 142 may be dismounted from the indoor unit 1000, which avoids the problem in the prior art that the heat exchanger 140 affects the mounting and dismounting of the fan 142. The convenient dismounting of the fan 142 in the present invention facilitates cleaning the fan wheel 143 of the fan 142. The cleaning of the fan wheel 143 does not involve the dismounting and mounting of the heat exchanger 140, which avoids the problem that the heat exchanger 140 tends to break down due to the dismounting and mounting thereof during the cleaning of the fan 142, thus facilitating the maintenance of the indoor unit 1000 and reducing the failure rate of the indoor unit 1000.

With reference to FIGS. 1 to 12, in some embodiments of the present invention, the upper base plate 110 includes: the rear baffle 111, the upper cover plate 112, the left end plate 113 and the right end plate 114. The heat exchanger 140 is mounted to the rear baffle 111, the rear edge of the upper cover plate 112 is connected with the upper edge of the rear baffle 111, and the air inlet 101 is formed in the upper cover plate 112, such that the air flow may enter the indoor unit 1000 from the air inlet 101 to exchange heat conveniently. The rear edge of the left end plate 113 is connected with the left edge of the rear baffle 111 and the upper edge of the left end plate 113 is connected with the left edge of the upper cover plate 112. The rear edge of the right end plate 114 is connected with the right edge of the rear baffle 111 and the upper edge of the right end plate 114 is connected with the right edge of the upper cover plate 112, so as to enhance the structural strength of the upper base plate 110 and facilitate mounting the heat exchanger 140 to the upper base plate 110, thereby improving the structural strength of the whole indoor unit 1000.

Additionally, by providing the air inlet 101 in the upper cover plate 112 of the upper base plate 110 and mounting the heat exchanger 140 to the rear baffle 111, the gap may be effectively formed between the heat exchanger 140 and the upper cover plate 112 provided with the air inlet 101, such that the air flow may enter the indoor unit 1000 smoothly, so as to guarantee the smooth circulation of the air flow and improve the working efficiency of the indoor unit 1000.

Preferably, the lower base plate 120 is detachably mounted at the right side of the left end plate 113 and at the left side of the right end plate 114. The left end plate 113 is located at the left side of the lower base plate 120, and the right end plate 114 is located at the right side of the lower base plate 120, so as to facilitate mounting the lower base plate 120 to the upper base plate 110 and disassembling the lower base plate 120 therefrom.

Further, the upper base plate 110 further includes the left shield plate 115 and the right shield plate 116. The left shield plate 115 is mounted to the left side surface of the left end plate 113, and the right shield plate 116 is mounted to the right side surface of the right end plate 114, so as to further improve the structural strength of the upper base plate 110 via the left shield plate 115 and the right shield plate 116 and also to enhance the sealing performance at the left and right sides of the upper base plate 110, along with a beautiful appearance of the housing 100.

Preferably, the front cover 130 is detachably mounted to the left shield plate 115 and the right shield plate 116, which facilitates mounting the front cover 130 and improves the assembling and maintenance efficiency of the indoor unit 1000.

Advantageously, as shown in FIGS. 39 to 42, the air inlet grille 117 is provided at the air inlet 101 of the upper cover plate 112, which makes it convenient for the air flow to enter the indoor unit 1000 via the air inlet 101, and prevents the dust outside from entering the indoor unit 1000 to a certain extent, i.e., reducing the dust entering the indoor unit 1000, so as to facilitate cleaning the indoor unit 1000 and also to improve the stability and safety of the operation thereof.

Additionally, the upper base plate 110 according to the present invention may include other forms. For example, the upper base plate 110 may only include the rear baffle 111, but not include the upper cover plate 112, and the rear baffle 111 is formed with positions where the heat exchanger 140 and the lower base plate 120 are mounted.

In some embodiments of the present invention, the front cover 130 is pivotably mounted over the upper base plate 110. That is, the front cover 130 is mounted over the upper base plate 110 and rotatable between the first position where the housing 100, the heat exchanger 140 and the fan 142 are shielded and the second position where the housing 100, the heat exchanger 140 and the fan 142 are exposed, so as to facilitate mounting the heat exchanger 140 and the fan 142 to the housing 100 and dismounting the heat exchanger 140 and the fan 142 therefrom.

Figure 10:
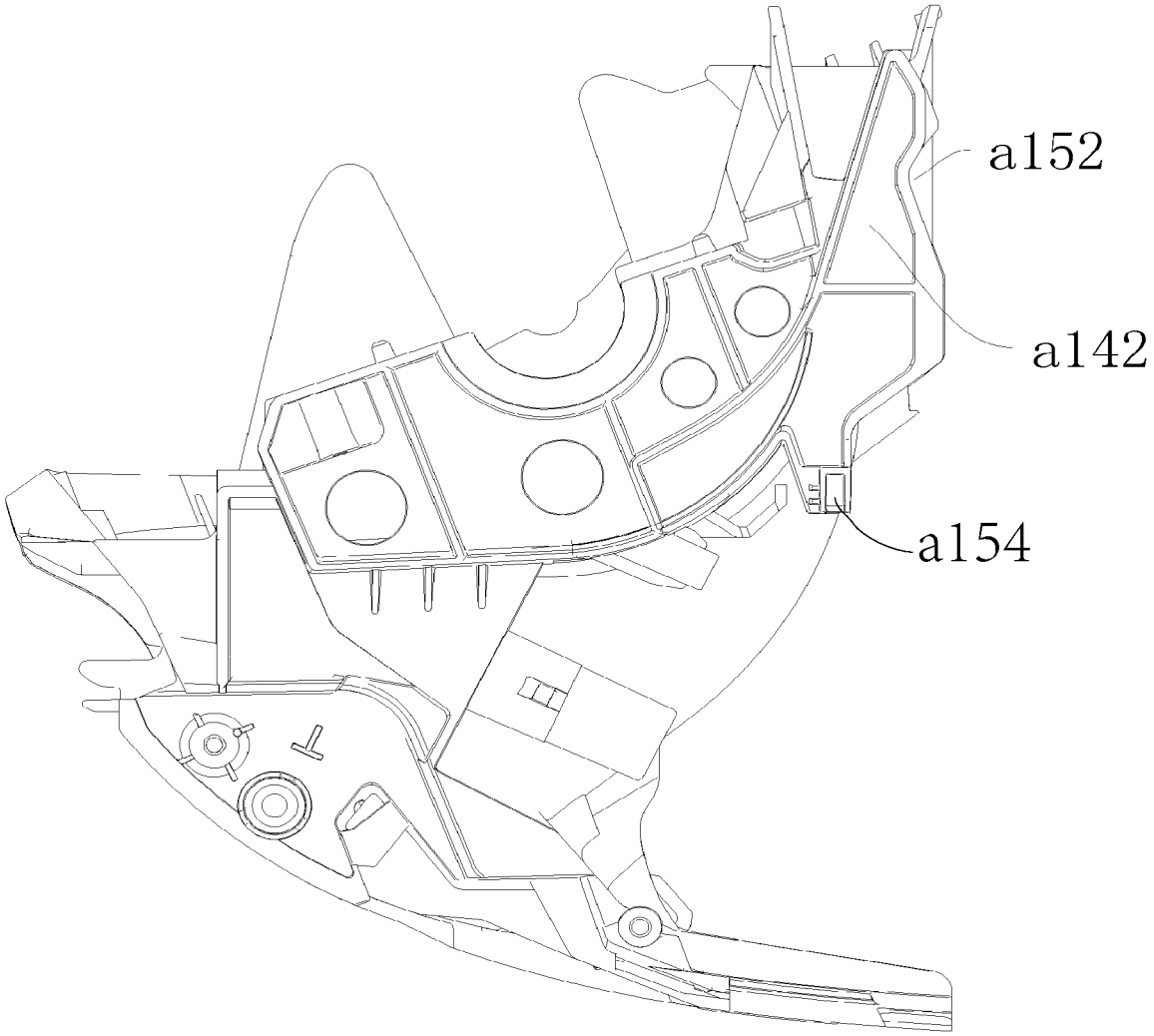
FIG. 10 is a right view of the housing shown in FIG. 8.

Referring to FIGS. 8 and 10, in some embodiments of the present invention, the front cover 130 defines the covering chamber 104, and the upper base plate 110 and the lower base plate 120 are disposed in the covering chamber 104 and covered by the front cover 130, such that the indoor unit 1000 has the beautiful appearance and is enclosed, thus facilitating the oriented air supply. Alternatively, the air supply port 103 corresponding to the air outlet in position is provided in the front cover 130 and configured to avoid the air outlet.

Further, with reference to FIGS. 1 to 5, the front cover 130 includes the front panel 131, the lower panel 132, the left panel 133 and the right panel 134. The front panel 131 covers front surfaces of the upper base plate 110 and the lower base plate 120. The lower panel 132 has the front edge connected with the lower edge of the front panel 131, and covers the lower surface of the lower base plate 120, in which the air supply port 103 is provided at the position where the front panel 131 and the lower panel 132 are connected. The left panel 133 has the front edge connected with the left edge of the front panel 131 and the lower edge connected with the left edge of the lower panel 132, and is rotatably mounted to the left side of the upper base plate 110 and covers the left side of the upper base plate 110. The right panel 134 has the front edge connected with the right edge of the front panel 131 and the lower edge connected with the right edge of the lower panel 132, and is rotatably mounted to the right side of the upper base plate 110 and covers the right side of the upper base plate 110.

Further, with reference to FIG. 5, the left panel 133 is provided at the left side of the upper base plate 110, and the right panel 134 is provided at the right side of the upper base plate 110. The rotating shaft is provided at each of the rear end of the upper portion of the left panel 133 and the rear end of the upper portion of the right panel 134, while the shaft hole structure configured to be fitted with the rotating shaft 162 is provided in each of the left shield plate 115 and the right shield plate 116 of the upper base plate 110, so as to realize the rotatable mounting of the front cover 130 to the housing 100 via the shaft-hole fit.

Advantageously, the front panel 131 is connected with the lower panel 132 via the arc transition portion, to make the appearance of the indoor unit 100 aesthetic. Moreover, the indoor unit 1000 having the rounded-off surface is less easy to be damaged than the indoor unit 1000 having the angular surface during the transportation of the indoor unit 1000.

Additionally, the front panel 131 and the lower panel 132 of the front cover 130 may be molded separately, in which the lower panel 132 may be separately fixed to the lower panel 120 or integrally molded with the lower panel 120.

Figure 11:
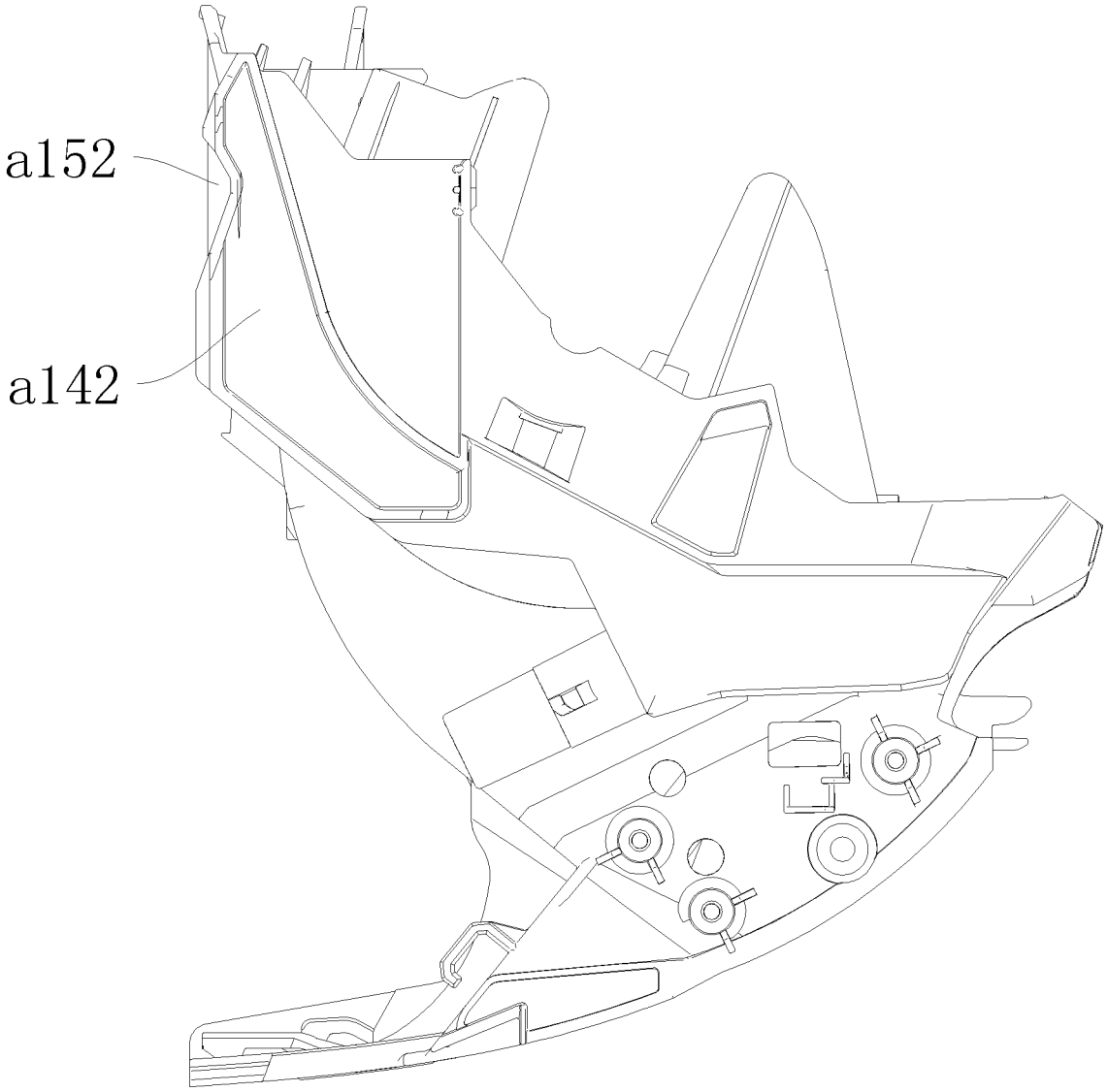
FIG. 11 is a left view of the housing shown in FIG. 8.
Figure 12:
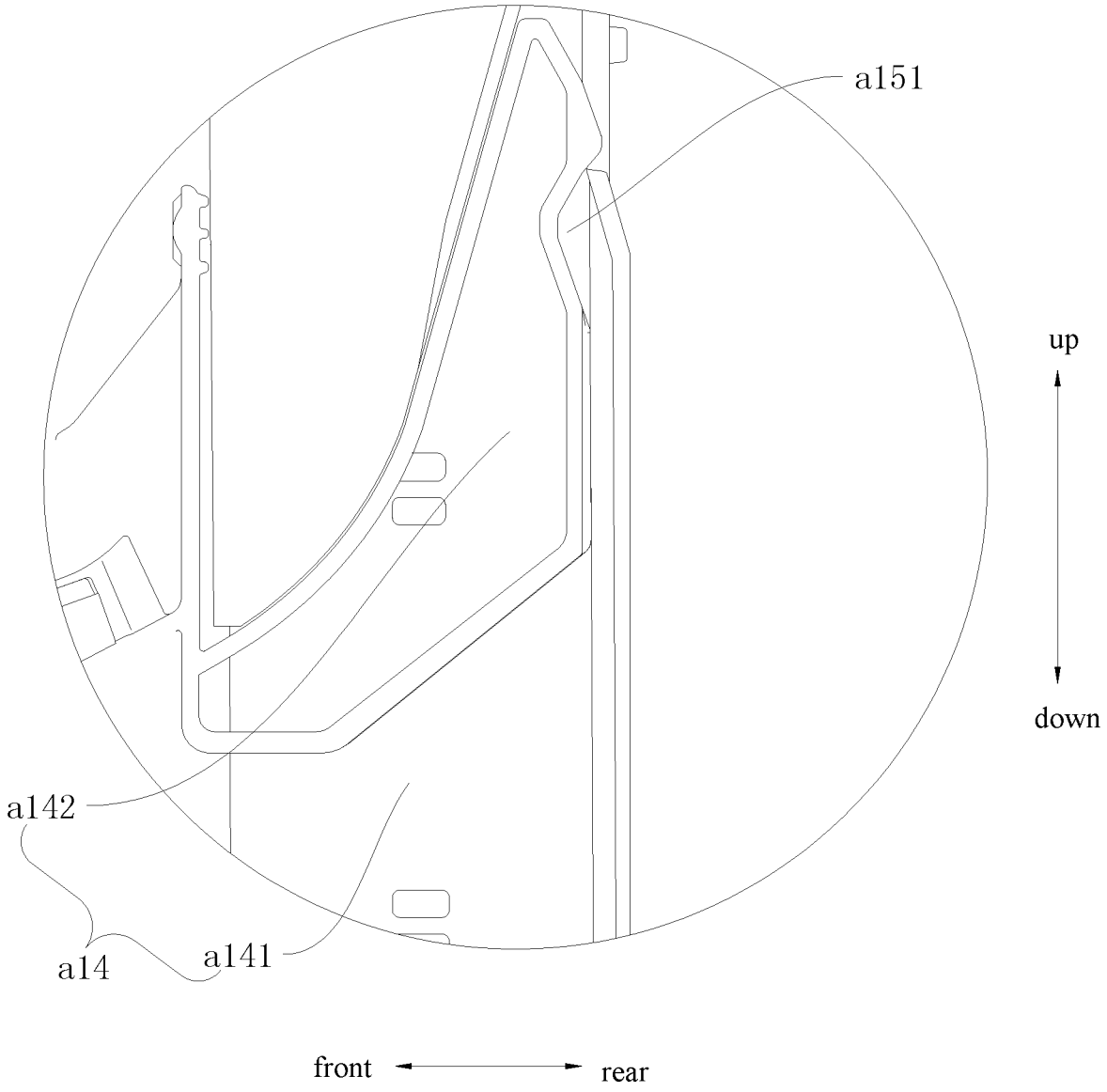
FIG. 12 is a schematic view of a guide rail and a guide groove fitted with each other of an indoor unit for an air conditioner according to an embodiment of the present invention.
Figure 13:
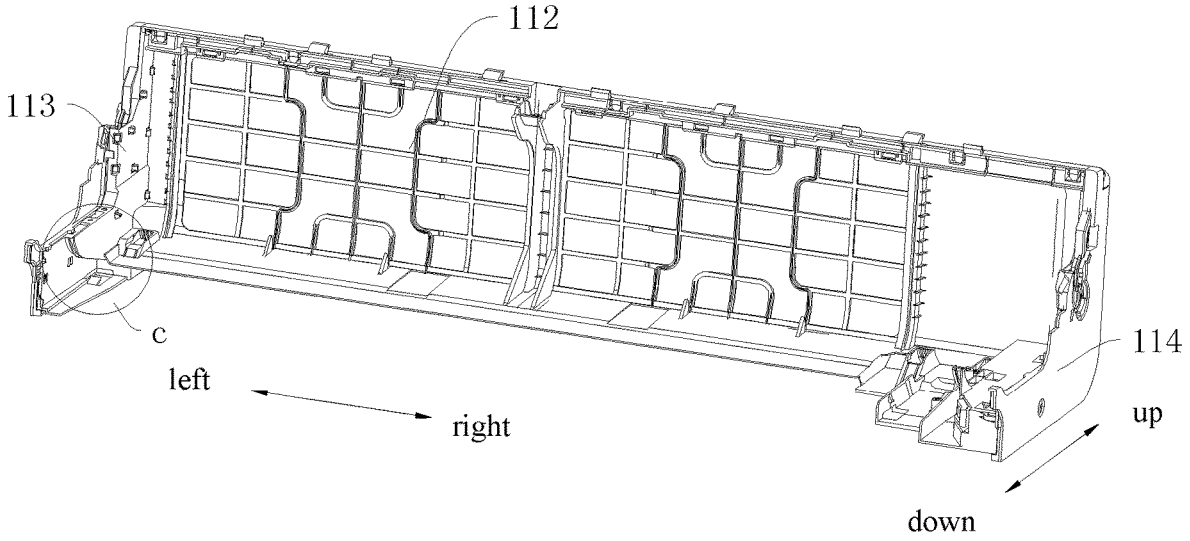
FIG. 13 is a schematic view of an upper base plate of an indoor unit for an air conditioner according to an embodiment of the present invention.
Figure 14:
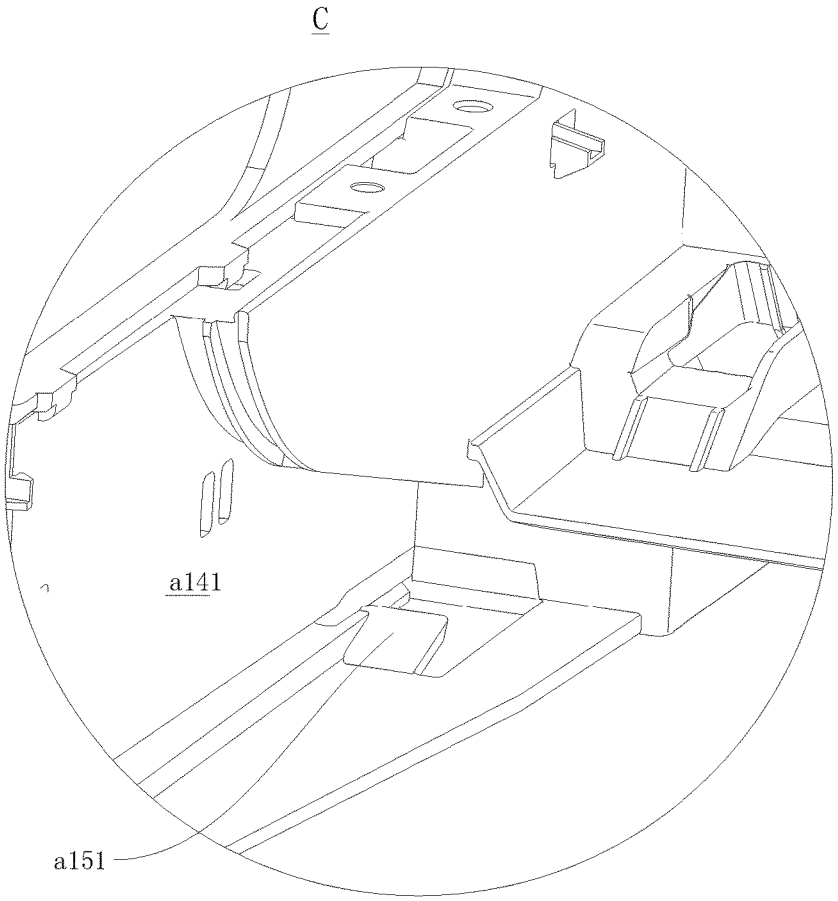
FIG. 14 is a partially enlarged view of part C in FIG. 13.
Figure 15:
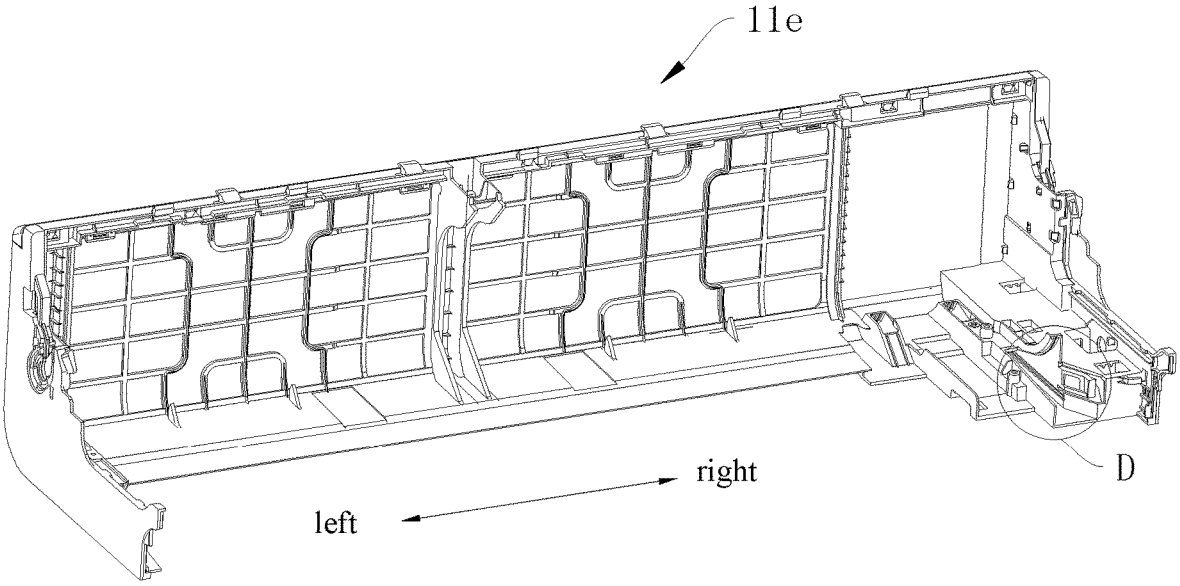
FIG. 15 is a schematic view of an upper base plate of an indoor unit for an air conditioner according to an embodiment of the present invention.
Figure 16:
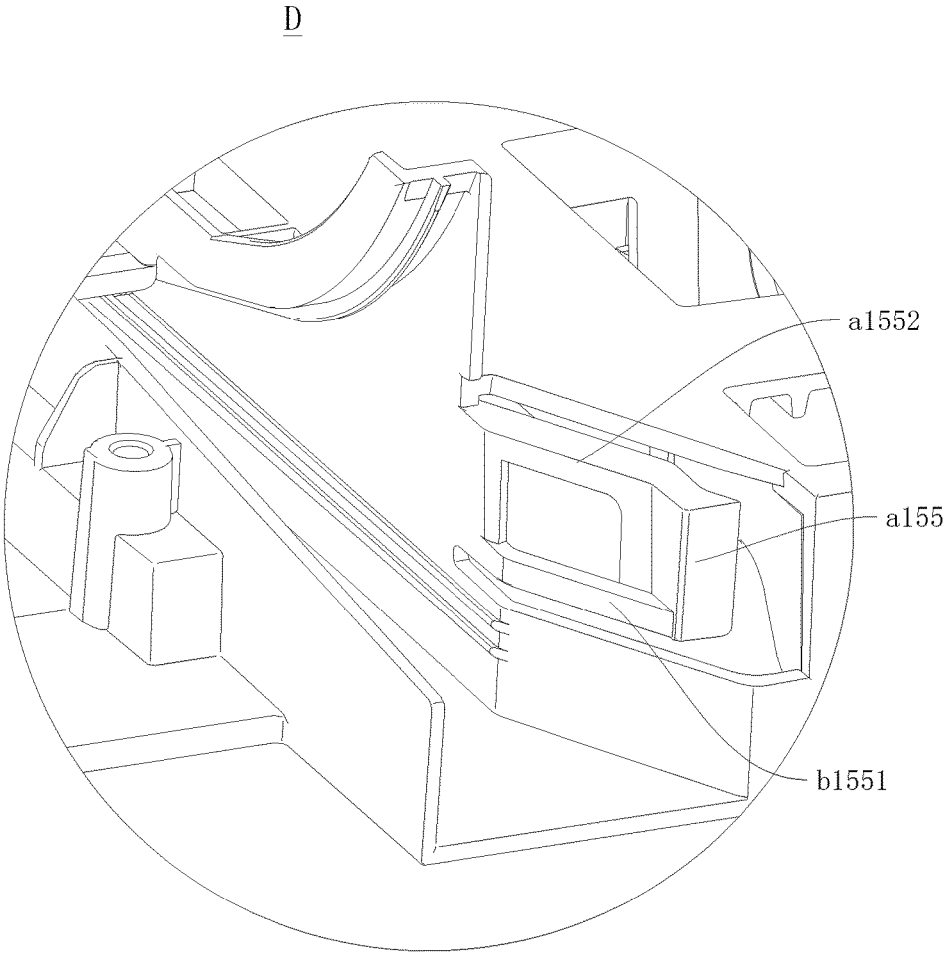
FIG. 16 is a partially enlarged view of part D in FIG. 15.

As shown in FIG. 11, in some embodiments of the present invention, the fan 142 includes the fan wheel 143 and the motor 144. The fan wheel 143 is detachably mounted to the lower base plate 120, and the motor 144 is detachably mounted to the lower base plate 120 and connected with the fan wheel 143 in the transmission way, so as to facilitate the operation, mounting and dismounting of the fan 142.

Further, the lower base plate 120 is provided with the motor mounting groove (not shown) for the motor 144, the upper base plate 110 is provided with the water receiving cover 141, the motor 144 is mounted in the motor mounting groove, and the water receiving cover 141 is located below the heat exchanger 140 and presses the motor 144 in the motor mounting groove.

In some embodiments of the present invention, the air deflector 105 is provided at the air outlet of the lower base plate 120 and exposed out from the air supply port 103, so as to guide the direction of the air flow sent out from the indoor unit 1000.

In some embodiments, as shown in FIGS. 29 to 38, the indoor unit 1000 further includes an electric control box assembly 200 that includes an electric control box body 210, an electric control box lid 220, an electric control printed circuit board 230, a ground sheet 240 and a wire holder 250. Specifically, the electric control box lid 220 is provided at a top of the electric control box body 210, the electric control printed circuit board 230 is provided in the electric control box body 210 and arranged along the vertical direction (e.g. the up and down direction shown in FIG. 31), the ground sheet 240 is provided at the top of the electric control box body 210, and the wire holder 250 also is provided at the top of the electric control box body 210 and located on the ground sheet 240.

In other words, the electric control box assembly 200 mainly includes the electric control box body 210, the electric control box lid 220, the electric control printed circuit board 230, the ground sheet 240 and the wire holder 250. The electric control box body 210 is provided with the electric control printed circuit board 230, the ground sheet 240 and the wire holder 250 therein. The electric control box lid 220 is provided over the top of the electric control box body 210. Specifically, the electric control printed circuit board 230 is configured as a board body by extending along the vertical direction, and has two ends connected with the electric control box body 210. The ground sheet 240 is provided at the top of the electric control box body 210, and the wire holder 250 is provided on the ground sheet 240.

Consequently, for the electric control box assembly 200 according to embodiments of the present invention, since the electric control box body 210 and the electric control box lid 220 of the electric control box assembly 200 are configured as separate structures, the electric control printed circuit board 230, the ground sheet 240 and the wire holder 250 can be mounted in the electric control box body 210 in order respectively, which provides a simple and compact structure, and is convenient to assemble or disassemble and easy to operate.

Specifically, according to an embodiment of the present invention, a mounting groove 211 is formed in each of two opposite inner walls of the electric control box body 210, and the two ends of the electric control printed circuit board 230 extend into corresponding mounting grooves 211, respectively.

As shown in FIGS. 29-38, the electric control box body 210 is configured as a substantially rectangular box body, and the mounting groove 211 is formed in each of the two opposite inner walls of the electric control box body 210 and extends along the vertical direction of the electric control box body 210. The two ends of the electric control printed circuit board 230 are clamped in the two opposite mounting grooves 211 of the electric control box body 210. Preferably, each of upper and lower ends of the mounting groove 211 has a V shape to facilitate mounting the electric control printed circuit board 230. In this embodiment, a width (for example, a size in the front and rear direction shown in FIG. 31) of the mounting groove 211 is larger than or equal to a thickness of the electric control printed circuit board 230.

Therefore, by providing the mounting grooves 211 in the two opposite inner walls of the electric control box body 210, the electric control printed circuit board 230 may be fixedly mounted in the electric control box body 210, which improves the utilization rate of the mounting space effectively, guarantees the structural stability of the electric control box assembly 200, prevents the electric control printed circuit board 230 from falling off from the electric control box body 210 and thus ensures the normal operation of the indoor unit 1000. Moreover, the electric control printed circuit board 230 may be mounted or dismounted from the front side, to facilitate the assembling and disassembling of the electric control box assembly 200.

Alternatively, according to an embodiment of the present invention, an extension part 212 is provided at the top of the electric control box body 210 and extends in a direction running away from a center of the electric control box body 210, in which the ground sheet 240 and the wire holder 250 are provided on the extension part 212.

Figure 32:
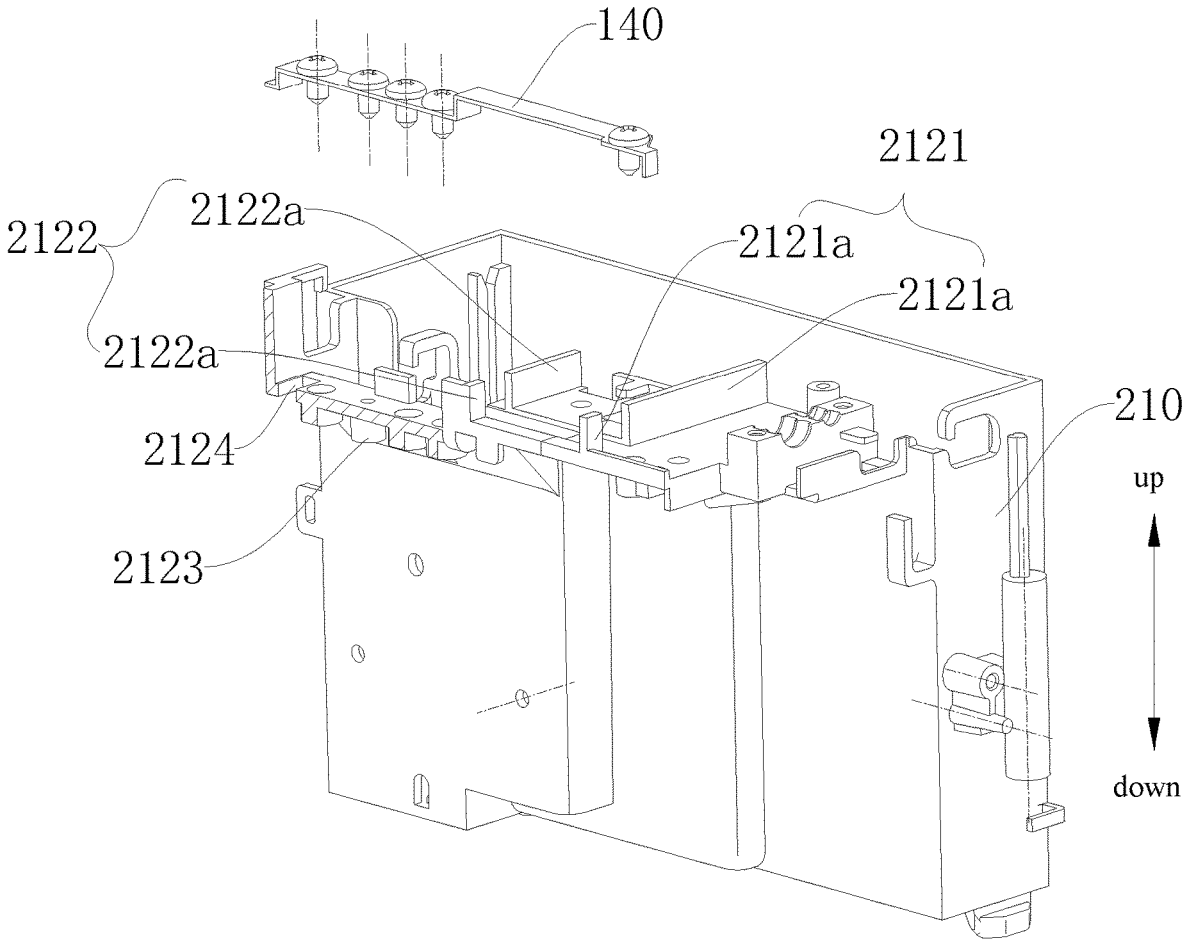
FIG. 32 is a perspective exploded view of an electric control box assembly of an indoor unit for an air conditioner according to an embodiment of the present invention.

As shown in FIG. 32, according to an embodiment of the present invention, the extension part 212 is provided with a first position limiting rib 2121, and the first position limiting rib 2121 includes two first position limiting sub-ribs 2121*a* that are spaced apart from each other in a width direction of the ground sheet 240.

According to an embodiment of the present invention, as shown in FIGS. 28 to 33, the extension part 212 is provided with a second position limiting rib 2122 spaced apart from the first position limiting rib 2121 in a length direction of the ground sheet 240, and the second position limiting rib 2122 includes two second position limiting sub-ribs 2122*a* that are spaced apart from each other in the width direction of the ground sheet 240. The wire holder 250 is provided between the first position limiting rib 2121 and the second position limiting rib 2122.

Specifically, the extension part 212 is provided with the first position limiting rib 2121 and the second position limiting rib 2122 that are spaced apart from each other along the length direction of the ground sheet 240. The first position limiting rib 2121 mainly consists of two first position limiting sub-ribs 2121*a* spaced apart from each other in the width direction of the ground sheet 240, while the second position limiting rib 2122 mainly consists of two second position limiting sub-ribs 2122*a* that are spaced apart from each other in the width direction of the ground sheet 240. The wire holder 250 is provided on the ground sheet 240 and clamped between the first position limiting rib 2121 and the second position limiting rib 2122.

Consequently, by providing the extension part 212 with the first position limiting rib 2121 and the second position limiting rib 2122 that are spaced apart from each other, and providing the wire holder 250 clamped between the first position limiting rib 2121 and the second position limiting rib 2122, the wire holder 250 may be mounted to the extension part 212 stably, which provides a simple structure and a low cost, and is convenient to assemble and easy to implement.

According to an embodiment of the present invention, the ground sheet 240 is provided with at least one ground screw 241, and the extension part 212 is provided with at least one seal sleeve 2123 fitted with the at least one ground screw 241. According to an embodiment of the present invention, a plurality of ground screws 241 are provided and spaced apart from one another along the length direction of the ground sheet 240.

In this embodiment, the ground sheet 240 is provided with the plurality of ground screws 241, while the extension part 212 is provided with a plurality of seal sleeves 2123 arranged along the length direction of the ground sheet 240. The number of the ground screws 241 on the ground sheet 240 is equal to that of the seal sleeves 2123 of the extension part 212. The plurality of ground screws 241 are fitted with the plurality of seal sleeves 2123 of the extension part 212 in one to one correspondence.

Alternatively, according to an embodiment of the present invention, a snap piece 242 is provided at at least one of two ends of the ground sheet 240 along the length direction thereof, and the extension part 212 is provided with a snap groove 2124 configured to be fitted with the snap piece 242.

Figure 33:
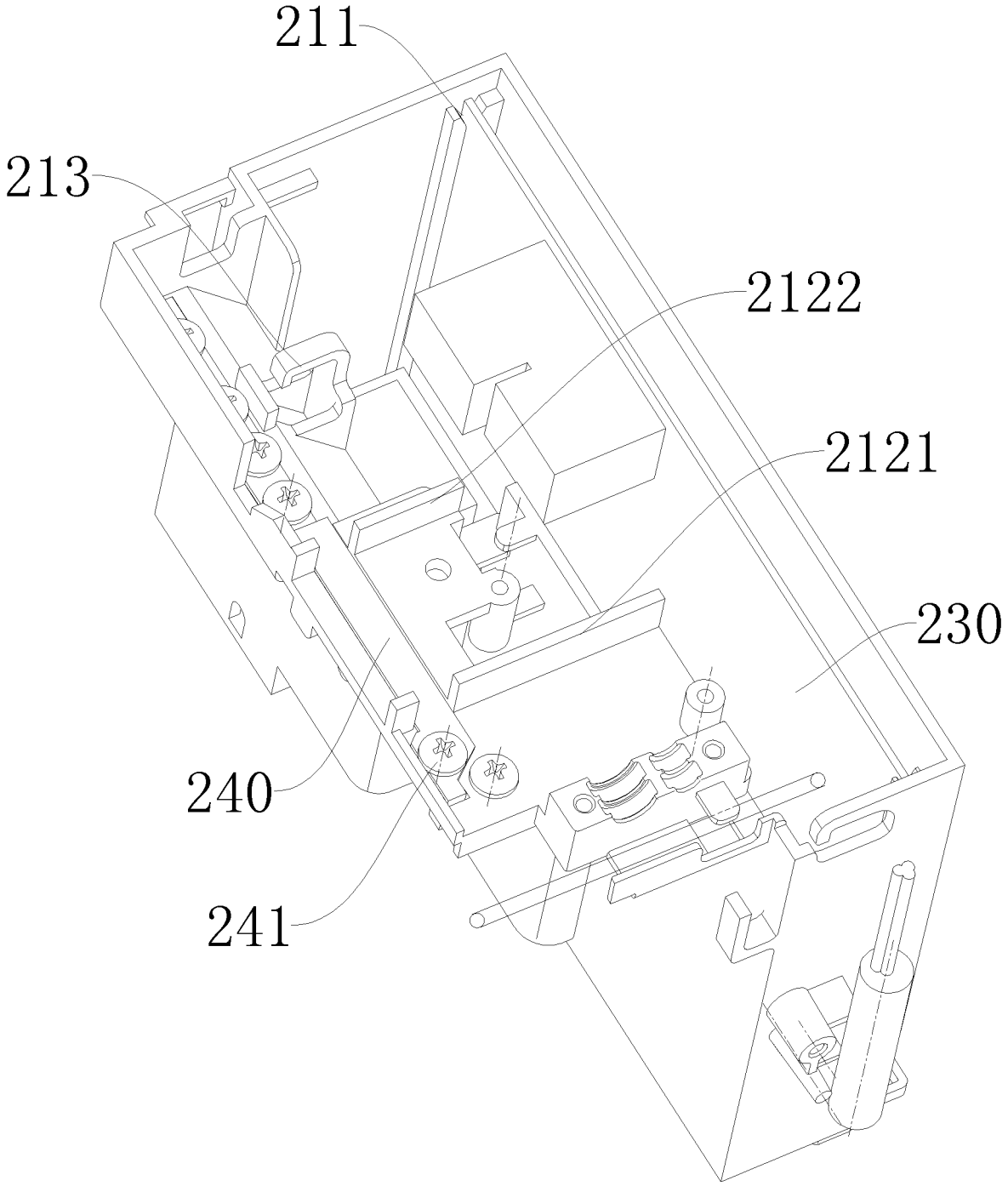
FIG. 33 is a partially schematic view of an electric control box assembly of an indoor unit for an air conditioner according to an embodiment of the present invention.

Specifically, as shown in FIG. 33, the ground sheet 240 substantially has a strip shape. The snap piece 242 is provided at one end of the ground sheet 240 along the length direction thereof, while the snap groove 2124 is provided in a position of the extension part 212 where the extension part 212 is fitted with the end of the ground sheet 240. When the ground sheet 240 is mounted to the extension part 212, the snap piece 242 of the ground sheet 240 is snapped into the snap groove 2124 of the extension part 212. Certainly, in this embodiment, the snap piece 242 may be provided at each of the two ends of the ground sheet 240. Correspondingly, the extension part 212 is provided with snap grooves 2124 fitted with the two snap pieces 242 of the ground sheet 240. Further, the ground sheet 240 is connected to the extension part 212 via a third threaded fastener.

In some specific embodiments of the present invention, the snap piece 242 is formed by bending a part of the ground sheet 240. That is, the snap piece 242 is integrally formed with the ground sheet 240. It can be understood that the snap piece 242 may be directly formed to the ground sheet 240 during the molding of the ground sheet 240. The integrally formed structure guarantees the structural stability of the ground sheet 240 and is convenient to mold at a low cost, and also makes the structure of the whole electric control box assembly 200 compact.

In this embodiment, the ground sheet 240 employs four ground screws 241, and adapts to various grounding manners. Moreover, one side of the ground sheet 240 is fixed with the snap groove 2124 of the electric control box body 210 via the snap piece 242, the other side thereof is fixed with the snap groove 2124 of the electric control box body 210 via a vertical rib, and a middle part thereof is fixed to a screw column of the electric control box body 210 via the ground screw 241. Moreover, the ground sheet 240 is pressed by the wire holder 250, and the wire holder 250 is an existing wire holder in the prior art, thus facilitating wiring by a user.

Figure 34:
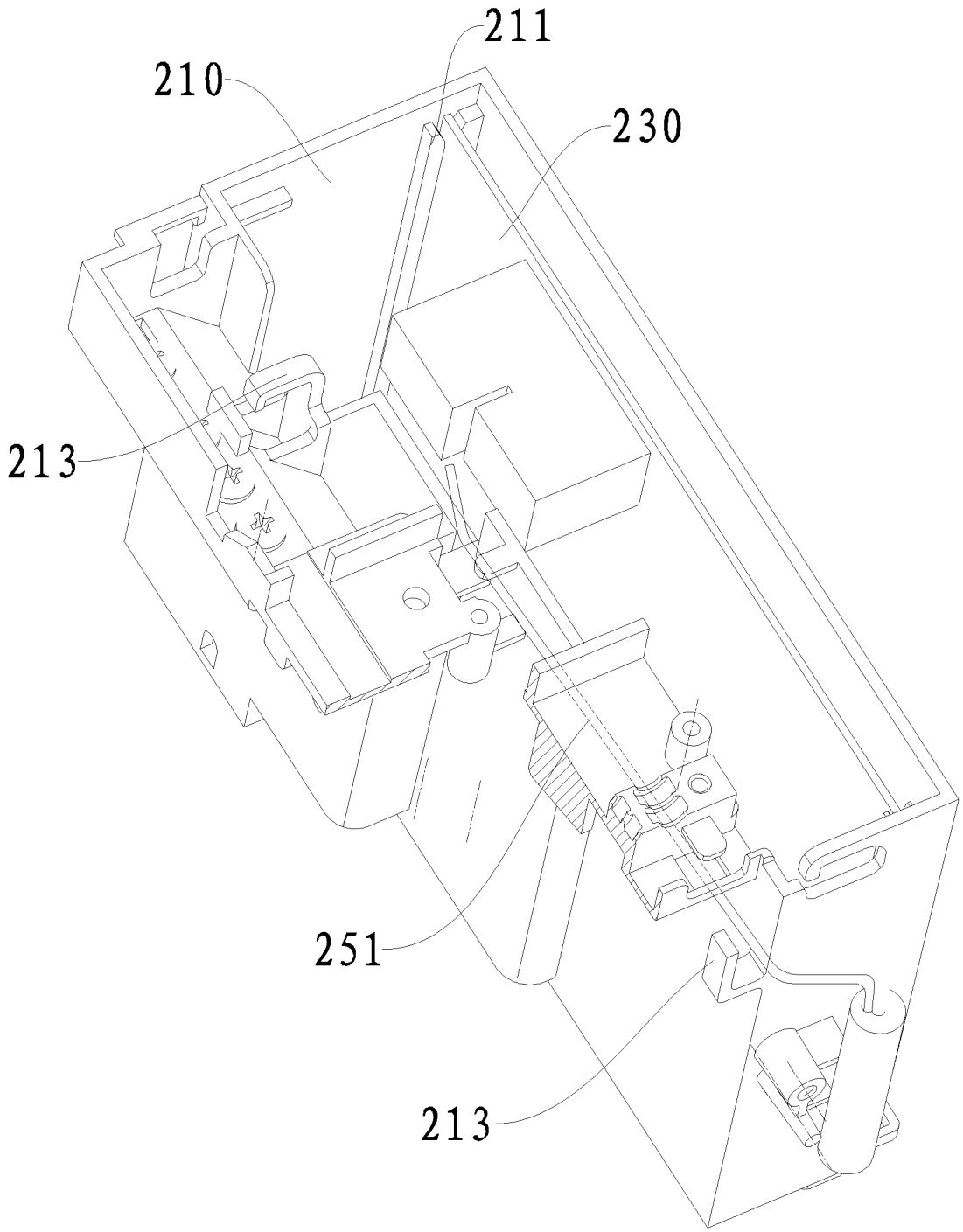
FIG. 34 is a partially schematic view of an electric control box assembly of an indoor unit for an air conditioner according to an embodiment of the present invention.
Figure 35:
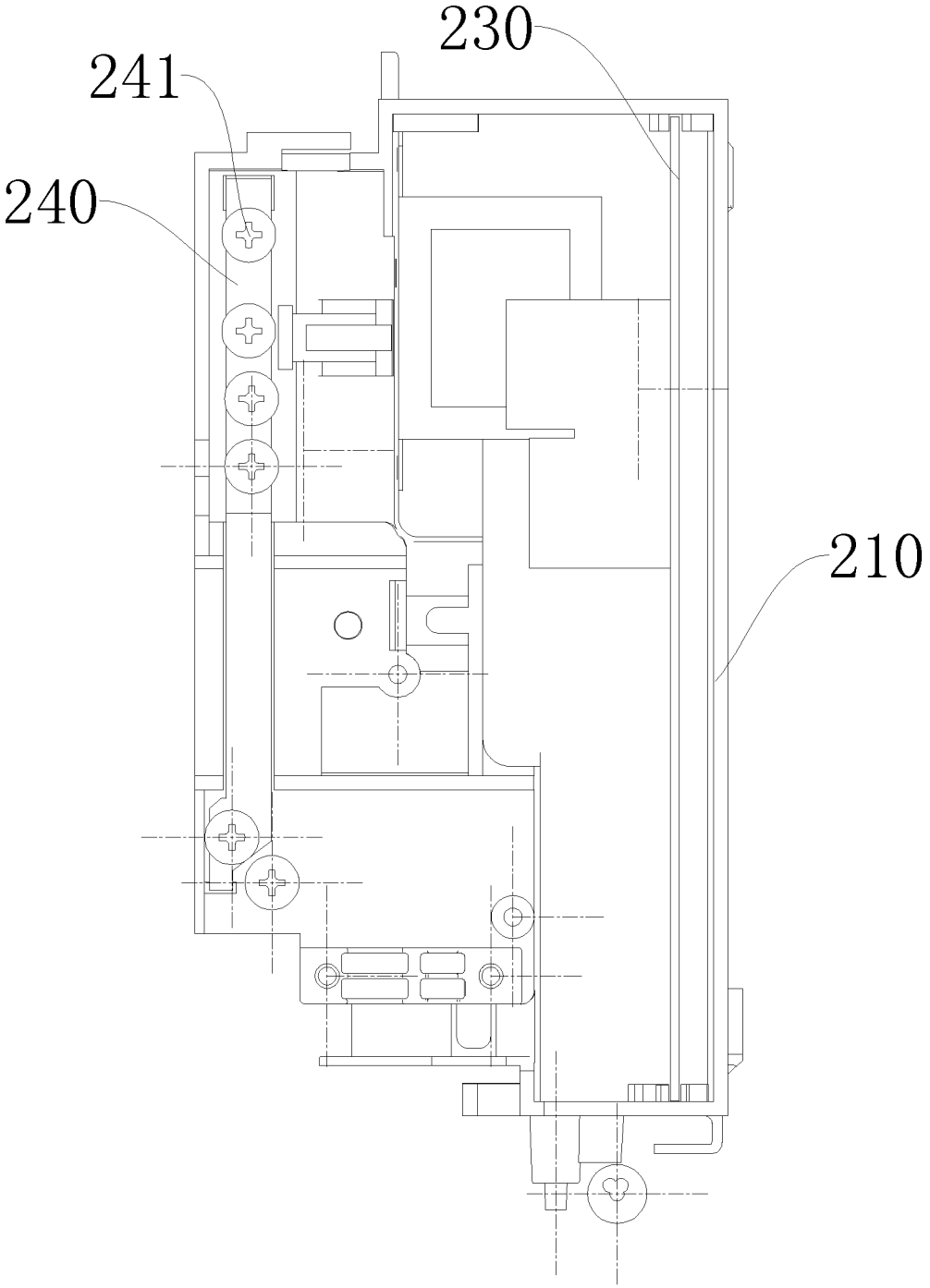
FIG. 35 is a schematic view of an electric control box assembly of an indoor unit for an air conditioner according to an embodiment of the present invention.
Figure 36:
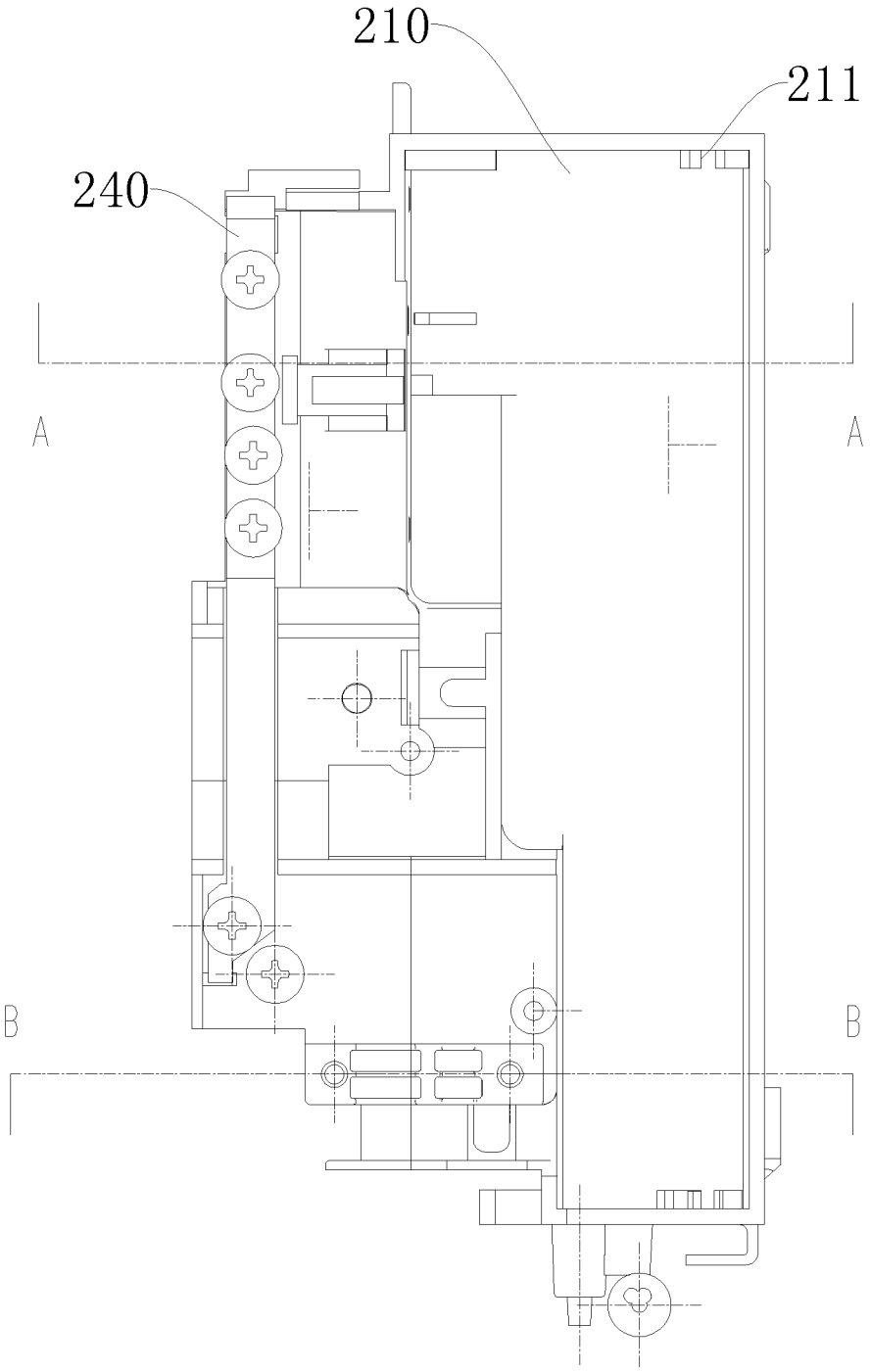
FIG. 36 is a schematic view of an electric control box assembly of an indoor unit for an air conditioner according to an embodiment of the present invention.
Figure 37:
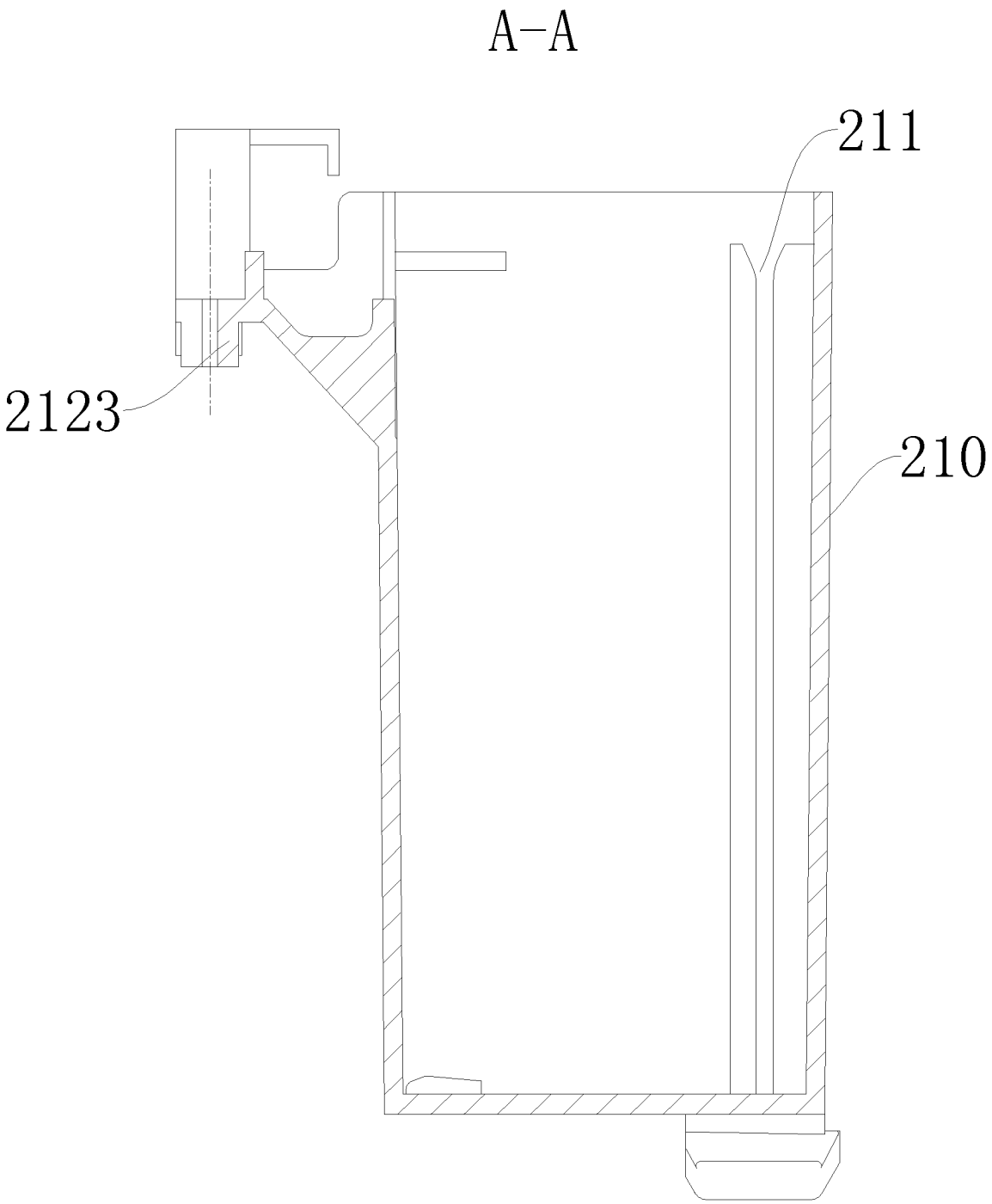
FIG. 37 is a sectional view along line A-A in FIG. 36.
Figure 38:
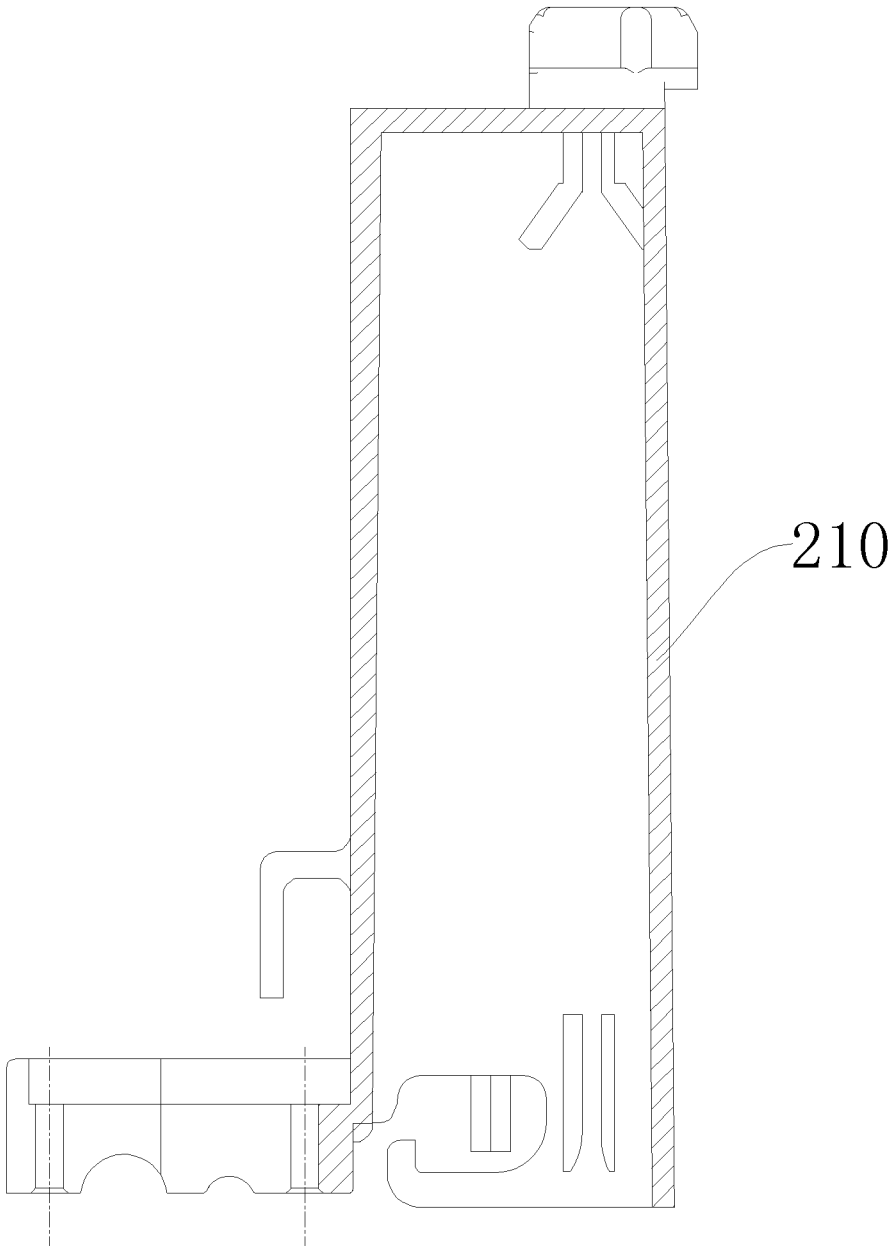
FIG. 38 is a sectional view along line B-B in FIG. 36.

Additionally, as shown in FIG. 34, according to an embodiment of the present invention, the electric control box body 210 is provided with a plurality of wire-running hooks 213. Since components in the electric control box body 210 need to be connected via a wire 251, the electric control box body 210 is provided with multiple wires 251. Thus, the wires 251 are arranged in the wire-running hooks 213, and then winded around a circumference of the electric control box body 210, such that the various wires 251 in the electric control box body 210 are arranged in good order, along with simplicity, safety and reliability.

According to an embodiment of the present invention, at least one fastener 214 is provided at a bottom of the electric control box body 210. By providing the fastener 214 at the bottom of the electric control box body 210, it is convenient to fix and mount the electric control box assembly 200 to the indoor unit 1000, so as to make the structure of the indoor unit 1000 stable and guarantee the normal operation of the system.

According to an embodiment of the present invention, the electric control box lid 220 is connected to the top of the electric control box body 210 via a snap 221. Specifically, a plurality of snaps 221 are provided at a front side of the electric control box lid 220, while the top of the electric control box body 210 is provided with a plurality of fixing bosses connected with the snaps 221 of the electric control box lid 220 in a snapping manner. The fixing bosses are in one to one correspondence with the snaps 221. Then, a rear side of the electric control box lid 220 is fixed with a rear side of the electric control box body 210 via a screw. In such a way, the electric control box lid 220 is connected to the top of the electric control box body 210 via the snap 221, which reduces the assembling of redundant connectors and considerably lowers the mounting cost. Moreover, the connection via the snap 221 decreases the assembling and disassembling procedures of the electric control box assembly 200 and improves the assembling efficiency of the electric control box assembly 200.

The other configurations and operations of the indoor unit 1000 according to embodiments of the present invention are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation or position as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable.

What is claimed is:

1. An indoor unit for an air conditioner, comprising:

a housing comprising an upper base plate provided with an air inlet, a lower base plate detachably mounted to the upper base plate and provided with an air outlet, and a front cover detachably mounted to the upper base plate;

a heat exchanger mounted to the upper base plate;

a fan detachably mounted to the lower base plate; and a guide assembly configured to guide the lower base plate when mounting and dismounting the lower base plate, the guide assembly including:

a guide groove provided at the upper base plate and including a first wall and a second wall facing each other, the guide groove including a position limiting protrusion that protrudes from the first wall towards the second wall and does not contact the second wall; and a guide rail provided at the lower base plate and configured to be fitted with the guide groove, the guide rail including a position limiting groove facing the position limiting protrusion when the guide rail is fitted with the guide groove.

2. The indoor unit according to claim 1, wherein the guide groove extends upwards from a bottom of the upper base plate and has an open bottom end, and at least one of a size of the guide groove in a left and right direction or a size of the guide groove in a front and rear direction is decreased gradually from down to up.

3. The indoor unit according to claim 2, wherein the guide rail has a shape decreased gradually from down to up in size and matched with a shape of the guide groove.

4. The indoor unit according to claim 1, wherein:

the position limiting protrusion is adjacent to an upper end of the guide groove; and the position limiting groove adjacent to an upper end of the guide rail.

5. The indoor unit according to claim 1, wherein the upper base plate is provided with a connecting groove, the lower base plate is provided with a connecting protrusion, and the connecting protrusion is configured to be fitted in the connecting groove.

6. The indoor unit according to claim 5, wherein the connecting groove is provided in the guide groove and adjacent to a lower end of the upper base plate.

7. The indoor unit according to claim 5, wherein the upper base plate is provided with an elastic arm, and the connecting groove is provided in the elastic arm.

8. The indoor unit according to claim 7, wherein ribs of the elastic arm located at both sides of the connecting groove are arranged in a stagger manner.

9. The indoor unit according to claim 8, wherein the elastic arm extends along an up and down direction, the connecting groove in the elastic arm extends along a left and right direction, and an inner side surface of a first rib of the elastic arm located behind the connecting groove protrudes inwards beyond an inner side surface of a second rib of the elastic arm located in front of the connecting groove.

10. The indoor unit according to claim 1, wherein the upper base plate comprises:

a rear baffle, the heat exchanger being provided to the rear baffle;

an upper cover plate having a rear edge connected with an upper edge of the rear baffle and formed with the air inlet therein;

a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate, wherein the lower base plate is detachably mounted at a right side of the left end plate and at a left side of the right end plate, the left end plate is located at a left side of the lower base plate and the right end plate is located at a right side of the lower base plate.

11. The indoor unit according to claim 10, wherein the upper base plate further comprises:

a left shield plate mounted to a left side of the left end plate; and a right shield plate mounted to a right side of the right end plate, wherein the front cover is detachably mounted to the left shield plate and the right shield plate.

12. The indoor unit according to claim 10, wherein a bending plate portion is provided at a rear portion of the upper cover plate and extends rearwards and downwards, and a wall-hung groove is defined between the bending plate portion and a rear wall of the upper base plate.

13. The indoor unit according to claim 10, wherein an air inlet grille is provided at the air inlet of the upper cover plate, and formed with the air inlet hole running through the upper cover plate.

14. The indoor unit according to claim 13, further comprising a filter mesh disposed in the upper base plate.

15. The indoor unit according to claim 14, wherein a supporting bar is disposed in front of the upper base plate, an inserting groove is defined between the supporting bar and the upper cover plate, and the filter mesh is fitted in the inserting groove in a drawable manner.

16. The indoor unit according to claim 15, wherein the supporting bar is located at a lower portion of the upper cover plate.

17. The indoor unit according to claim 1, comprising:

a middle supporter having a first end mounted to the upper base plate and a second end mounted to the lower base plate.

18. The indoor unit according to claim 17, wherein the first end of the middle supporter is mounted to a front surface of the upper base plate and the second end thereof is mounted to a front surface of the lower base plate, and the first end and the second end of the middle supporter are located in middle of the indoor unit in a left and right direction.

19. The indoor unit according to claim 17, wherein the front cover is detachably mounted to the upper base plate, the first end of the middle supporter is rotatably mounted to the upper base plate, and the second end thereof is mounted to the lower base plate via a second threaded fastener.

20. The indoor unit according to claim 19, wherein a first position limiting groove is provided in an inner surface of the front cover, and the second end of the middle supporter is provided with a tongue piece configured to be fitted with the first position limiting groove.

21. The indoor unit according to claim 19, wherein the first end of the middle supporter is provided with a rotating shaft, the upper base plate is provided a shaft hole, and the rotating shaft is rotatably fitted in the shaft hole.

22. The indoor unit according to claim 21, wherein the first end of the middle supporter is provided with an arc arm for pressing the middle supporter against the upper base plate, and the rotating shaft is provided on the arc arm.

23. The indoor unit according to claim 19, wherein the second end of the middle supporter is provided with a screw hole, the lower base plate is provided with a stud, and the second end of the middle supporter is mounted to the lower base plate via the second threaded fastener fitted in the screw hole and the stud.

24. The indoor unit according to claim 23, wherein the second end of the middle supporter is provided with a positioning boss, the positioning boss is provided with a positioning groove, and the stud is fitted in the positioning groove.

25. The indoor unit according to claim 1, further comprising an electric control box assembly that comprises:

an electric control box body;

an electric control box lid provided at a top of the electric control box body;

an electric control printed circuit board provided in the electric control box body and arranged along a vertical direction;

a ground sheet provided at the top of the electric control box body; and a wire holder provided at the top of the electric control box body and located on the ground sheet.

26. The indoor unit according to claim 25, wherein a mounting groove is formed in each of two opposite inner walls of the electric control box body, and each end of the electric control printed circuit board extends into a corresponding mounting groove.

27. The indoor unit according to claim 25, wherein an extension part is provided at the top of the electric control box body and extends in a direction running away from a center of the electric control box body, in which the ground sheet and the wire holder are provided on the extension part.

28. The indoor unit according to claim 27, wherein the extension part is provided with a first position limiting rib, and the first position limiting rib comprises two first position limiting sub-ribs that are spaced apart from each other in a width direction of the ground sheet.

29. The indoor unit according to claim 28, wherein the extension part is provided with a second position limiting rib spaced apart from the first position limiting rib in a length direction of the ground sheet, and the second position limiting rib comprises two second position limiting sub-ribs that are spaced apart from each other in the width direction of the ground sheet, wherein the wire holder is disposed between the first position limiting rib and the second position limiting rib.

30. The indoor unit according to claim 27, wherein the ground sheet is provided with at least one ground screw, and the extension part is provided with at least one seal sleeve fitted with the at least one ground screw.

31. The indoor unit according to claim 27, wherein a snap piece is provided at at least one of two ends of the ground sheet along the length direction thereof, and the extension part is provided with a snap groove fitted with the snap piece.

32. The indoor unit according to claim 31, wherein the snap piece is formed by bending a part of the ground sheet.

33. The indoor unit according to claim 25, wherein the electric control box assembly is detachably mounted to the upper base plate.

34. The indoor unit according to claim 33, wherein the upper base plate defines a mounting space at an end of the heat exchanger, and the electric control box assembly is disposed in the mounting space.

* * * * *